US005678135A

United States Patent [19]

Fukui et al.

[11] Patent Number: 5,678,135

[45] Date of Patent: Oct. 14, 1997

[54] IMAGE FORMING APPARATUS FOR A MULTIPLEX COPYING SYSTEM

[75] Inventors: Tomonori Fukui; Yukio Abe, both of Tokyo; Makoto Hidaka, Yokohama; Yasuhiro Kishimoto; Manabu Komatsu, both of Tokyo; Yasuhiro Tabata, Kawasaki, all of Japan

[73] Assignee: Ricoh Company, Ltd., Tokyo, Japan

[21] Appl. No.: 493,160

[22] Filed: Jun. 21, 1995

[30] Foreign Application Priority Data

| | | | |
|---|---|---|---|
| Jun. 21, 1994 | [JP] | Japan | 6-139182 |
| Jun. 27, 1994 | [JP] | Japan | 6-144812 |
| Jul. 6, 1994 | [JP] | Japan | 6-154830 |
| Aug. 29, 1994 | [JP] | Japan | 6-203687 |
| Jun. 2, 1995 | [JP] | Japan | 7-136800 |

[51] Int. Cl.[6] ..... G03G 15/00; G03G 21/14

[52] U.S. Cl. ..... 399/77; 345/902; 399/81; 399/407

[58] Field of Search ..... 355/200, 206, 355/209; 340/712, 715, 745; 399/67, 77, 81, 407, 410; 345/146, 902

[56] References Cited

U.S. PATENT DOCUMENTS 5,159,324 10/1992 Ohtani et al. ..... 340/712

FOREIGN PATENT DOCUMENTS

| | | |
|---|---|---|
| 62-81653 | 4/1987 | Japan . |
| 63-212953 | 9/1988 | Japan . |
| 64-61765 | 3/1989 | Japan . |
| 3-223902 | 10/1991 | Japan . |
| 3-268139 | 11/1991 | Japan . |
| 4-172528 | 6/1992 | Japan . |
| 4-301655 | 10/1992 | Japan . |
| 5-80602 | 4/1993 | Japan . |
| 5-80610 | 4/1993 | Japan . |
| 5-88433 | 4/1993 | Japan . |

*Primary Examiner*—William J. Royer

*Attorney, Agent, or Firm*—Oblon, Spivak, McClelland, Maier & Neustadt, P.C.

[57] ABSTRACT

An image forming apparatus for a multiplex copying system in which indefinite peripherals having various additional functions may be connected to the body of the apparatus. The version of the apparatus body is adjusted surely and adequately in matching relation to the versions of the peripherals. The apparatus body is, therefore, capable of cooperating with the peripherals newly connected thereto.

39 Claims, 68 Drawing Sheets

8 BIT DATA

4 BIT DATA

1 BIT DATA

TYPE 1

TYPE 2

TYPE 3

Flg. 18

Fig. 19

PLEASE SET FLOPPY DISK
(NO.XX) ON FLOPPY DISK DRIVE.

Fig. 20

WRONG DISK IS SET.
PLEASE SET CORRECT FLOPPY
DISK.

| Fig. 22A | Fig. 22B |
|---|---|

STAPLE UNIT STAPLES FROM BELOW.

Fig. 59

| ADF DOCUMENT FEED | SORTER PAPER DISCHARGE | BODY TURN-OVER MECHANISM |
|---|---|---|
| FROM PAGE 1 | FACE-UP DISCHARGE | OPERATED |
| FROM PAGE 1 | FACE-DOWN DISCHARGE | NOT OPERATED |
| FROM LAST PAGE | FACE-UP DISCHARGE | NOT OPERATED |
| FROM LAST PAGE | FACE-DOWN DISCHARGE | OPERATED |

Fig. 60

| ADF DOCUMENT FEED | SORTER PAPER DISCHARGE | SORTER TURN-OVER MECHANISM |
|---|---|---|
| FROM PAGE 1 | FACE-UP DISCHARGE | OPERATED |
| FROM PAGE 1 | FACE-DOWN DISCHARGE | NOT OPERATED |
| FROM LAST PAGE | FACE-UP DISCHARGE | NOT OPERATED |
| FROM LAST PAGE | FACE-DOWN DISCHARGE | OPERATED |

Fig. 61

| ADF DOCUMENT FEED | SORTER PAPER DISCHARGE | BODY MEMORY TURN-OVER MECHANISM |
|---|---|---|
| FROM PAGE 1 | FACE-UP DISCHARGE | OPERATED |
| FROM PAGE 1 | FACE-DOWN DISCHARGE | NOT OPERATED |
| FROM LAST PAGE | FACE-UP DISCHARGE | NOT OPERATED |
| FROM LAST PAGE | FACE-DOWN DISCHARGE | OPERATED |

Fig. 65

| RDH DOCUMENT FEED | FINISHER PAPER DISCHARGE | BODY TURN-OVER MECHANISM |
|---|---|---|
| FROM PAGE 1 | FACE-UP DISCHARGE | OPERATED |
| FROM PAGE 1 | FACE-DOWN DISCHARGE | NOT OPERATED |
| FROM LAST PAGE | FACE-UP DISCHARGE | NOT OPERATED |
| FROM LAST PAGE | FACE-DOWN DISCHARGE | OPERATED |

Fig. 66

| RDH DOCUMENT FEED | FINISHER PAPER DISCHARGE | FINISHER TURN-OVER MECHANISM |
|---|---|---|
| FROM PAGE 1 | FACE-UP DISCHARGE | OPERATED |
| FROM PAGE 1 | FACE-DOWN DISCHARGE | NOT OPERATED |
| FROM LAST PAGE | FACE-UP DISCHARGE | NOT OPERATED |
| FROM LAST PAGE | FACE-DOWN DISCHARGE | OPERATED |

Fig. 67

| RDH DOCUMENT FEED | FINISHER PAPER DISCHARGE | FINISHER TURN-OVER MECHANISM |
|---|---|---|
| FROM PAGE 1 | FACE-UP DISCHARGE | OPERATED |
| FROM PAGE 1 | FACE-DOWN DISCHARGE | NOT OPERATED |
| FROM LAST PAGE | FACE-UP DISCHARGE | NOT OPERATED |
| FROM LAST PAGE | FACE-DOWN DISCHARGE | OPERATED |

IMAGE FORMING APPARATUS FOR A MULTIPLEX COPYING SYSTEM

BACKGROUND OF THE INVENTION

The present invention relates to an image forming apparatus for a multiplex copying system in which indefinite peripherals having various additional functions may be connected to the body of the apparatus.

It is a common practice with an image forming apparatus for the above application to register data relating to some peripherals at the apparatus body beforehand. When a desired peripheral is connected to the apparatus body, the data relating to the peripheral are selected in order to set a display section and a control section optimally. However, the number of peripherals which can be registered at the apparatus body is limited. Moreover, newly developed peripherals cannot be used with the apparatus body. Although data relating to future peripherals may, of course, be registered at the apparatus body beforehand, this also has its limit. Further, when the apparatus body lacks functions matching the additional functions of peripherals, e.g., a sorting function, stapling function, punching function, folding function, stamping function, mail box function and other postprocessing functions, and an automatic document feeding (ADF) function, recycling document handling (RDH) function and other preprocessing functions, the apparatus body cannot cooperate with such peripherals. In addition, when the apparatus body lacks a function of reporting the operator that such peripherals cannot be connected to the apparatus body, it is impossible for the operator to recognize the situation before actually connecting them to the apparatus body.

The image forming apparatus to which the peripherals are connected will be able to make the most of their additional functions if the version of the apparatus body is matched to the versions of the peripherals by adjustment. However, technologies relating the this kind of version adjustment have not been reported yet. Implementations for rewriting programs stored in the apparatus body are disclosed in Japanese Patent Laid-Open Publication Nos. 62-81643, 3-223902, 5-80602, 4-301655, 4-172528, and 3-268139. Laid-Open Publication No. 5-80602, for example, teaches an image forming apparatus in which setting keys relating to all the expected additional functions are arranged on an operation panel. However, the setting keys not relating to the peripherals actually connected to the apparatus body are not desirable from the easy operation standpoint.

SUMMARY OF THE INVENTION

It is, therefore, an object of the present invention to provide an image forming apparatus for a multiplex copying system and capable of adjusting the version of its body surely and adequately on the basis of the versions of indefinite peripherals.

In accordance with the present invention, an image forming apparatus is capable of adjusting, when an indefinite peripheral is connected thereto, the version of its body on the basis of the version of the additional function of the peripheral. The apparatus has a display device for displaying setting keys for entering commands. The display device displays only minimum necessary setting keys. Circuitry is provided for selecting, based on identification symbols respectively assigned to the peripheral and the body beforehand, a program for control necessary for a version adjustment and a program relating to the display of setting keys relating to the additional function on the display device, and for supplying the programs to the body, whereby the version adjustment is executed.

Also, in accordance with the present invention, an image forming apparatus is provided for an image forming system in which the version of the body of the apparatus is adequately adjusted on the basis of the version of a postprocessing peripheral connected to the body.

Further, in accordance with the present invention, an image forming apparatus to which an indefinite peripheral is connectable has a body, and an adjusting device for adjusting the version of the body adequately on the basis of the combination of a preprocessing peripheral and a postprocessing peripheral connected to the body.

BRIEF DESCRIPTION OF THE DRAWINGS

The above and other objects, features and advantages of the present invention will become more apparent from the following detailed description taken with the accompanying drawings in which:

FIG. 19 shows a specific message for urging the operator to set a floppy disk storing necessary updating programs;

FIG. 20 shows a specific message showing that the necessary programs cannot be read out of the floppy disk;

FIG. 59 lists the combinations of the document feed order of the automatic document feeder, the paper discharge direction of the sorter, and the operation of a turn-over mechanism included in the copier body;

FIG. 60 lists the combinations of the document feed order of the automatic document feeder, the paper discharge direction of the sorter, and the operation of a turn-over mechanism included in the sorter;

FIG. 61 lists the combinations of the document feed direction of the automatic document feeder, the paper discharge direction of the sorter, and the reversal effected by the copier body by using a memory;

FIG. 65 lists the combinations of the document feed direction of the document handler, the paper discharge direction of the finisher, and the turn-over mechanism of the copier body;

FIG. 66 lists the combinations of the document feed direction of the document handler, the paper discharge direction of the finisher, and a turn-over mechanism included in the finisher;

FIG. 67 lists the combinations of the paper discharge direction of the document handler, the paper discharge direction of the finisher, and the reversal effected by the copier body by using a memory.

DESCRIPTION OF THE PREFERRED EMBODIMENTS

Figure 1:
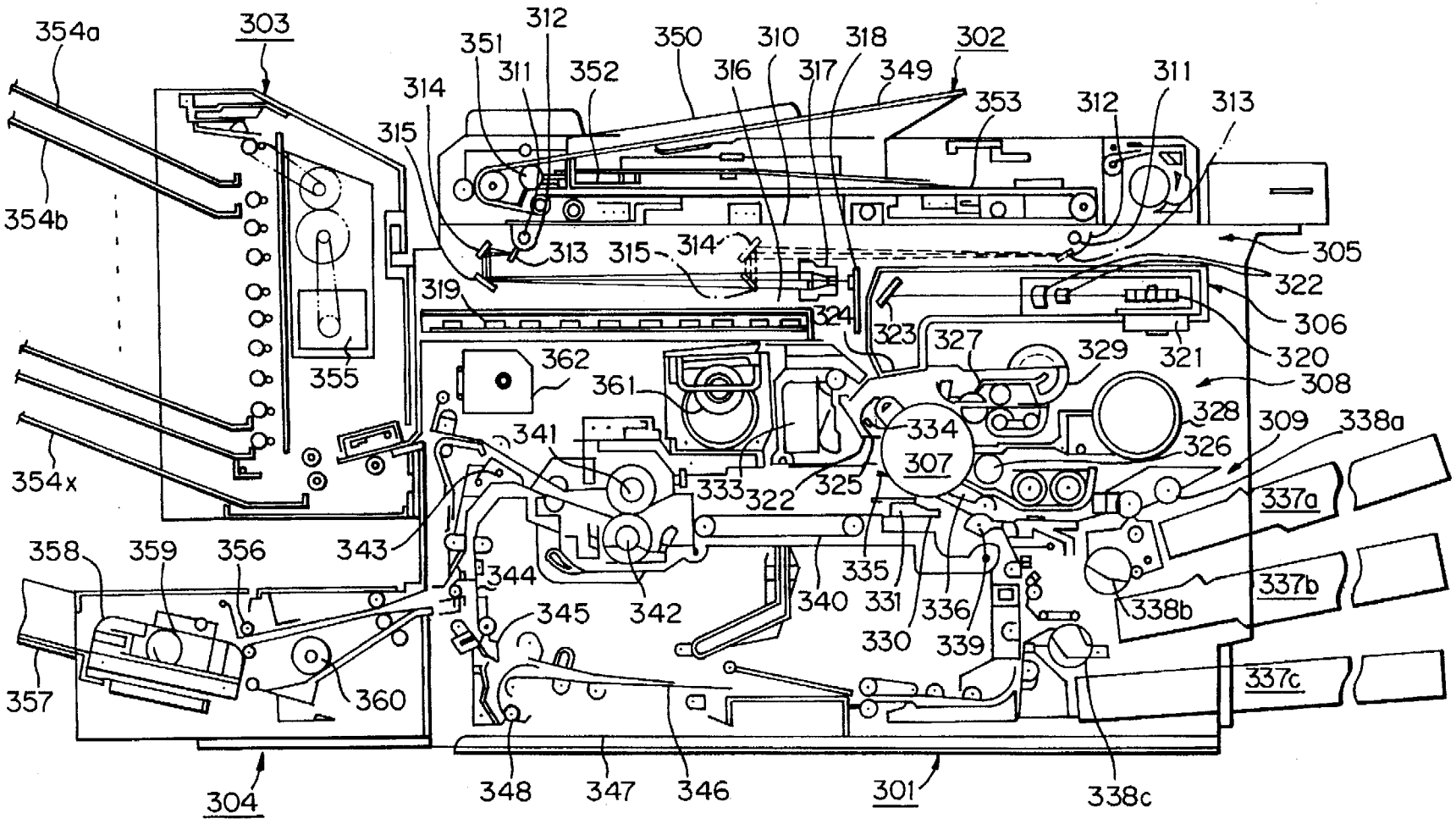
FIG. 1 is a section showing an image forming apparatus embodying the present invention and implemented as a digital copier by way of example.

Referring to FIG. 1 of the drawings, an image forming apparatus embodying the present invention is shown and implemented as a digital copier by way of example. As shown, the copier has a copier body 301, an ADF (Automatic Document Feeder) 302, a sorter 303, and a duplex copy unit 304. The copier body 301 has a scanner section 305, an optical image writing section 306, an image forming section 307 including a photoconductive element, a developing section 308, a paper feeding section 309, etc.

The scanner section 305 includes a transparent glass platen 310 on which a document, not shown, is to be laid. A lamp 311 illuminates the document and is implemented by, for example, a fluorescent lamp or a halogen lamp. A reflector 312 reflects light issuing from the lamp 311 toward the document. A first mirror 313 reflects an imagewise reflection from the document toward a second minor 314. The second mirror 314 reflects the incident light toward a third minor 315. The third mirror 315 steers the incident light to a color filter 316 which transmits light of necessary color. A lens 317 focuses the incident light onto a CCD (Charge Coupled Device) image sensor 318. The image sensor 318 transforms the incident light to an electric image signal. An image processing board 319 executes conventional image processing with the image signal. The image processing includes shading correction, MTF (Modulation Transfer function) correction, bilevel and multilevel processing, tonality processing, magnification, and image editing.

The image writing section 306 has a polygonal mirror 320 which is rotated at a high speed for steering a laser beam incident thereto. The mirror 320 has minor elements mounted on the sides of a polygonal body and is driven by a polygon motor 321. An f-theta lens 322 causes the laser beam, deflected at an equal angular pitch, to scan the surface of a photoconductive element 307 at an equal linear pitch. In the illustrative embodiment, the photoconductive element 307 is implemented as a drum. The laser beam from the lens 322 is guided to the drum 307 by a mirror 323. A dust-proof glass 324 prevents dust and other impurities from entering the image writing section 306.

Various units for forming an electrostatic latent image are arranged around the drum 307, as follows. A main charger 325 charges the surface of the drum 307 uniformly. The image writing section 306 scans the charged surface of the drum 307 with the laser beam. The illuminated portions of the drum 307 are lowered in potential. Specifically, a potential of −750 V to −800 V and a potential of −500 V are respectively deposited in the background and the image portions of the drum 307. As a result, a latent image corresponding to the document image is electrostatically formed on the surface of the drum 307.

In the embodiment, the developing section 308 has a first developing unit 326 storing black toner, and a second developing unit 327 storing color toner. The black toner and the color toner are respectively replenished from a black toner cartridge 328 and a color toner cartridge 329. A transfer charger 330 transfers a toner image from the drum 307 to a paper. A separation charger 331 is constructed integrally with the transfer charger 330 and separates the paper from the drum 307 by AC discharge. A cleaning blade 332 removes the toner left on the drum 307 after image transfer. The toner removed by the blade 332, i.e., waste toner is collected in a tank 333. A discharge lamp 334 dissipates the charge also left on the drum 307 after image transfer by illuminating the drum 307. A separator 335 lightly contacts the drum 307 in order to help the charger 331 separate the paper. A photosensor 336 senses a reflection density from the surface of the drum 307.

The paper feeding section 309 has paper cassettes 337*a*, 337*b* and 337*c* each being loaded with papers of particular size. Pick-up rollers 338*a*, 338*b* and 338*c* are respectively associated with the cassettes 337*a*–337*c*, and each feeds one paper at a time. A registration roller 339 drives, at a predetermined timing, the sheet fed thereto from one of the cassettes 337*a*–337*c* to a transfer position where the transfer charger 330 is located. A belt 340 conveys the paper that has undergone the image transfer away from the transfer position. A heat roller 341 has a heater thereinside and is heated to a predetermined temperature. A press roller 342 is pressed against the heat roller 341 under a predetermined pressure.

The image forming section and paper feeding section 309 are operated as follows. The cassettes 337*a*–337*c* are removably mounted to the copier body 301. A paper fed from any one of the cassettes 337*a*–337*c* by the associated pick-up roller 338*a*, 338*b* or 338*c* is once stopped by the registration roller 339 and then driven toward the drum 307 at a predetermined timing. The drum 307 is rotated clockwise, as viewed in the figure. The transfer charger 330 transfers the toner image from the drum 307 to the paper that has reached the transfer position. The separation charger 331 separates the paper from the drum 307 electrostatically. The paper carrying the toner image thereon is conveyed by the belt 340 to between the heat roller 341 and the press roller 342. The rollers 341 and 342 cooperate to fix the toner image on the paper. After the image transfer, the toner remaining on the drum 307 is removed by the cleaning blade 332 while the charge left on the drum 307 is dissipated by the discharge lamp 334. As a result, the drum 307 is prepared for the next image forming cycle.

A path selector 343 switches over the direction in which the paper having the toner image fixed thereon is to be conveyed. A path selector 344 steers the paper into the duplex copy unit 304. Further, a path selector 345 steers the paper toward a refeed section 346. A tray 347 is provided for turning over the paper. A roller 348 conveys the paper to the tray 347 and then rotates in the opposite direction to refeed it from the trailing edge.

In a duplex copy mode, the paper guided downward by the path selector 343 is further guided downward by the path selector 344. Then, the path selector 345 drives the paper toward the roller 348 which in turn drives it onto the tray 347. As soon as the trailing edge of the paper reaches the roller 348, the roller 348 conveys the paper in the opposite direction. At this instant, the path selector 345 is so positioned as to steer the paper from the roller 348 to the refeed section 346. As a result, the paper is refed to the registration roller 339 via the refeed section 346.

The ADF 302 has a tray 349 to be loaded with a stack of documents. Side guides 350 are provided on the tray 349 for positioning the document stack on the basis of document size. A pick-up roller 351 feeds one document at a time from the tray 349. A belt 352 conveys the document fed from the tray 349 to a predetermined position on the glass platen 310. The document copied by the previously stated procedure is driven out to a table 353. Specifically, after the documents stacked on the tray 349 have been positioned by the side guides 350 in the widthwise direction, they are fed by the pick-up roller 351 one by one. The belt 352 conveys the document to the predetermined position on the glass platen 310 and stops it there. At this position, the document is scanned, as stated earlier. After the document has been copied a desired number of times, it is driven out to the table 353 by the belt 352. It is to be noted that the document size is determined on the basis of the position of the side guides 350 and by counting the document feed time.

The sorter 303 has bins 354*a*–354*x* and a motor 355 for driving a plurality of conveyor rollers included in the sorter 303. When copies are sequentially driven out of the copier body 303, the sorter 303 selectively sorts them into the bins 354*a*–354*x* in order of page, or stacks them in the bins 354*a*–354*x* page by page, or delivers them to preselected ones of the bins 354*a*–354*x* in a mail box fashion. Each copy conveyed by the rollers is guided into a particular bin by a pawl adjoining the inlet of the bin.

The duplex copy unit 304 has a conveyor roller 356, a tray 357, a guide 358, a conveyor roller 359, and a refeed roller 360. The roller 356 stacks papers, i.e., one-sided copies sequentially driven out of the copier body 301 on the tray 357. The guide 358 positions the papers on the tray 357. The roller 359 conveys the papers while positioning them. The refeed roller 360 again drives the papers into the copier body 301. In operation, when a plurality of duplex or two-sided copies are to be produced, the path selector 343 is so positioned as to steer the one-sided copies to the duplex copy unit 304. The copies are sequentially stacked on the tray 357 by the roller 356 while being positioned by the roller 359 and guide 358 in the longitudinal and lateral directions. Then, the refeed roller 360 feeds the copies to the refeed section 346 one by one. As a result, a toner image is formed on the rear of the copy to produce a duplex copy. With the refeed section 346 of the copier body 301 alone, only a single duplex copy is available at a time. However, by connecting the duplex copy unit 304 to the copier body 301, it is possible to produce a plurality of duplex copies at once.

There are also shown in FIG. 1 a main motor 361 for driving various rollers included in the copier body 301, and a fan motor 362 for maintaining the temperature inside the copier body 301 lower than a predetermined level.

Figure 2:
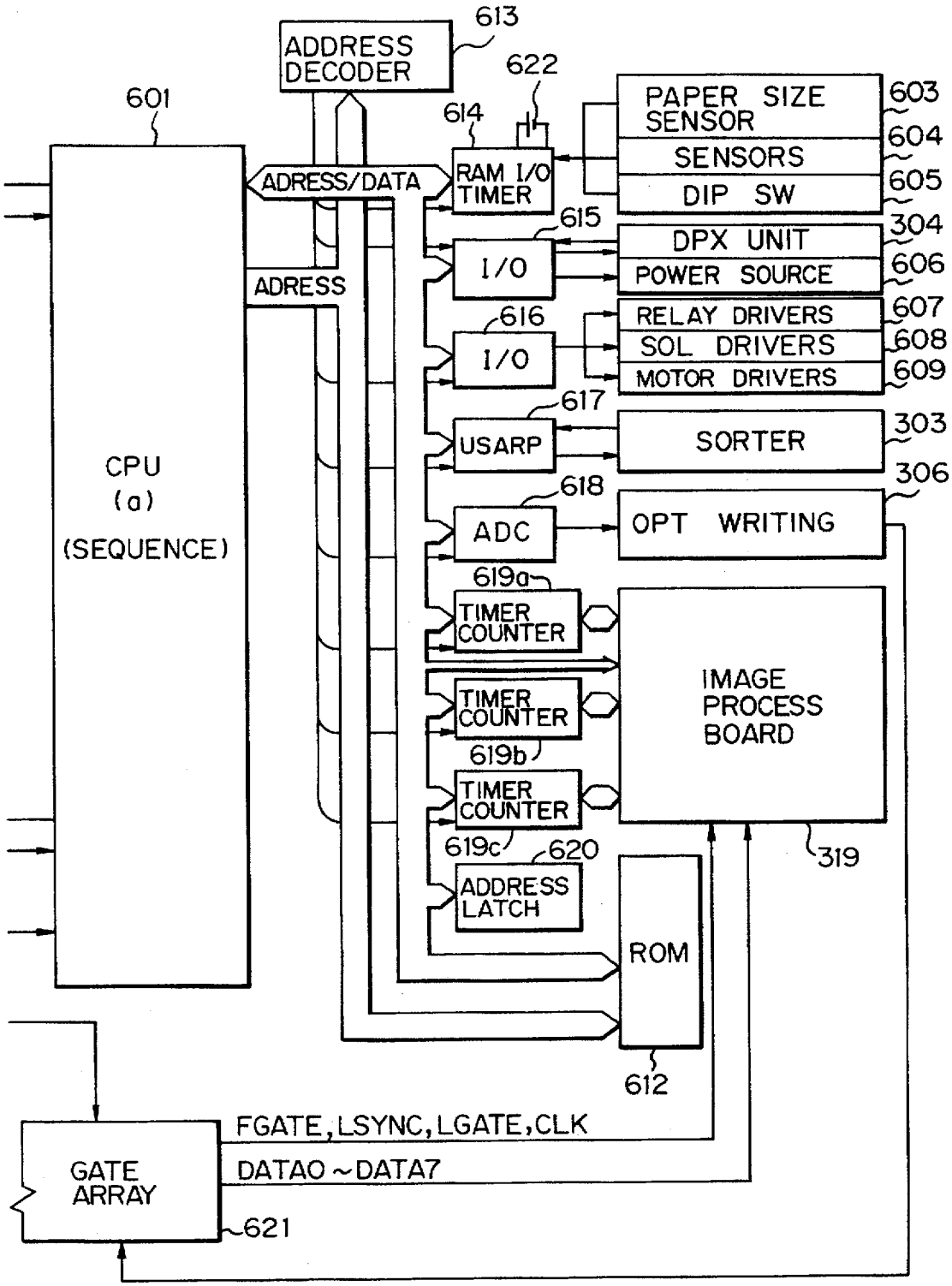
FIGS. 2 and 3 are block diagrams schematically showing, when combined, a control system included in the embodiment.
Figure 3:
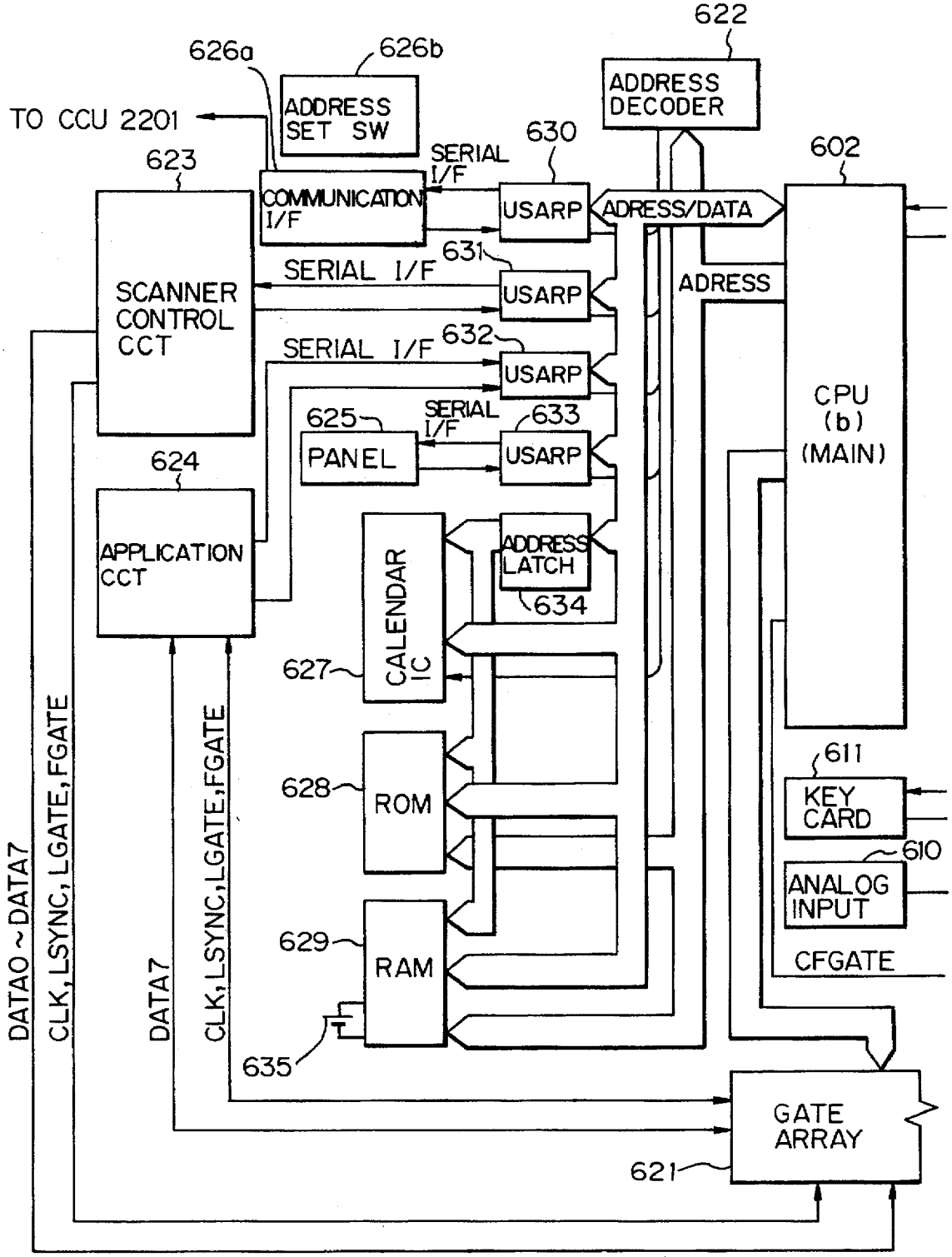

Referring to FIGS. 2 and 3, a control section included in the copier will be described. As shown, the control section includes a CPU (Central Processing Unit) (a) 601 for sequence control, and a CPU(b) for controlling the entire operation of the copier. The CPU(a) 601 and CPU(b) 602 are connected by a serial interface (RS232C). A paper size sensor 603 is responsive to the size of papers stacked in each paper cassette. Sensors 604 include a registration sensor and a paper output sensor. Dip switches 605 are used to set various conditions including the amount of loop of a paper at the registration roller 339, and the margin at the leading edge of a paper. A high-tension power source 606 applies a particular high voltage to each of the main charger 325, transfer charger 330, separation charger 331, and a bias electrode for development, not shown. Relay drivers 607 drive power relays. Solenoid drivers 608 drive a toner supply solenoid, solenoids of paper feed clutches, and clutches. Motor drivers 609 drive the main motor 361, fan motor 362, and other motors.

An analog input section 610 receives data representative of the temperature of the heat roller 341, the output of the photosensor 336, the monitor output of a semiconductor laser 401, and the reference voltage of the laser 401. A key card unit 611 is capable of reading key cards each being assigned to a particular operator. A ROM (Read Only Memory) 612 stores various control conditions in a program. An address decoder 613 is assigned to the CPU(a) 601, A RAM (Random Access Memory), I/O (Input/Output) port and timer 614 are connected to the sensors 603–605. A nonvolatile battery 622 backs up the RAM 614. An I/O port 615 is assigned to the duplex copy unit (DPX) 304 and high-tension power source 606. An I/O port 616 is assigned to the relay drivers 607, solenoid drivers 608, and motor drivers 609. A USARP 617 is connected to the sorter 303 by a serial interface. An analog-to-digital converter (ADC) 618 transforms analog data to digital data and delivers the digital data to the image writing section 306. Timer counters **619*a*–619*c* each allows particular processing to be executed on the basis of a particular time width. The reference numeral 620** designates an address latch.

A gate array 621 selectively outputs image data (DATA0–DATA7) to the image processing board 319, a scanner control circuit 623, and an application circuit (APL) 624 in response to a select signal from the CPU(b) 602. An address decoder 636 is assigned to the CPU(b) 602. The application circuit 624 interfaces the CPU(b) 602 to external apparatuses (facsimile apparatus, printer, etc.) and outputs signals on the basis of predetermined information.

An operation and display panel (PANEL) 625 has keys accessible for entering a desired copy mode and other information, and a display for displaying the statuses of the copier. A communication interface unit (PI) **626*a* is connected to a communication control unit (CCU) 2201 which controls communication with an external managing unit 2203. An address setting switch 626b is available for setting an address particular to the copier when a plurality of copiers are connected to the CCU 2201. A calendar IC (Integrated Circuit) 627 stores date and time and delivers them to the CPU(b) 602, as needed. A ROM 628 stores a program assigned to the CPU(b). A RAM 629 is also assigned to the CPU(b) 602. A nonvolatile battery 635 backs up the RAM 629. A USARP 633 is connected to the operation and display panel 625 by a serial interface. A USARP 631 is connected to the scanner control circuit 623 by a serial interface. A USARP 632 is connected to the application circuit 624 by a serial interface. A USARP 630 is connected to the communication interface unit 626*a* by a serial interface. An address latch 634 is assigned to the calendar IC 627**.

In operation, the CPU(a) 601 controls paper conveyance, image forming conditions, and other factors relating to the sequence. For example, the paper size sensor 603 senses the size and feed direction of the papers loaded in the cassette 337. In response to the output of the sensor 603, the CPU(a) 601 controls the conveyance of the paper, image formation, etc. In addition, the outputs of the sensors 604, including the registration sensor and paper output sensor, and the conditions set by the dip switches 605 are input to the CPU(a) 601. In response, the CPU(a) 601 detects a jam and controls the interval between consecutive papers as well as the image formation.

The DPX unit 304 interchanges with the CPU(a) 601 data relating to a motor for positioning papers in the lateral direction, a paper feed clutch, a solenoid for switching over the path, a solenoid for moving a roller for positioning papers, a paper sensor, a home position sensor associated with side fences, and sensors responsive to paper conveyance. The sorter 303, connected to the CPU(a) 601 by a serial interface, conveys papers at predetermined timings to the bins **354*a*–354*x* in response to a control signal from the CPU(a) 601. The temperature of the heat roller 341, which is one of the data input to the analog input 610, is sensed by a thermistor, not shown, adjoining the surface of the heat roller 341. The CPU(a)601 ON/OFF controls the heater of the roller 341 such that the roller 341** is maintained in a predetermined temperature range.

The CPU(b) or main CPU 602, assigned to the operation, controls the calendar IC 627 and a plurality of serial ports. Connected to the serial ports are the CPU(a) 601, operation and display panel 625, scanner control circuit 623, application circuit 624, communication interface unit (PI) **626*a*, etc. The panel 625 sends key inputs to the CPU(b) 602 by serial transmission or turns on the display by serial receipt from the CPU(b) 602. The scanner control circuit 623 sends data relating to the drive of a scanner servo motor, image processing and image reading to the CPU(b) 602 by serial transmission. In addition, the circuit 623 interfaces the ADF 302 to the CPU(b) 602. The application circuit 624 interchanges predetermined data with the external apparatuses (facsimile apparatus, printer, etc.). The CPU(b) 602 reads the date and time out of the calendar IC 627, as needed, and displays them on the panel 625. In addition, with the date and time, the CPU(b) 602** executes timer control, e.g., turns on the copier and turns it off at desired times.

Figure 4:
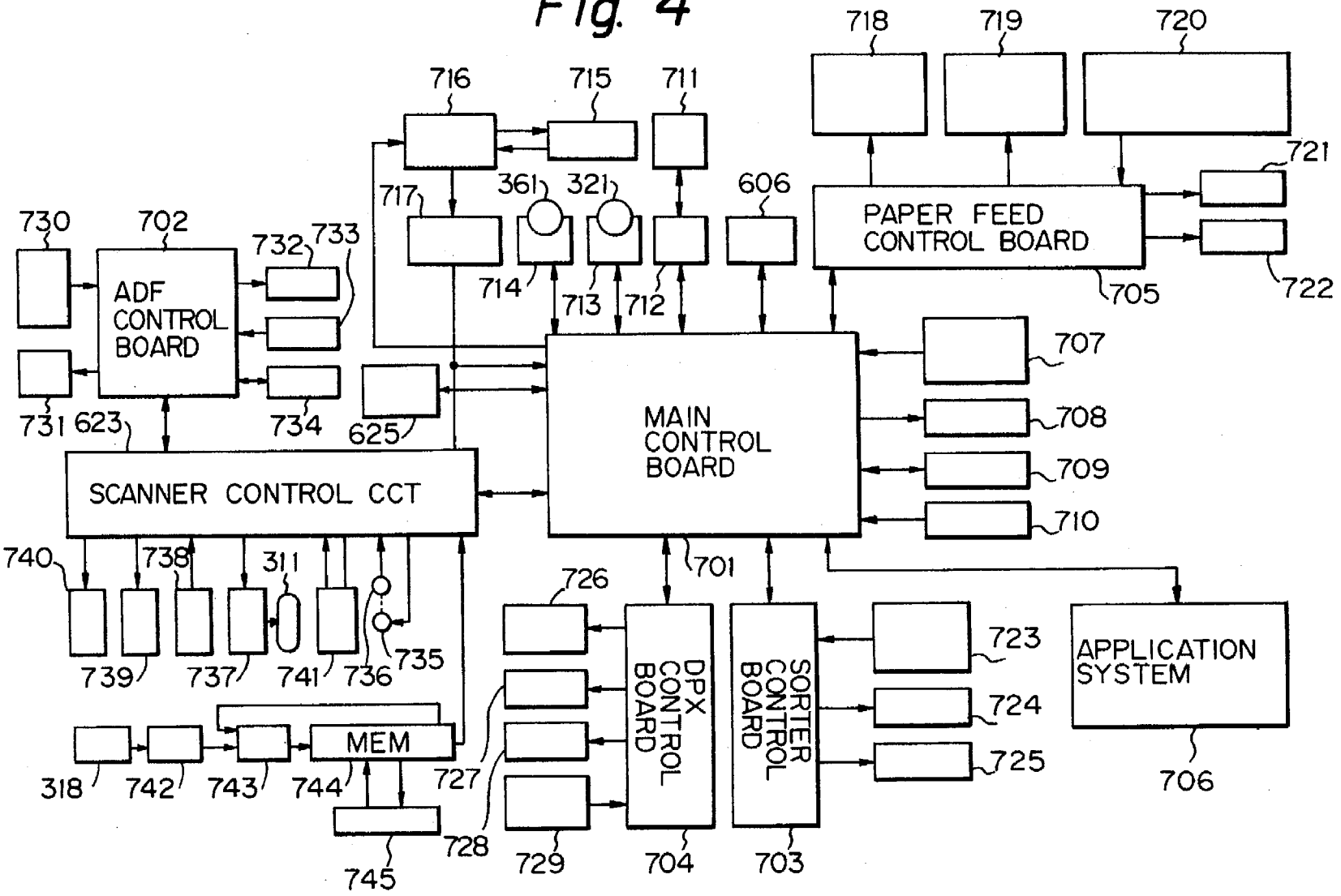
FIG. 4 is a block diagram schematically showing the overall arrangement of the control system of the embodiment.

FIG. 4 is a block diagram schematically showing the overall construction of the control system of the copier. As shown, the system includes a main control board 701 for controlling the entire copier. An ADF control board 702 controls the ADF 302. A sorter control board 703 controls the sorter 303. A DPX control board 704 controls the duplex copy unit 304. A paper feed control board 705 executes various kinds of control over the paper feed section 309. There are also shown in FIG. 4 an application system 706, sensors 707 including the fixation sensor, density sensor 336, and registration sensor, fans 708 including an APL fan and a ventilation fan, counters 709 including a total counter and a key counter, and a thermistor 710 responsive to the surface temperature of the heat roller 341.

Further shown in FIG. 4 are a laser diode (LD) control board 711, a pulse width modulation (PWM) control board 712, drive boards 713 and 714, a temperature fuse and fixing heater 715, an AC drive board 716, a DC power source 717, solenoids 718 including a first to a third pick-up solenoid and a first and a second lock solenoid, clutches 719 including a registration clutch, elevation clutch, a first to a third paper feed clutch, sensors 720 including a first size sensor, manual insertion size sensor, manual insertion door sensor, and a first preregistration sensor, a suction fan 721, a conveyance fan 722, scanner motors 735 and 736, a stabilizer 737, a home position (HP) sensor 738, an ADF solenoid 739, an APS solenoid 740, and a fluorescent lamp heater and thermistor 741.

Additionally shown in FIG. 4 are sensors 723 included in the sorter 303, a drive motor 724 for driving the rollers of the sorter 303, solenoids 725 for causing copies to be distributed to the bins 354 of the sorter 303, solenoids 726 included in the duplex copy unit 304, clutches 727 included in the unit 304, a jogger motor 728 included in the unit 304, sensors 729 included in the unit 304, sensors 730 included in the ADF 302, solenoids 731 included in the ADF 302, motors 732 for driving the rollers of the ADF 302, switches 733 included in the ADF 302 for sensing a set condition and for switching the document thickness, a display 734 for displaying the number of documents stacked on the ADF 302 as well as a jam, an image preprocessor (IPP), an image processing unit (IPU) 743, a memory device (MEM) 744, and an external memory device 745.

Figure 6:
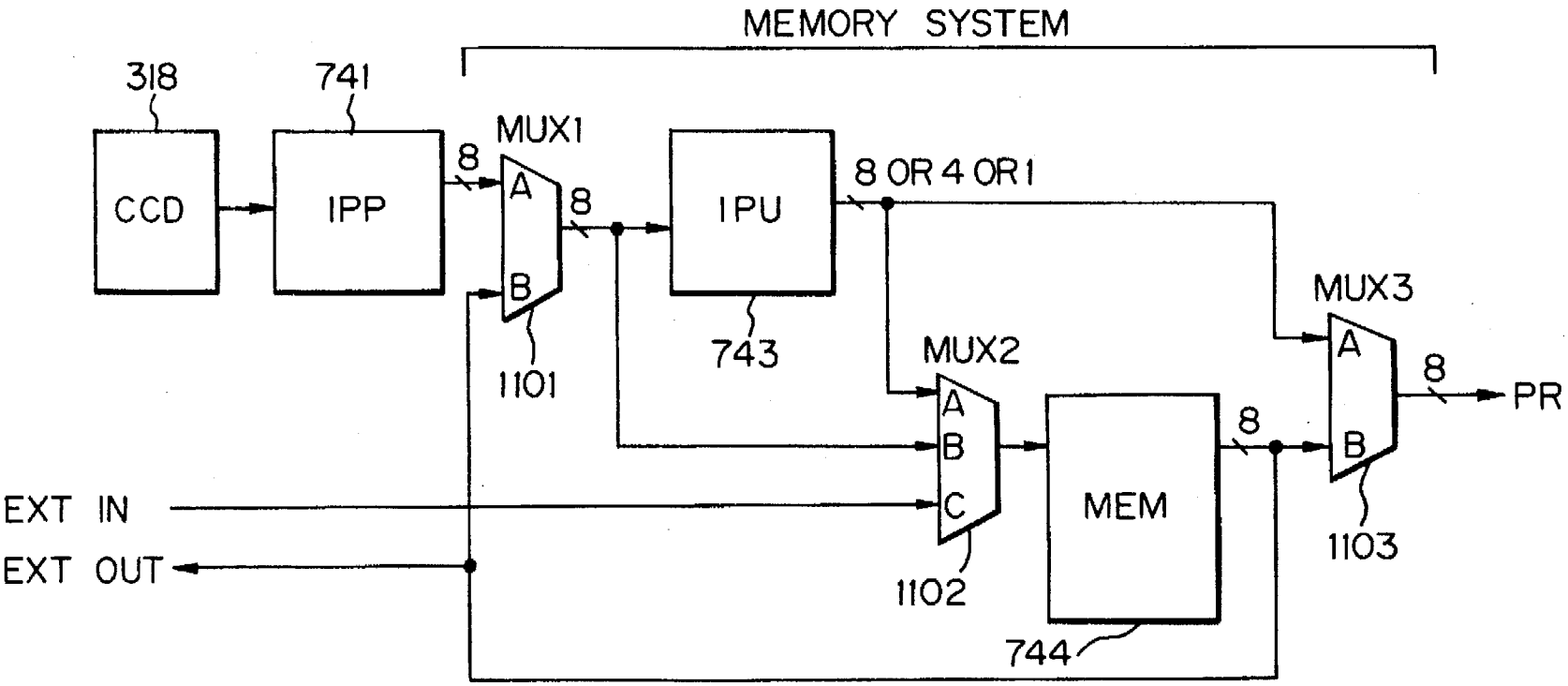
FIG. 6 is a block diagram schematically showing a memory system in accordance with the present invention.

FIG. 6 shows a memory system in accordance with the present invention. As shown, the system has multiplexers (MUX1–MUX3) 1101–1103 for receiving a plurality of data and selectively outputting them. The system receives an image data input signal EXTIN from the outside and produces a n output signal EXTOUT to the outside.

Figure 5A:
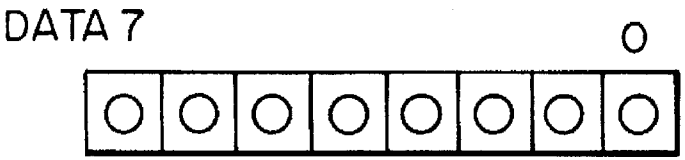
FIGS. 5A–5C show specific data types available with an image processing unit included in the embodiment.
Figure 5B:
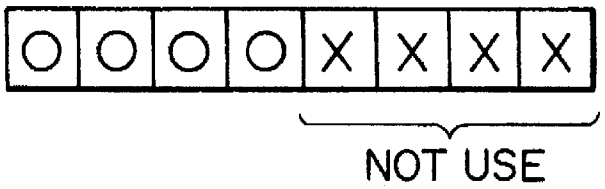
Figure 5C:
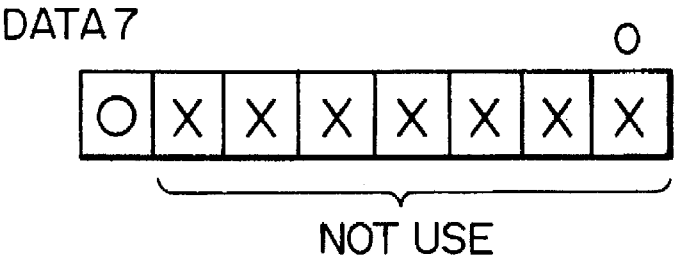

A specific operation of the above memory system will be described. Assume that a plurality of copies should be output by a single scanning of the scanner section 305 by changing the parameter of the IPU 743. Then, in the event of scanning, the MUX1–MUX3 are respectively caused to select A, B and A. In this condition, a single copy is produced. At this instant, the raw image data are written to the MEM 744 via the MUX2. For the second and successive copies, the MUX1 is caused to select B. The data from the MEM 744 is input to the IPU 743 and then sent to a printer (PR) via the MUX3. At this instant, the parameter of the IPU 743 is changed every time one copy is produced. In the case where one-bit data, FIG. 5C, or similar compact data is held, the MUX2 is caused to select A in order to write the output of the IPU 743 to the MEM 744. In this case, the PR is switched to a bilevel data (one bit) mode.

Figure 7:
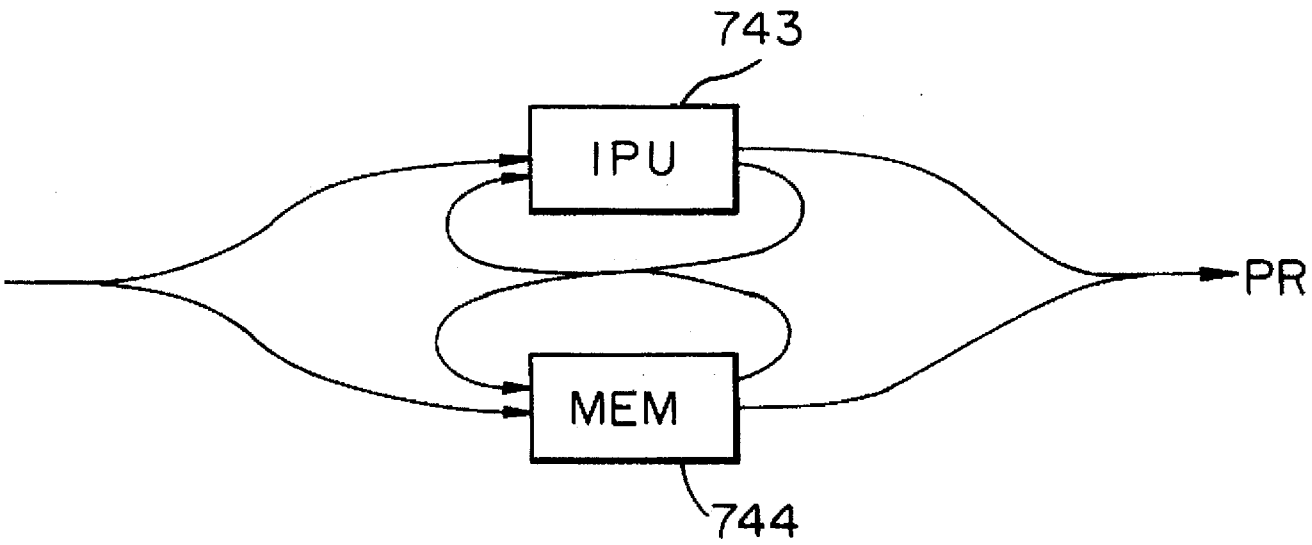
FIG. 7 shows the flows of image signals in accordance with the present invention.

FIG. 7 shows the flow of the image signal particular to the present invention, i.e., the flow described with reference to FIG. 6. As shown, both the data processed by the IPU 743 and the raw data can be selectively written to the MEM 744.

Figure 8:
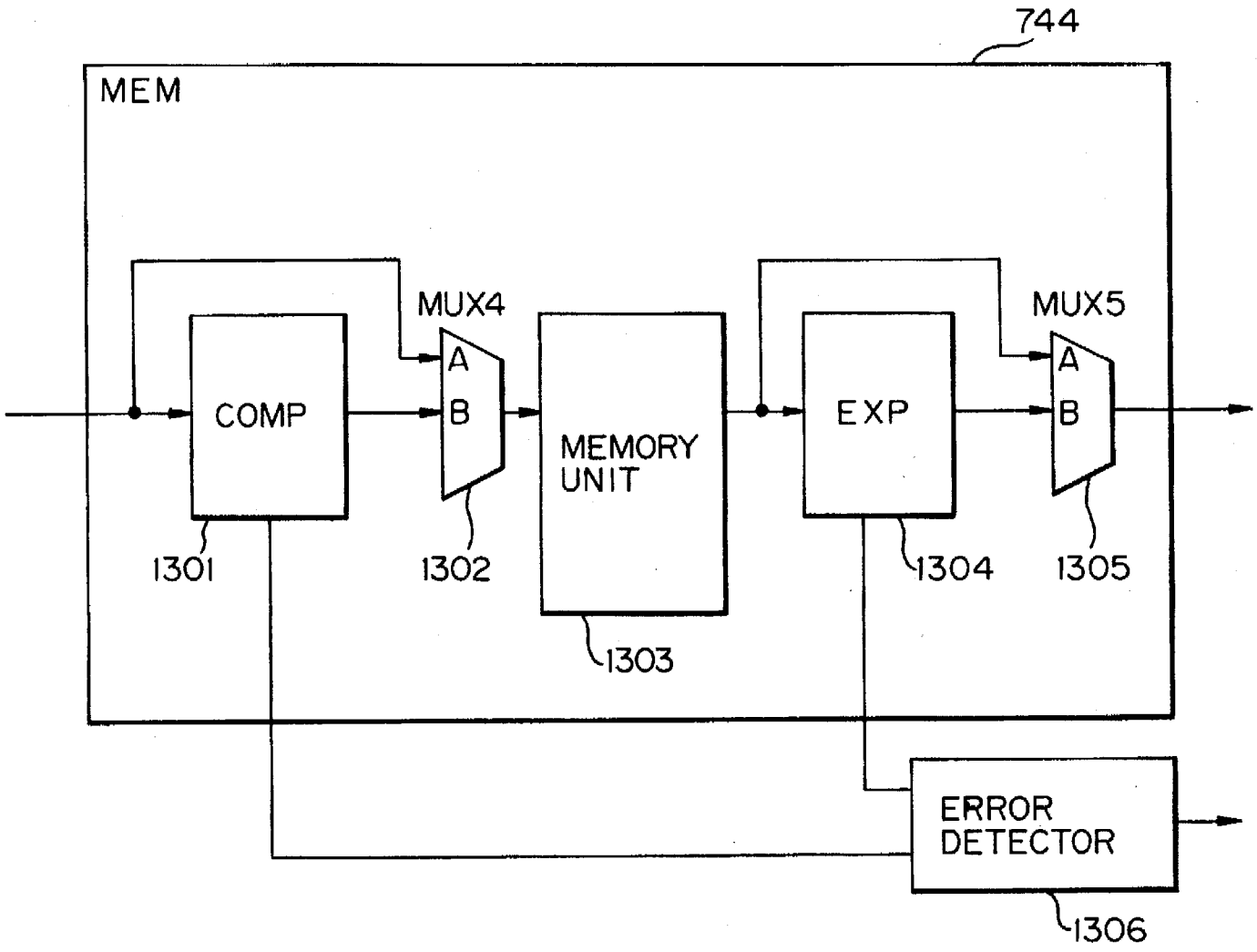
FIG. 8 is a block diagram schematically showing a specific configuration of a memory device.

FIG. 8 shows a specific arrangement of the MEM 744. As shown, the MEM 744 is made up of a compressor (COMP) 1301 for compressing the data, a multiplexer MUX4 1302 for selecting either the data from the IPU 743 or the data from the COMP 1301, a memory unit 1303 for storing the compressed data in addition to the raw data, an expander (EXP) 1304 for expanding the compressed data, a multiplexer MUX5 1305 for selecting either the data from the memory unit 1303 or the data from the EXP 1304, and an error detector 1306 for monitoring the error signals of the COMP 1301 and EXP 1304.

The COMP 1301 precedes the memory unit 1303 while the EXP 1304 follows the unit 1303. MUX4 and MUX5 are connected to the memory unit 1303. With this configuration, it is possible to selectively write the raw data or the compressed data in the memory unit 1303. Specifically, to store the raw data in the memory unit 1303, the MUX4 and MUX5 are caused to select A. To write the compressed data from the COMP 1301 in the unit 1303, the MUX4 and MUX5 are caused to select B. It is to be noted that the COMP 1301 executes memory processing matching the scanning speed of the scanner section 305, while the EXP 1304 executes processing matching the printing speed of the PR.

Figure 9:
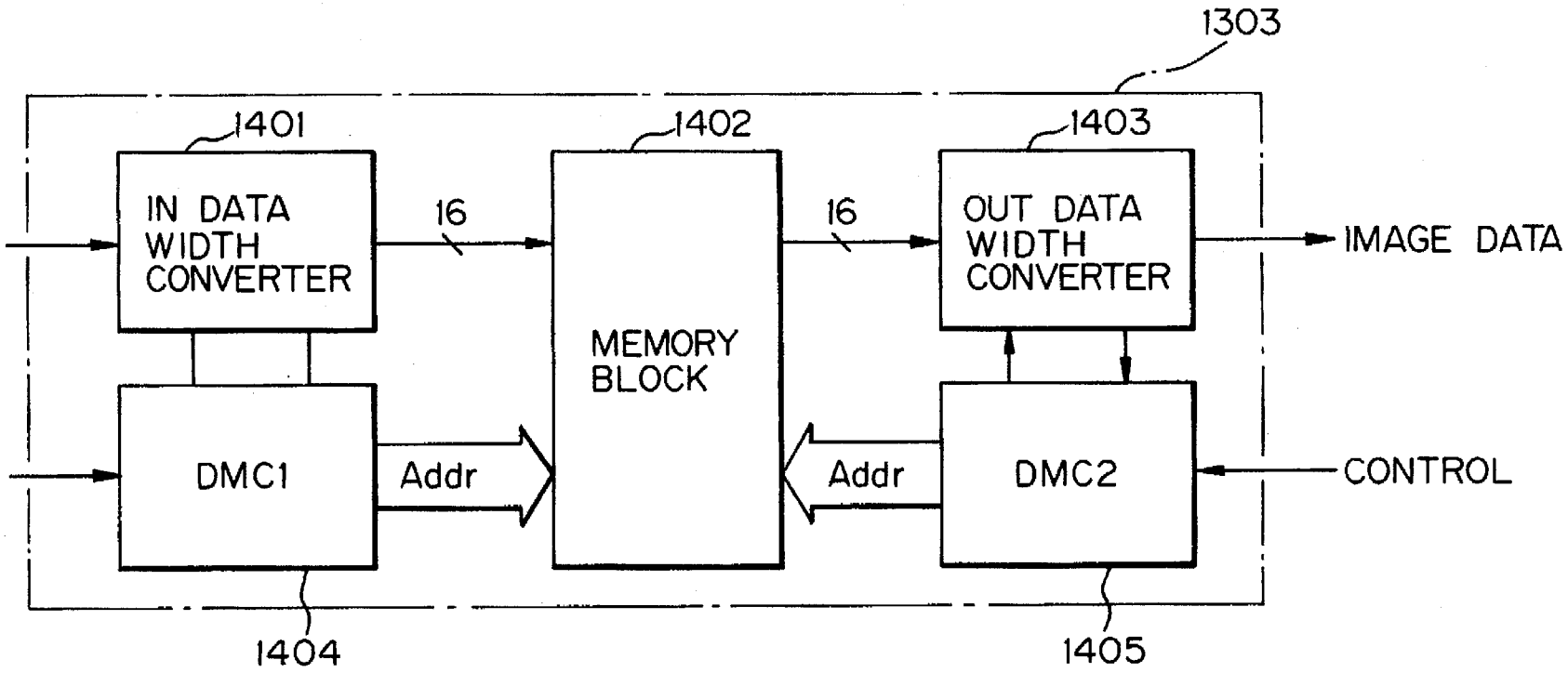
FIG. 9 is a block diagram schematically showing a specific arrangement of a memory unit included in the memory device.

FIG. 9 shows a specific arrangement of the memory unit 1303. As shown, the unit 1303 has an input data width converter 1404 for processing the image data and the compressed data or code data. A memory block 1402 stores the number of packed data. An output data width converter 1403 processes the image data and the compressed data or code data. A direct memory controller (DMC1) 1404 writes and reads the data out of predetermined addresses of the memory block 1402 in matching relation to the number of data packed by the input data width converter 1401 and the memory data width. A direct memory controller (DMC2) 1405 writes and reads the data out of predetermined addresses of the memory block 1402 in matching relation to the number of data packed by the output data width converter 1403 and the memory data width. The memory unit 1303, having the input converter 1401 and output converter 1403 connected to the memory block 1402, processes three different data types (see FIGS. 10A–10C) and the compressed data or code data from the COMP 1301.

Figures 10A, 10B, 10C:
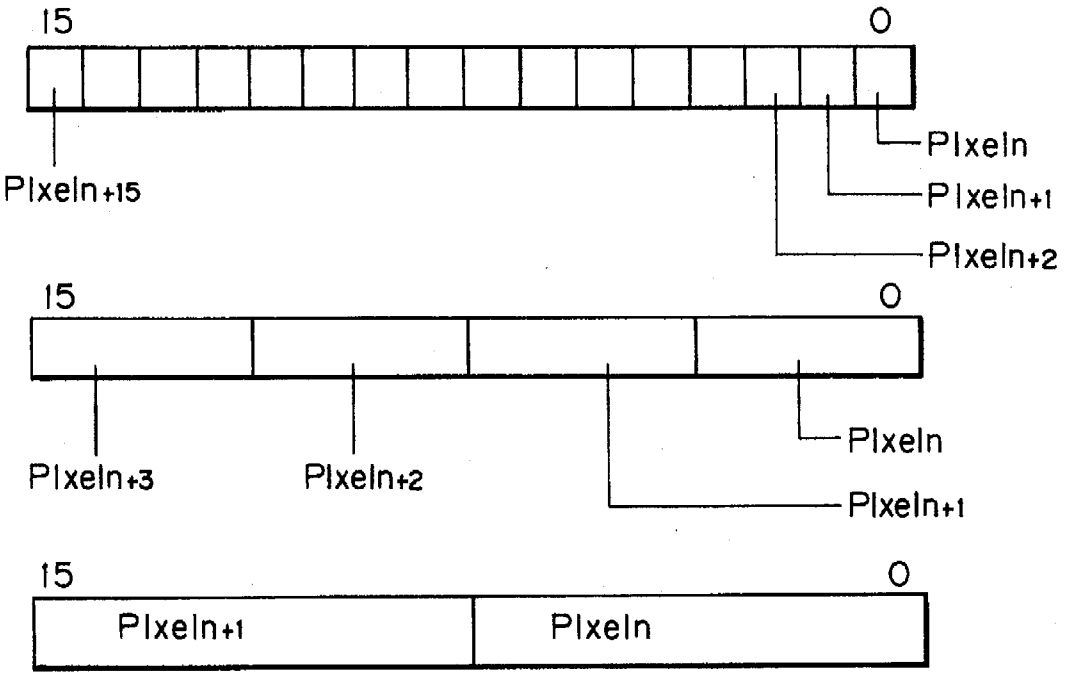
FIGS. 10A–10C show data formats to be processed FIG. 9.

FIGS. 10A, 10B and 10C respectively show a data type 1 having one bit, a data type 2 having four bits, and a data type 3 having eight bits. Usually, the rate of the image data from the scanner and that of the image data to the printer remain constant without regard to the number of data bits, because the period of one pixel is fixed in the apparatus. In the illustrative embodiment, the one-bit data, four-bit data and eight-bit data are each counted from, among eight data lines, the MSB (Most Significant Bit) data line. The input data width converter 1401 and output data width converter 1403 each packs and unpacks such data in the data width (sixteen bits) of the memory block 1402. By packing the data, the memory block 1402 and, therefore, the MEM 744 can be efficiently used in matching relation to the data depth.

Figure 11:
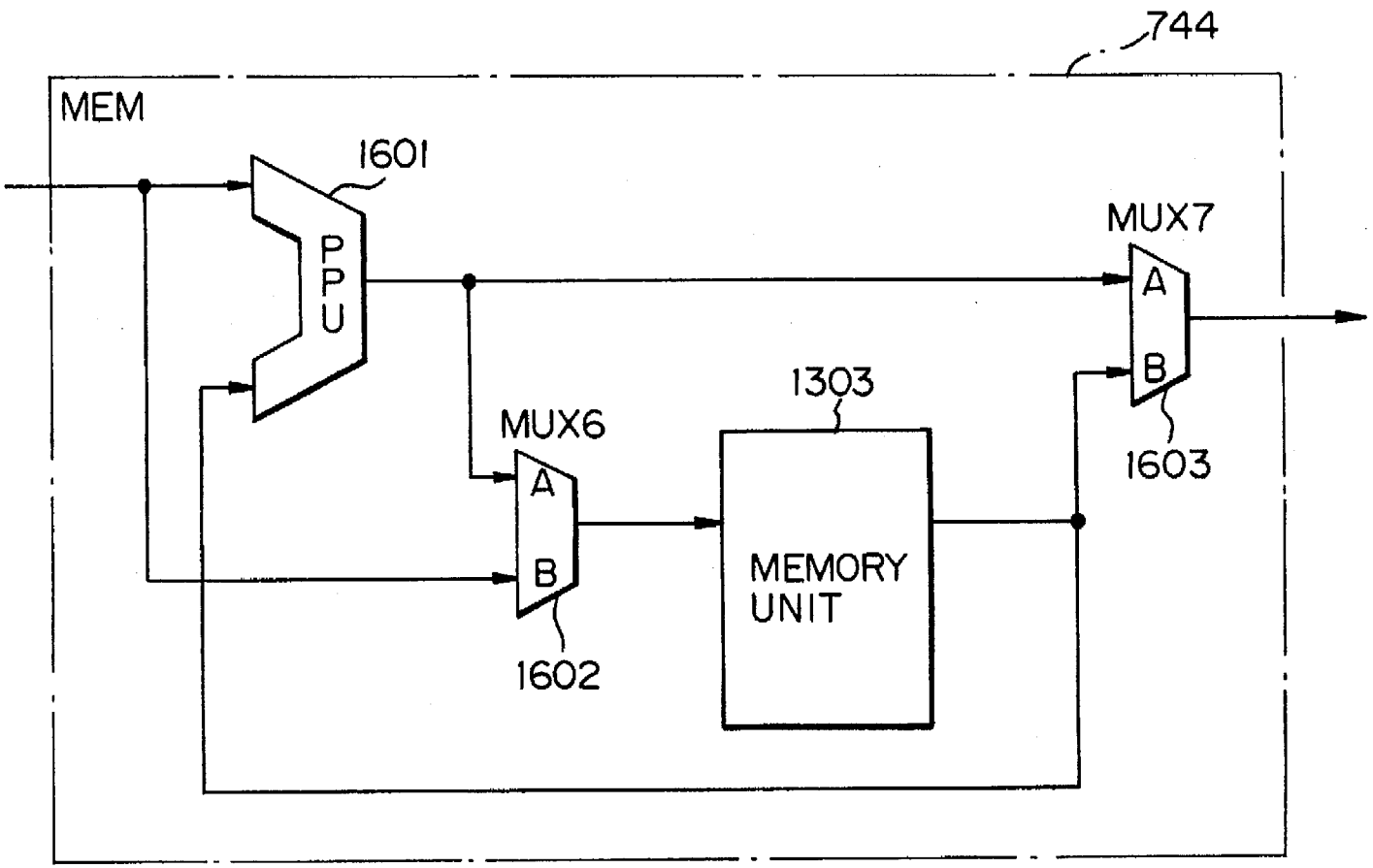
FIG. 11 is a schematic block diagram showing a construction in which a pixel processing unit is connected to the memory unit.

FIG. 11 shows a specific condition wherein a pixel processing unit (PPU) 1601 is connected to the memory unit 1303. The PPU 1601 performs ANDing, ORing, EORing, NOTing and other logical operations with image data. A multiplexer (MUX6) 1602 selects either the data from the IPU 743 or the data from the PPU 1601. A multiplexer (MUX7) 1603 selects either the data from the PPU 1601 or the data from the memory unit 1303. The PPU 1601 is located outside of the memory unit 1303 in place of the COMP 1301 and EXP 1304 shown in FIG. 8. The PPU 1601 peforms a logical operation with the data output from the memory and the input data and sends the result to the PR. Also, the PPU 1601 can perform a logical operation with the memory output data and the input data (e.g. data from the scanner section 305) and again writes the result in the memory unit 1303. The destination, i.e., PR or memory unit 1303 is selected by the MUX6 and MUX7. Generally, this kind of function is used to overlay extra data on scanner data or otherwise combine different images.

Figure 12:
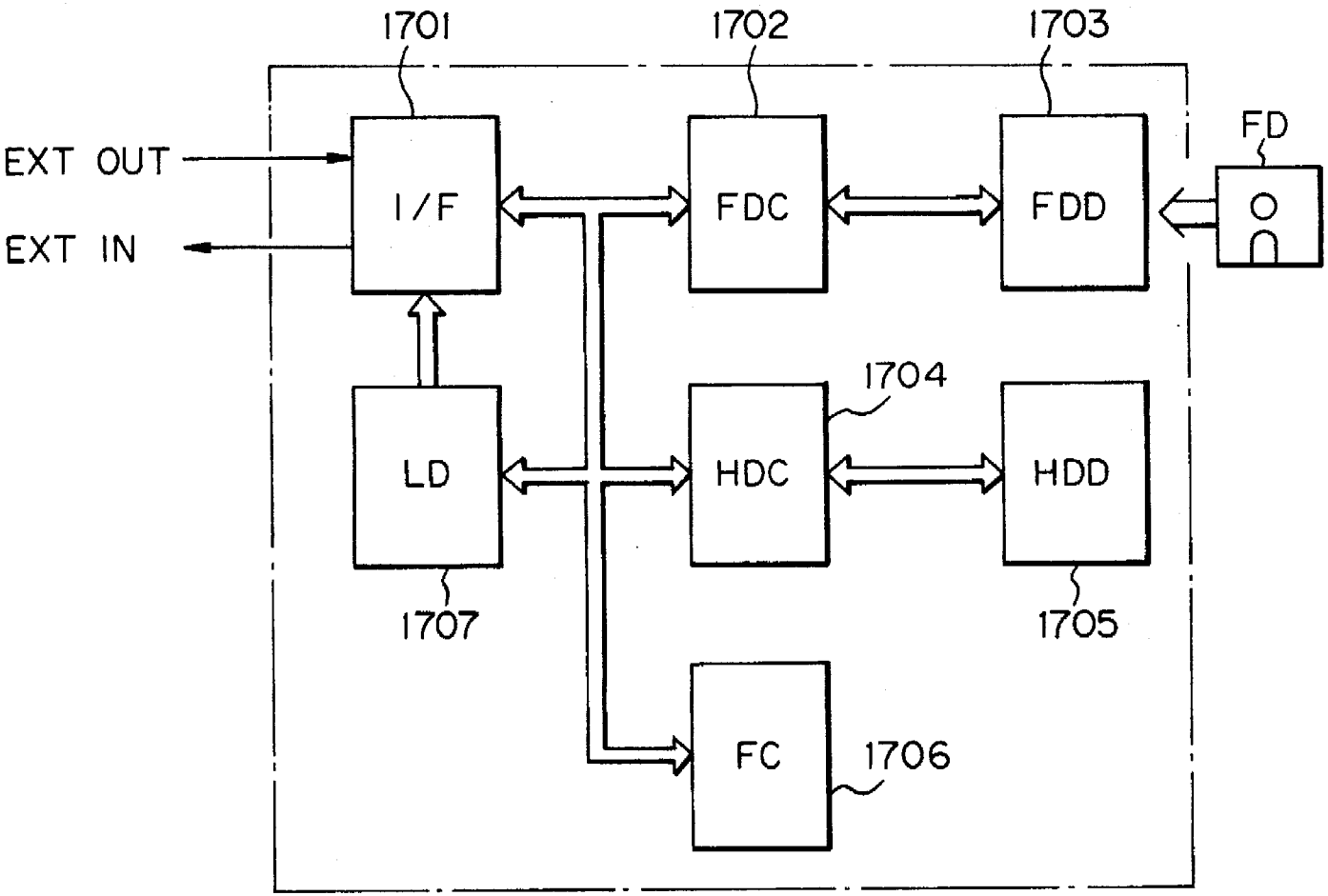
FIG. 12 is a schematic block diagram of an external memory device for saving image data.

FIG. 12 shows the configuration of the external memory device 745 for storing image data. As shown, the memory device 745 is made up of an interface (I/F) 1701 for controlling the input and output of image data, a floppy disk controller (FDC) 1702 for controlling a floppy disk driver (FDD) 1703 which drives a floppy disk (FD), a hard disk controller (HDC) 1704 for controlling the writing and reading of data out of a hard disk (HDD) 1705, a file controller (FC) for controlling the FDC 1702 and HDC 1704, and a line drawer (LD) 1707 for controlling the IFF 1701. To write image data in the FD, the data are sent from the terminal EXOUT, FIG. 6, to the FDC 1702 via the I/F 1701. As a result, the data are written to the FD of the FDD 1703 under the control of the FC 1706. The HDC 1704 writes and reads the data out of the HDD 1705 under the control of the FC 1706. The HDD 1705 stores format data and overlay data for general use.

Figure 13:
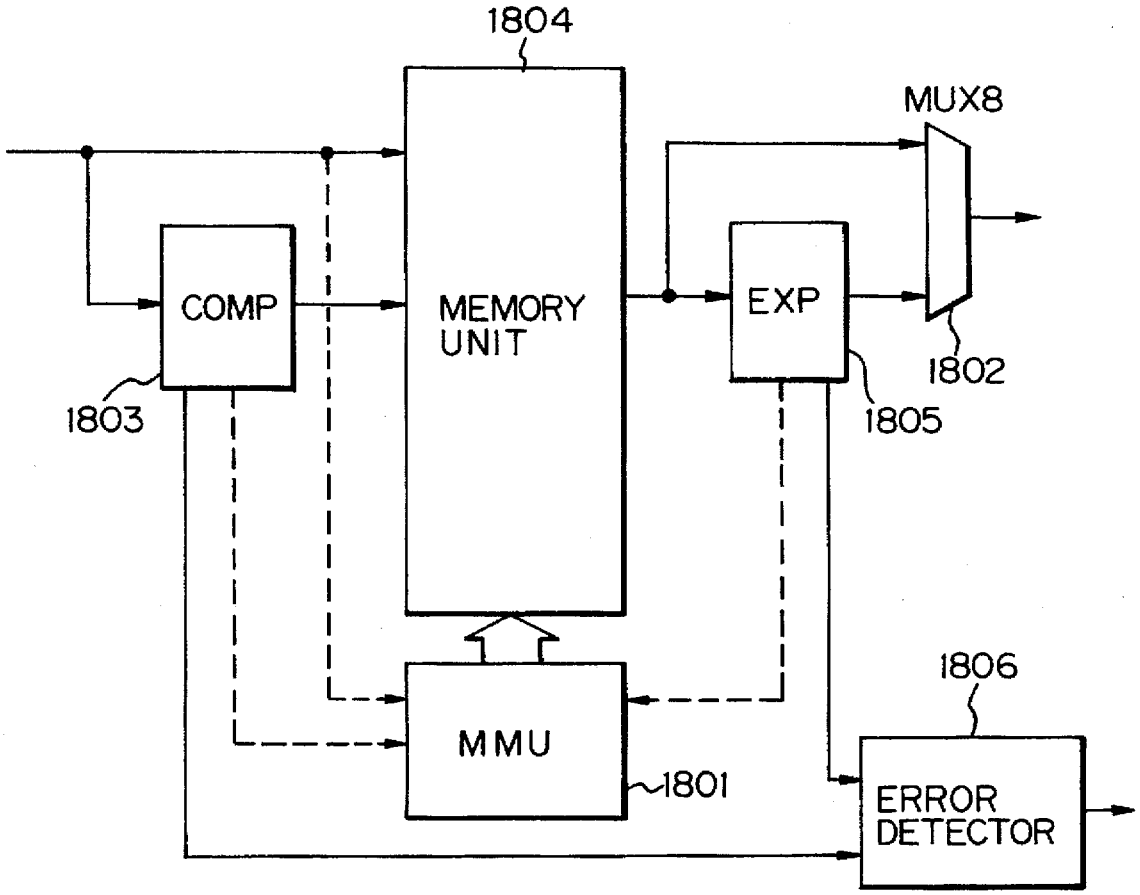
FIG. 13 is a schematic block diagram showing an arrangement for implementing recovery when an image data compression and expansion speed is short.

FIG. 13 shows a specific arrangement which implements recovery when the rate of image data compression and expansion was short. As shown, a memory managing unit (MMU) 1801 allows two input data and one output data to be input and output from a memory unit 1804 at the same time. A multiplexer (MUX8) 1802 selects either the data from the memory nit 1804 or the data from an expander (EXP) 1805. A compressor (COMP) 1803 compresses data. The memory unit 1804 is capable of storing not only the actual data but also the compressed data fed from the COMP 1803. The EXP 1805 expands data. An error detector 1806 monitors the error signals of the COMP 1803 and EXP 1805.

In the above arrangement, both the image data resulting from scanning and the compressed data from the COMP 1803 are input to the memory unit 1804. The two different kinds of data are each stored in a particular memory area of the memory unit 1804. The compressed data are directly input to the EXP 1805 and expanded thereby. Assume that the processing rate of the COMP 1803 and EXP 1805 was high enough to complete the processing normally before one page of data were fully written to the memory unit 1804. Then, the memory area allocated to the compressed data is left while the area allocated to the raw data is cancelled. When the error detector 1806 detects an error signal from the COMP 1803 or EXP 1806, the compressed data area is cancelled immediately so as to use the raw data. This realizes sure and rapid data processing and the effective use of the memory areas.

While the the MMU 1801 has been shown and described as allocating the memory areas dynamically, use may be made of two memory units with the assignment of one of them to the raw data and the other to the compressed data. This alternative scheme is feasible for applications which should satisfy both the number of pages to be stored and the printing speed, e.g., electronic sorting which stores a plurality of pages and outputs them to a printer on a real time basis.

Figure 14A:
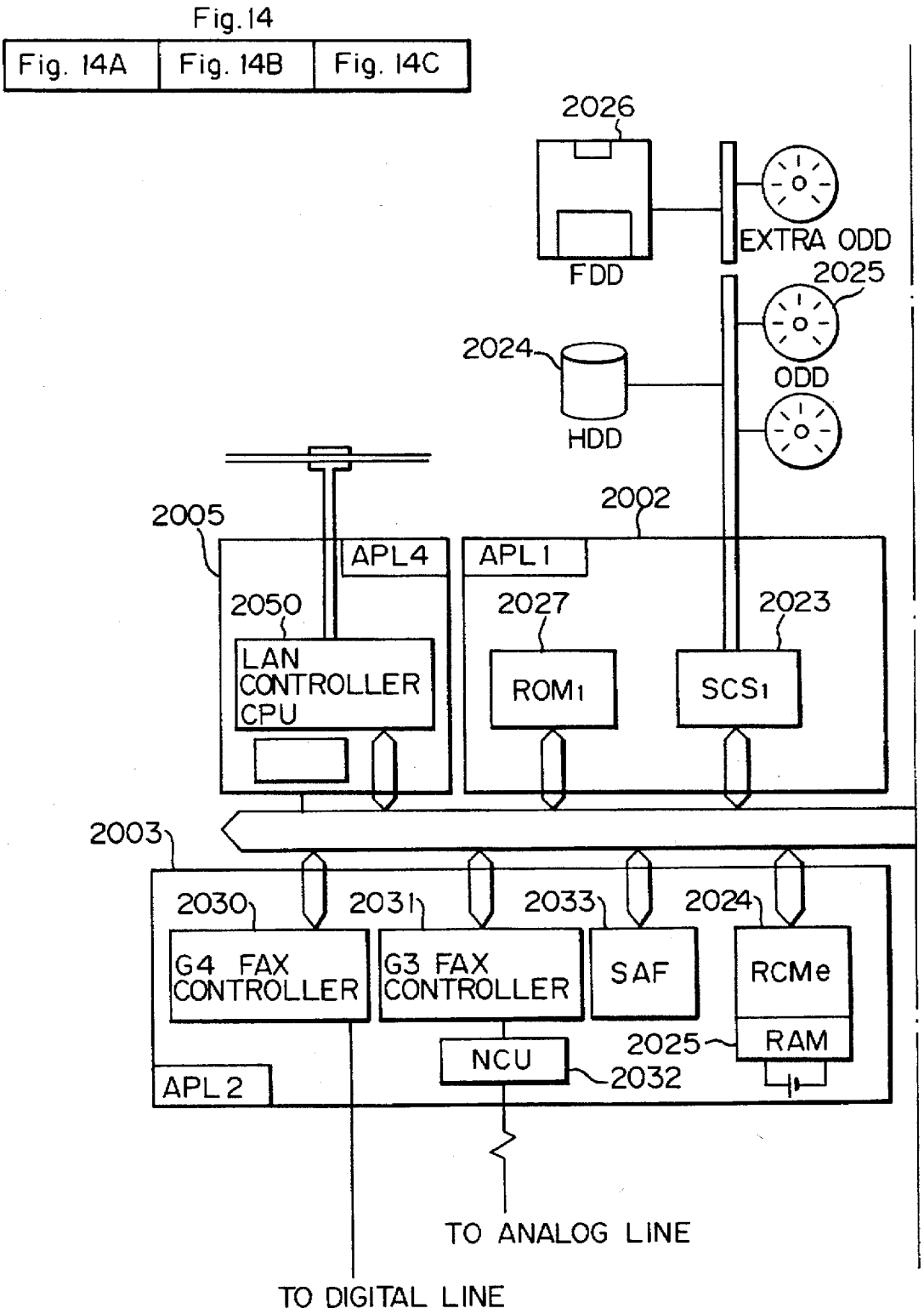
FIG. 14 is a schematic block diagram showing an application system in accordance with the present invention.
Figure 14B:
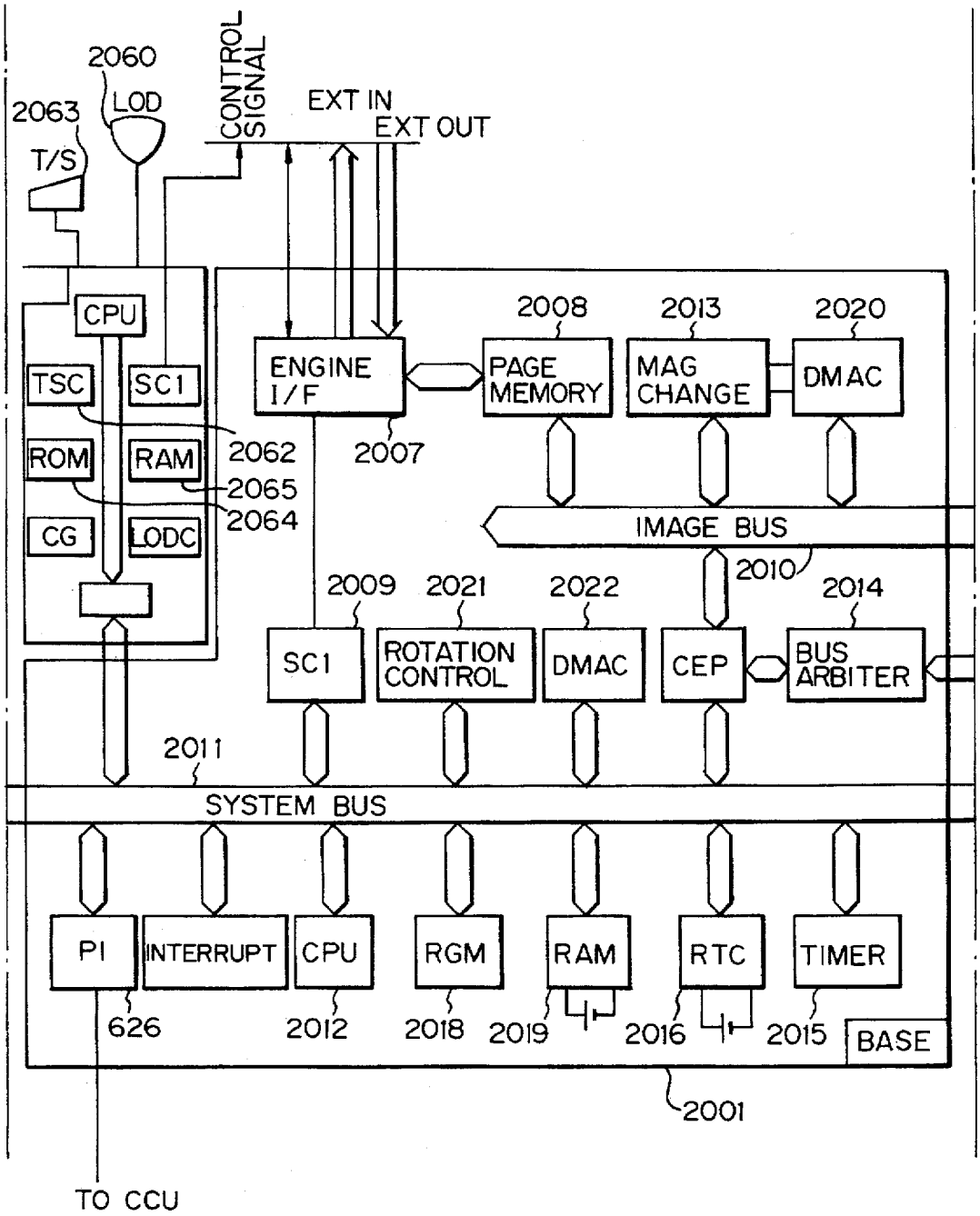
Figure 14C:
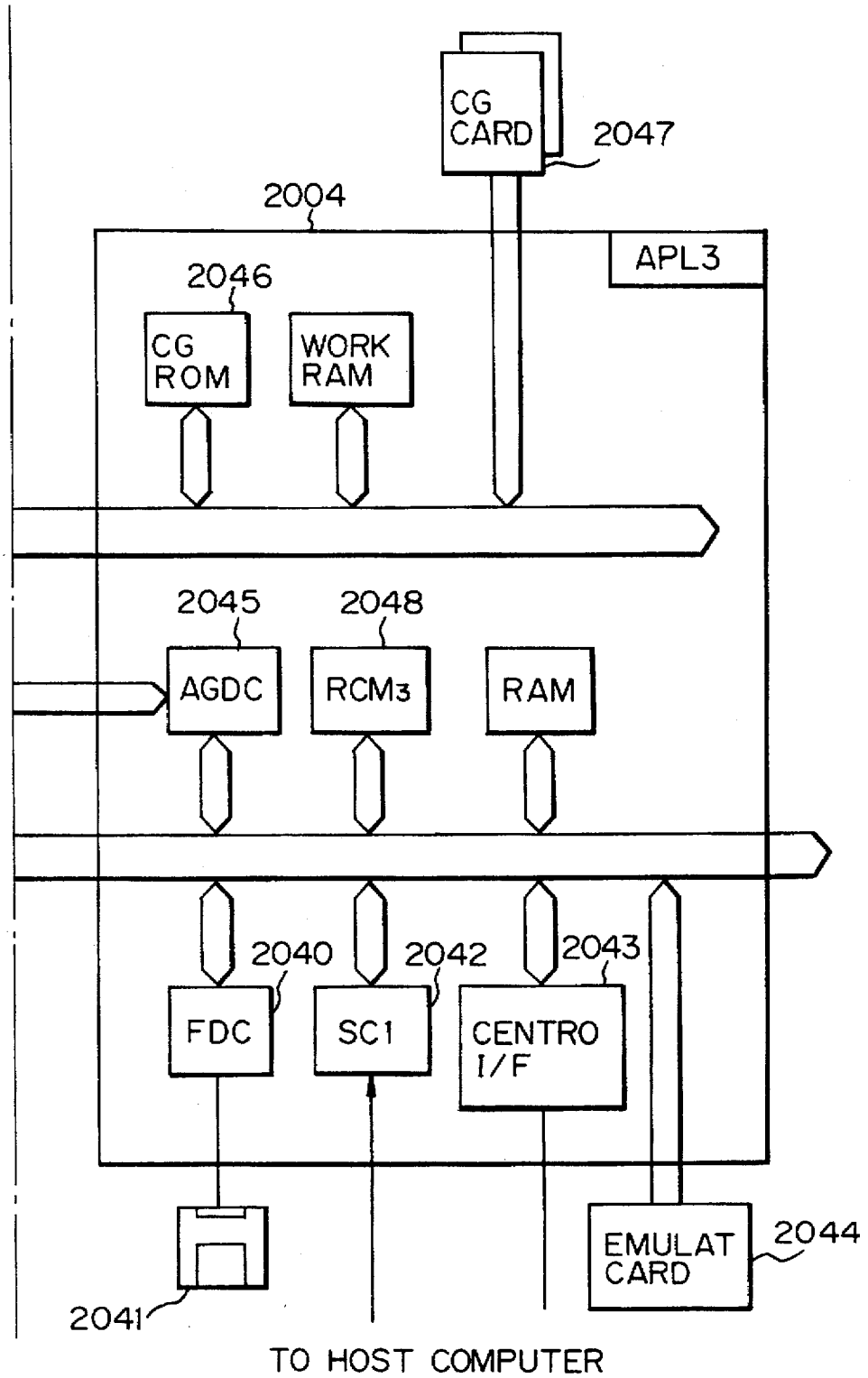

Referring to FIG. 14, an application system in accordance with the present invention will be described. As shown, the system is made up of a base unit 2001, an application (APL(1)) 2002 of a file unit, an APL(2) 2003 of a facsimile (FAX) unit, an APL(3) 2004 of an ON/OFF printer unit, an APL(4) 2005 for a local area network (LAN), and an operation and display unit 2006 including touch switches (T/Ss) and a liquid crystal display (LCD). The constructions and operations of these units will be described in detail.

[Base Unit 2001]

The base unit 2001 has an engine I/F 2007, a page memory 2008, a small communication interface (SCI) 2009, an image bus 2010, a system bus 1011, a CPU 2012, a magnification change circuit 2013 using a DRAM, a bus arbiter 2014, a timer 2015 for generating a predetermined clock, an RTC 2016 for generating the current clock, a ROM 2018 storing an operation system and other basic function programs, a RAM 2019 mainly serving as a work memory, a DMAC 2020, a rotation control 2021, and a CEP 2022.

The base unit 2001 executes the basic control of the system. The engine I/F 2007 transforms serial image data input to EXTOUT to parallel data or transforms parallel data from the page memory 2008 to serial data and outputs them to EXTIN. Because control signals are serial, they are delivered to the system bus 2011 from the engine I/F 2007 via the SCI 2009.

In the embodiment, the page memory 2008 is capable of accommodating one page of data of size A3. In the memory 2008 the image data are transformed to a bit image. In addition, the memory 2008 arbitrates the data rate of EXTIN and EXTOUT and the processing rate of the CPU 2012. The magnification change circuit 2013 enlarges or reduces the data of the memory 2008 at a high speed by using the DMAC 2020 without the intermediary of the CPU 2012.

As for the rotation control 2021, assume that a document to be sent by facsimile is of size A4 and positioned vertically long, and that it is received in a size A4 and horizontally long position. Then, because the transmitting station automatically reduces the document to 71%, the received image is not fully legible. The rotation control 2021 at the transmitting station rotates the image of the document 90 degrees to the horizontally long position and allows the document to be sent in a 1:1 magnification. Further, when the receipt size is A4 and horizontally long, but the cassette size is A4 and vertically long, the control 2021 rotates the output image 90 degrees to the A4 vertically long position. This makes it needless to distinguish the vertical and horizontal positions of the cassette.

The CEP 2022 executes the compression, expansion and throughout of image data. The bus arbiter 2014 executes processing for sending data from an AGDC 2045 to the image bus 2010 and system bus 2011.

[APL(1) 2002]

The PPL(1) 2002 is a file unit. In FIG. 14, an SCSI 2023 plays the role of an interface for an HDD 2024, an optical disk (ODD) 2025, and an FDD 2026. A ROM 2027 stores a control program for a filing system which controls the HDD 2024, ODD 2025 and FDD 2026 via the SCSI 2023.

[APL(2) 20031]

The APL(2) is a facsimile control unit. As shown in FIG. 14, the APL(2) has a G4 FAX controller 2030 for controlling a G4 protocol and supports G4 classes 1, 2 and 3. Further, the controller 2030 supports an ISDN (Integrated Services Digital Network). Because NET 64 has 2B+1D (64 kB×2p+16 kB) channels, the controller 2030 is capable of selecting one of G4/G4, G4/G3, G3/G3, G4 only, and G3 only. A G3 FAX controller 2031 controls a G3 protocol and has a G3 FAX protocol based on an analog channel and a modem for transforming a digital signal to an analog signal. A network control unit (NCU) 2032 has a dialing function.

An SAF (Store And Forward) memory 2033 is implemented by a semiconductor memory, HDD, ODD or the like and used to store image data (including code data) to be sent or received by facsimile. A ROM 2024 stores a program for controlling the APL(2). A RAM 2025 plays the role of a work memory and backed up by a nonvolatile battery. The telephone numbers and names of destinations, data for controlling the facsimile function and other data are stored in the RAM 2025. These data can be easily set on the T/Ss and LCD of the operation and display unit 2006.

[APL(3) 20041]The APL(3) 2004 is an on-line printer and off-line printer control unit. As shown in FIG. 14, the APL(3) has a floppy disk controller (FDC) 2040 for controlling a floppy disk (FD). Some modern floppy disks support the SCSI 2023. In the embodiment, the FDC 2040 supports SCSI 2023 and ST506 interfaces. A serial communication interface (SCI) 2042 allows a host computer to be connected to the APL(3) 2004. A centro I/F 2043 is also used to connect the host computer.

An emulation card 2044 has the following function. When the specifications of the printer are seen from the host computer side, they differ from one manufacturer to another. Hence, the software loaded in the host computer fails to operate unless the function of the printer is the same as seen from the host computer side. In light of this, the emulation card 2044 is removably mounted to cause the printer to operate, in an apparent sense, as a printer available from any manufacturer as seen from the host side.

An advanced graphic display controller (AGDC) 2045 writes code data from the host computer in a CG (Character Generator) ROM 2046 and writes font images stored in a CG card 2047 in the page memory 2008 at a high speed. A ROM3 2048 stores a control program. The CGROM 2046 stores font data corresponding to code data. The CG card 2047 is also removably mounted and identical in content with the CGROM 2046.

[APL(4) 20051]

The APL(4) 2005 controls the LAN. As sown in FIG. 14, the CPL(4) 2005 has a LAN controller 2050 for controlling, Ethernet, Omni or similar LAN presently in operation. It is to be noted that the FAX of the APL(2) 2003 and the LAN of the APL(4) 2005 are capable of working at the background even when another APL is in operation.

[Operation and Display Unit 2006]

This unit 2006 controls the LCD and T/Ss. As shown in FIG. 14, the unit 2006 has a ROM 2064 storing a program and data for controlling the unit 2006, a nonvolatile RAM 2065 backed up by a battery and storing control data and a control program which can be updated, and an LCD 2060 capable of displaying graphic and text data. A CG 2061 included in the LCD 2060 stores codes representative of ANK and the second level of kanji. A touch switch controller (TSC) 2062 controls T/Ss 2063. The T/Ss 2063 are defined by an XY lattice. The operator can freely select the switch size by determining the number of frames to be allocated to a single key on the TSC 062. The LCD 2060 and T/Ss 2063 are configured in a double layer structure; the key size and the frame of each key of the LCD 2060 match each other.

Figure 15:
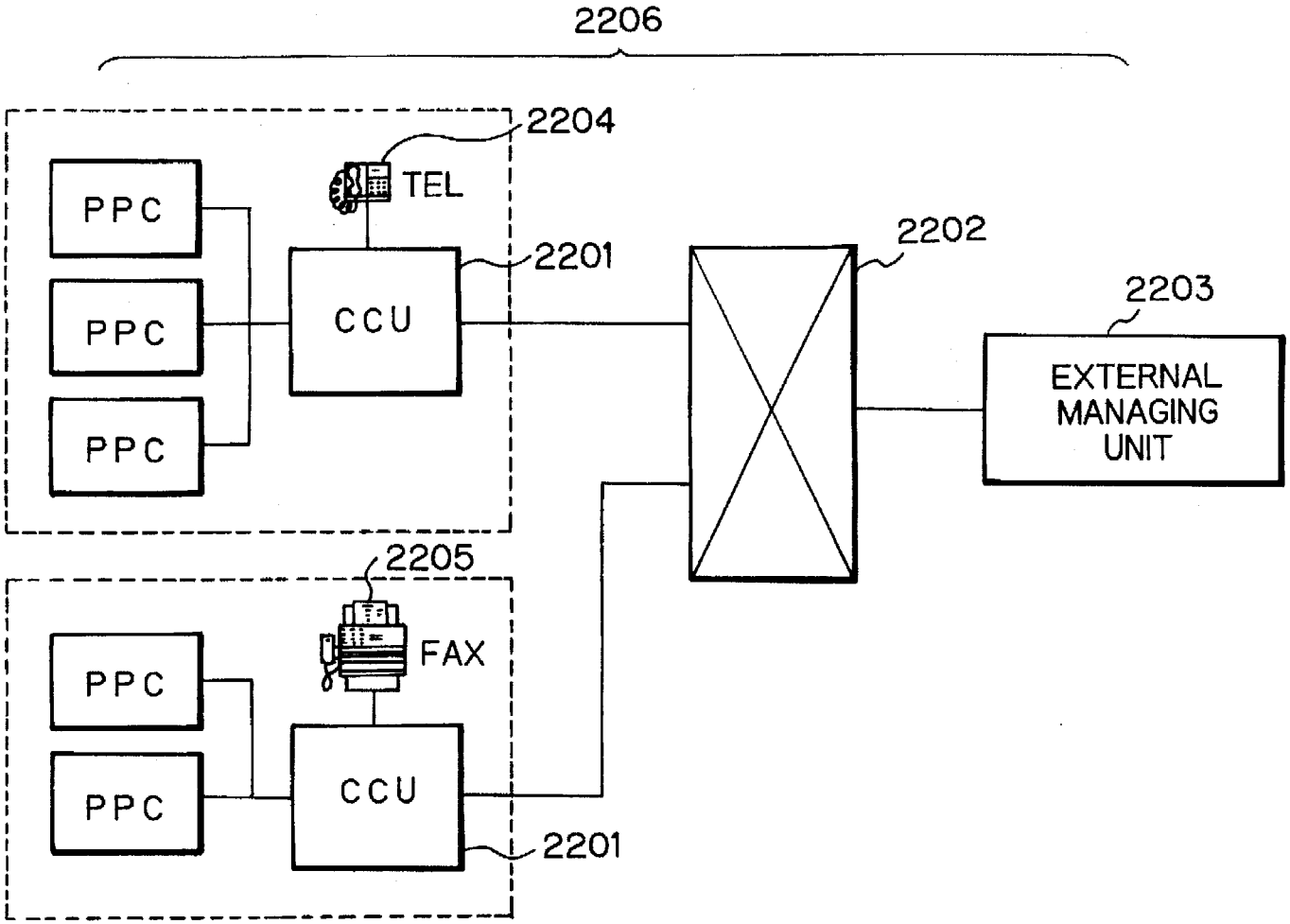
FIG. 15 is a schematic block diagram showing an image forming apparatus managing system in accordance with the present invention.

A reference will be made to FIG. 15 for describing an image forming apparatus managing system 2206 in accordance with the present invention. As shown, an external managing unit 2203 is located at a base station and connected by a public telephone network 2202 to copiers and other equipment located at users' stations. A communication control unit (CCU) 2201 is installed at each user's station for controlling the communication with the managing unit 2203 and is inserted in the existing subscriber line. A telephone 2204 and a facsimile apparatus 2205 are connectable to the CCU 2201, as desired. While a plurality of plain paper copiers (PPC) are shown as being connected to the CCU 2201, they may, of course, be replaced with a single PPC. The PPCs may be of different types or may even be replaced with other apparatuses. Assume that the maximum number of PPCs which can be connected to a single CCU 2201 is five by way of example. The CCU 2201 and PPCs are connected together in a multidrop configuration based on the RS-485 standard. The control over the communication between the CCU 2201 and the PPCs is executed by a basic data transmission control procedure. The CCU, or control station, 2201 can communicate with any one of the PPCs by setting up a data link on the basis of a centralized control polling/selecting system. An address particular to each PPC is set via the address setting switch 626, thereby determining a polling address and a selecting address.

Figure 16:
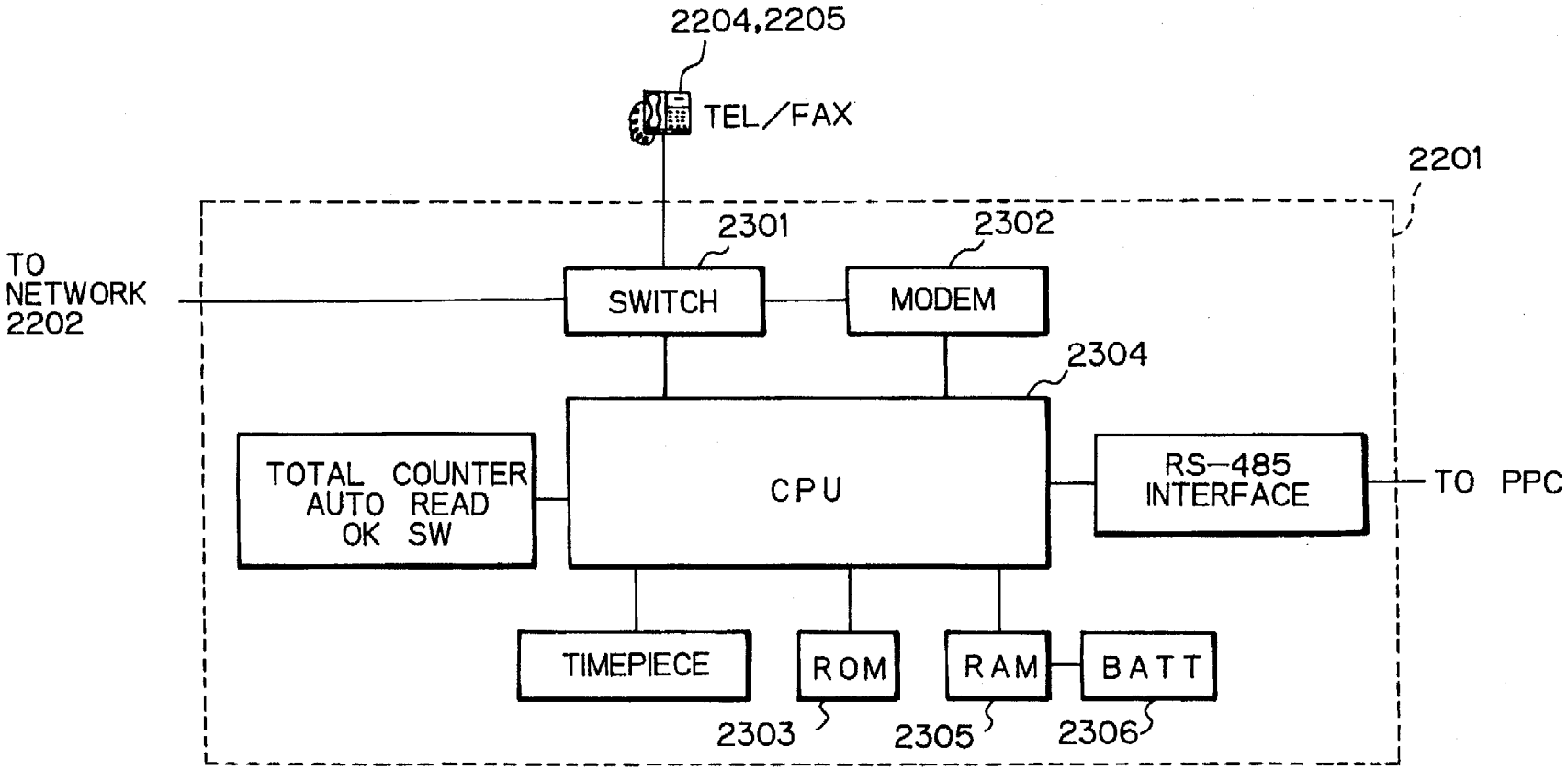
FIG. 16 is a schematic block diagram of a communication control unit.

As shown in FIG. 16, the CCU 2201 has a switching section 2301 to which a signal come in over the network 2202 is applied. When the signal is meant for the telephone 2204 or the facsimile apparatus 2205 connected to the CCU 2201, the switching section 2301 connects the network 2202 thereto. When the communication is originated by the external managing unit 2203, the switching unit 2301 connects the network 2202 to a modem 2302. The CCU 2201 is capable of communicating with the PPCs via a communication interface using a transceiver for RS-485. These control and processing functions are executed mainly by a CPU 2304 according to control programs stored in a ROM 2303. A RAM 2305 stores the interim results of processing and stores a communication text for a moment. In addition, various parameters necessary for the operation of the CCU 2201 and sent from the managing unit 2203 are also written to the RAM 2305. Usually, the CCU 2201 is constantly powered all the day and capable of communicating with the managing unit 2203 at all times. A battery 2306 backs up the CCU 2201 in order to prevent the parameters from being lost due to, for example, the accidental shut-off of the power supply.

Figure 17:
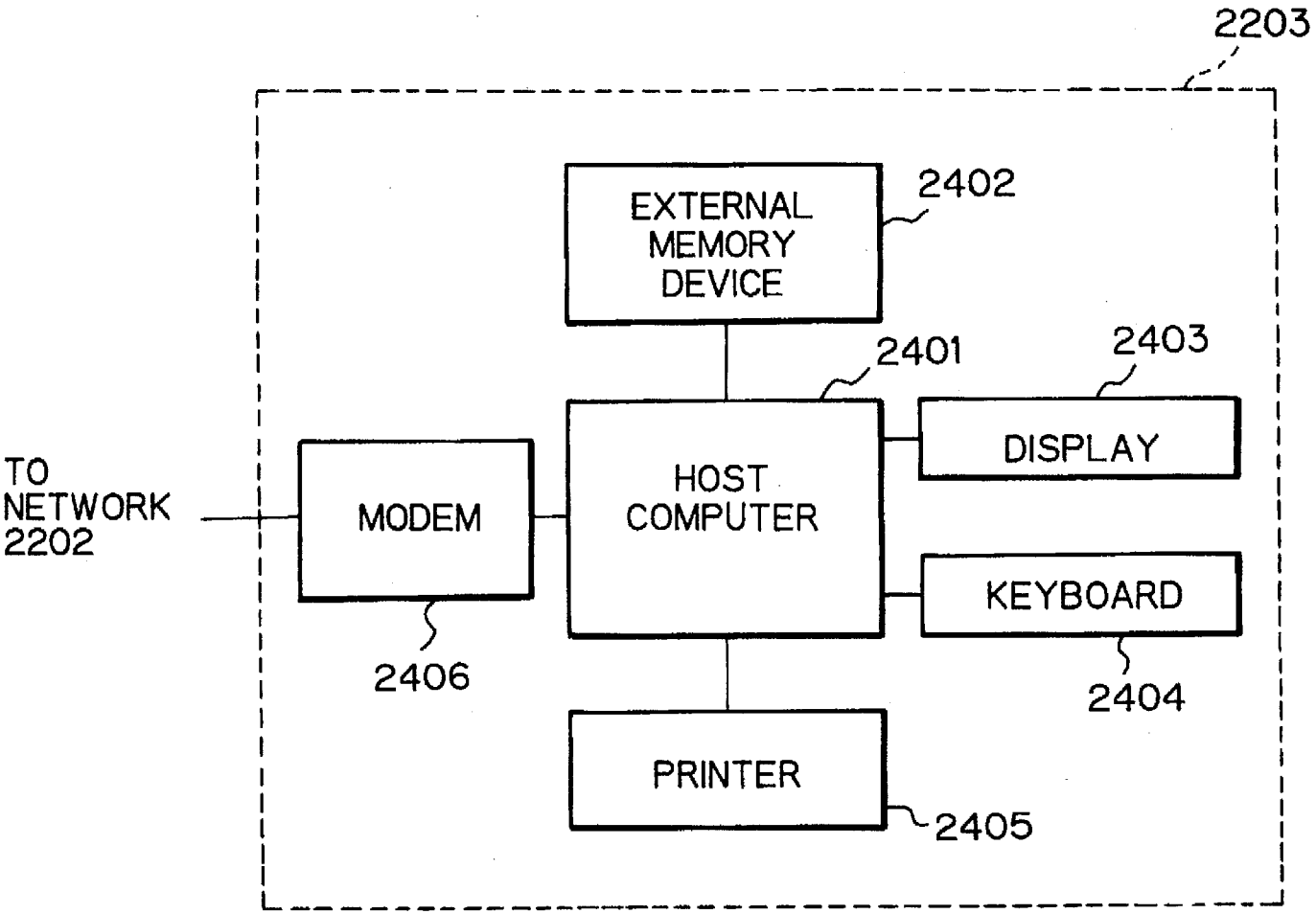
FIG. 17 is a schematic block diagram of an external managing unit.

FIG. 17 shows the external managing unit 2203 in detail. As shown, the managing unit 2203 is made up of a host computer 2401 for executing various kinds of processing, a magnetic disk or similar external memory device 2402 storing management data, a display 2403, a keyboard or operating means 2404, a printer 2405, and a modem 2406 connected to the telephone network 2202. As shown in FIG. 3, the communication interface (PI) unit **626*a* communicates with the CCU 2201. The USARP 633 is connected to the communication interface unit 626*a* by a serial interface. The address setting switch associated with the unit 626*a*** is a dip switch and allows an address to be set in the range of 1–5.

When a new function is added to the copier, the management system 2206 causes the external managing unit 2203 to supply control programs and control data for version adjustment and relating to the present invention, as follows. When the ADF 302, sorter 303, duplex copy unit 304 or similar new function is added to the copier, it cannot exhibit the expected function sufficiently or cannot exhibit it at all unless the control programs stored in the copier body 301 match the new function. Furthermore, to use the additional function, the operator must manipulate the panel 625 to enter a method of using it and other necessary information. This requires extra display data and extra control program for setting the usage.

Regarding version adjustment, two different cases exist, as follows. Assume that a control program and a display program for version adjustment are implemented as a module independent of the other programs stored in the image forming apparatus body. Then, the version adjustment can be done only if the independent programs are rewritten or added. On the other hand, if such programs are not (or cannot be) implemented as an independent module, then all the control programs of the apparatus body must be rewritten. That is, all the control programs must be written to the image forming apparatus in the event of version adjustment, depending on the program architecture of the apparatus body. Further, even when only the programs necessary for version adjustment should be written to the apparatus, all the programs are sometimes read again in order to enhance the reliability of the updated programs. The programs and data which should be supplied to the apparatus body for version adjustment will be collectively referred to as updating programs hereinafter.

Figure 18:
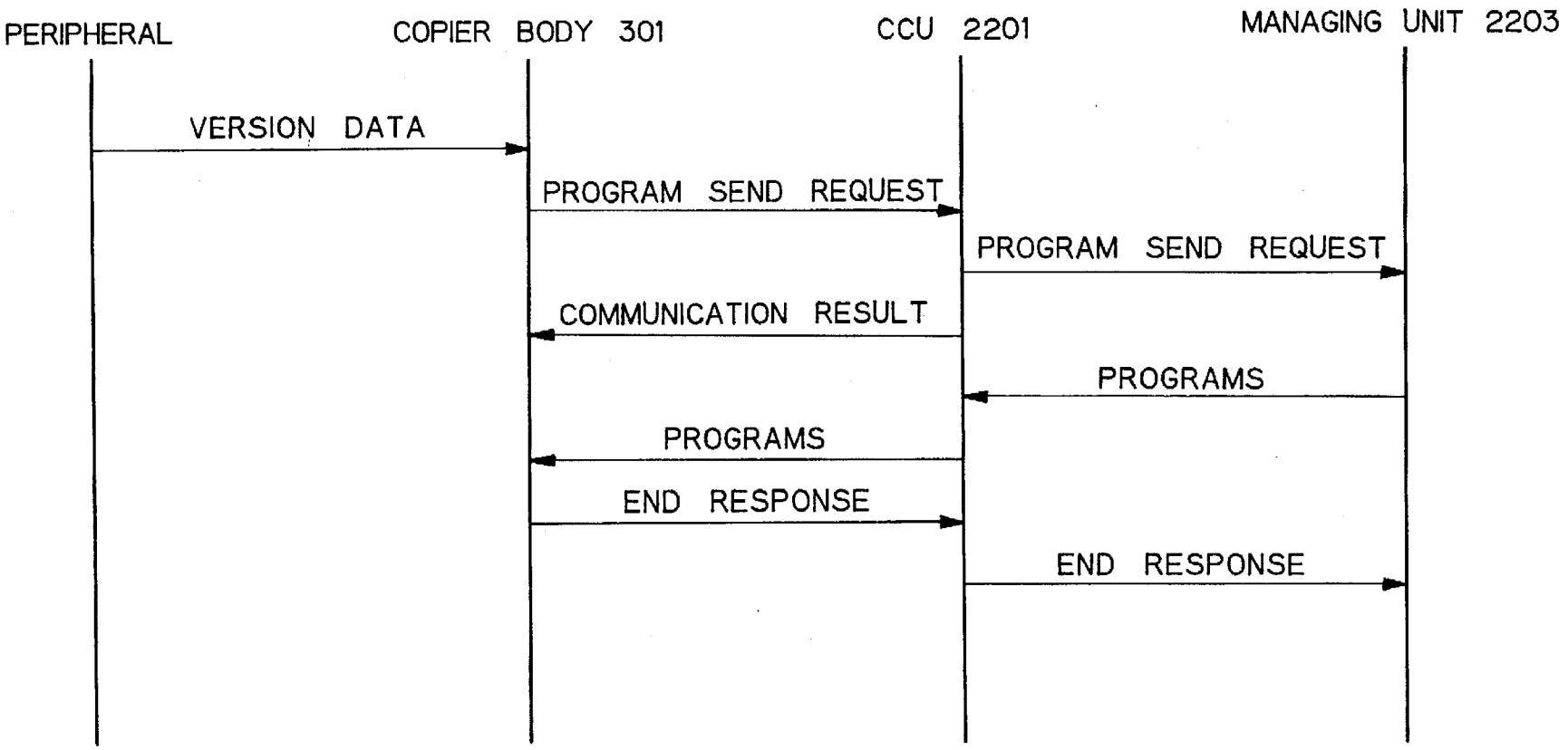
FIG. 18 is a chart representative of a procedure for supplying updating programs from the external managing unit.

Referring to FIG. 18, a procedure in which the managing unit 2203 supplies the updating programs will be described. As shown, after a new function has been added to the copier body 301, the additional function and copier body 301 check their connection at the time of, for example, power up. At this instant, version data (e.g. identification (ID) code) particular to the additional function is sent to the copier body 301. The copier body 301 compares the ID code with its own program version. If the copier body 301 determines, as a result of the comparison, that it cannot deal with the additional function sufficiently, it sends the ID code of the additional function and an updating program send request to the CCU 2201 via the USARP 633 and PI unit 626*a*. At the same time, the copier body 301 sends its own ID code to the CCU 2201.

In response, the CCU 2201 dials a telephone number assigned to the managing unit 2203 and stored in the RAM 2305 beforehand, and then sends the above data to the unit 2203. The managing unit 2203 is usually located at a base station and capable of interchanging data with a plurality of CCUs 2201 over subscriber lines. After sending all the data to the managing unit 2203, the CCU 2201 returns the result of communication thereof with the managing unit 2203 to the copier body 301. This shows the copier body 301 whether or not the communication ended normally or failed due to some error. On receiving the updating program send request via the CCU 2201, the managing unit 2203 searches for adequate programs for version adjustment stored in the data base of the memory device 2402 by use of the ID code of the additional function and that of the copier body 301. Then, the managing unit 2203 dials the CCU 2201 and then sends the programs thereto. In response, the CCU 2201 transfers such data to the copier body 301.

The copier body 301, received the updating programs via the CCU 2201, writes them in the nonvolatile RAM 629 or 614. Thereafter, the copier body 301 controls the additional function on the basis of the updating programs. Among the updating programs, the program for the display and control of a mode setting picture is transferred to the operation and display unit 2006 and written to the nonvolatile RAM 2065. This allows the unit 2006 to display mode setting keys and alert indicators associated with the additional function and to control the display.

After the copier body 301 has written all the programs in the RAM 629 or 614 and completed the associated processing, it sends an end response to the CCU 2201. The CCU 2201 transfers the end response to the managing unit 2203. This is the end of a single processing unit.

Figures 22, 22A:
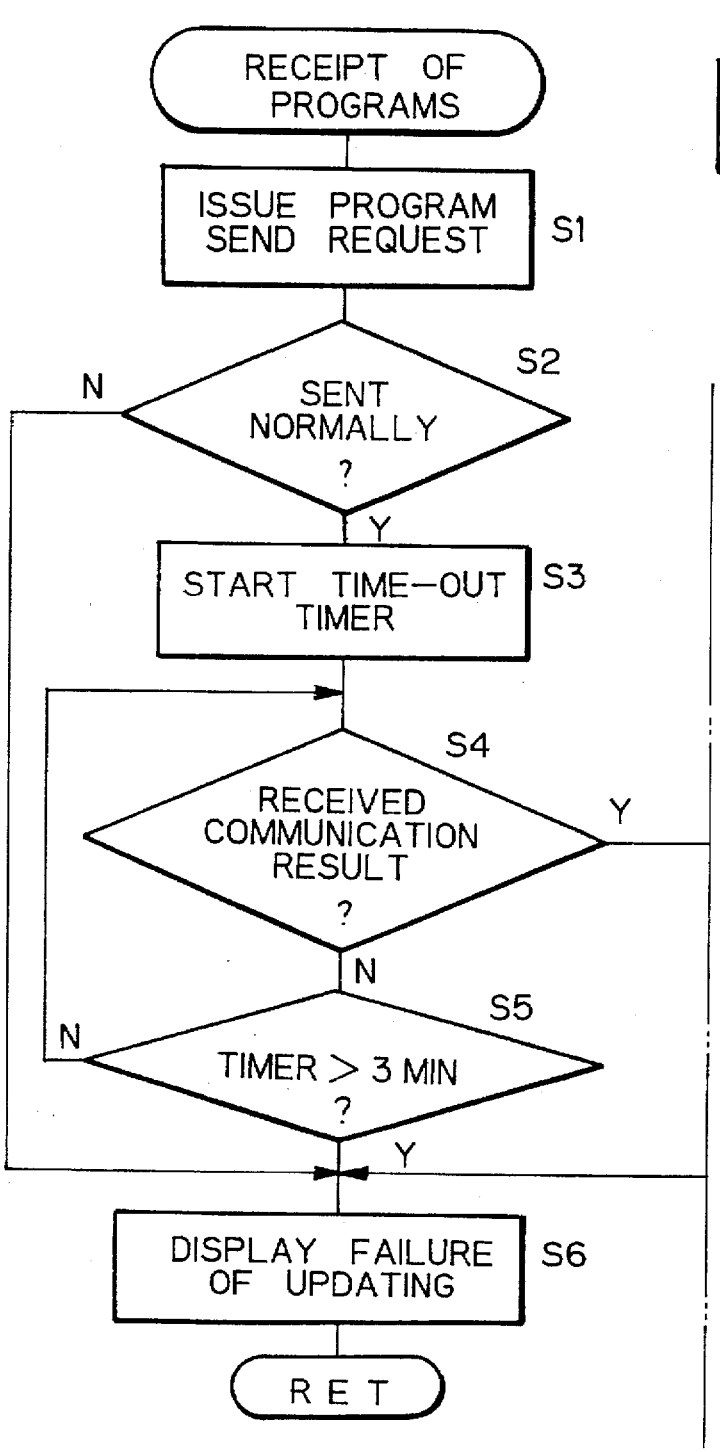
FIG. 22 is a flowchart demonstrating a procedure in which the copier body receives updating programs from the external managing unit.
Figure 22B:
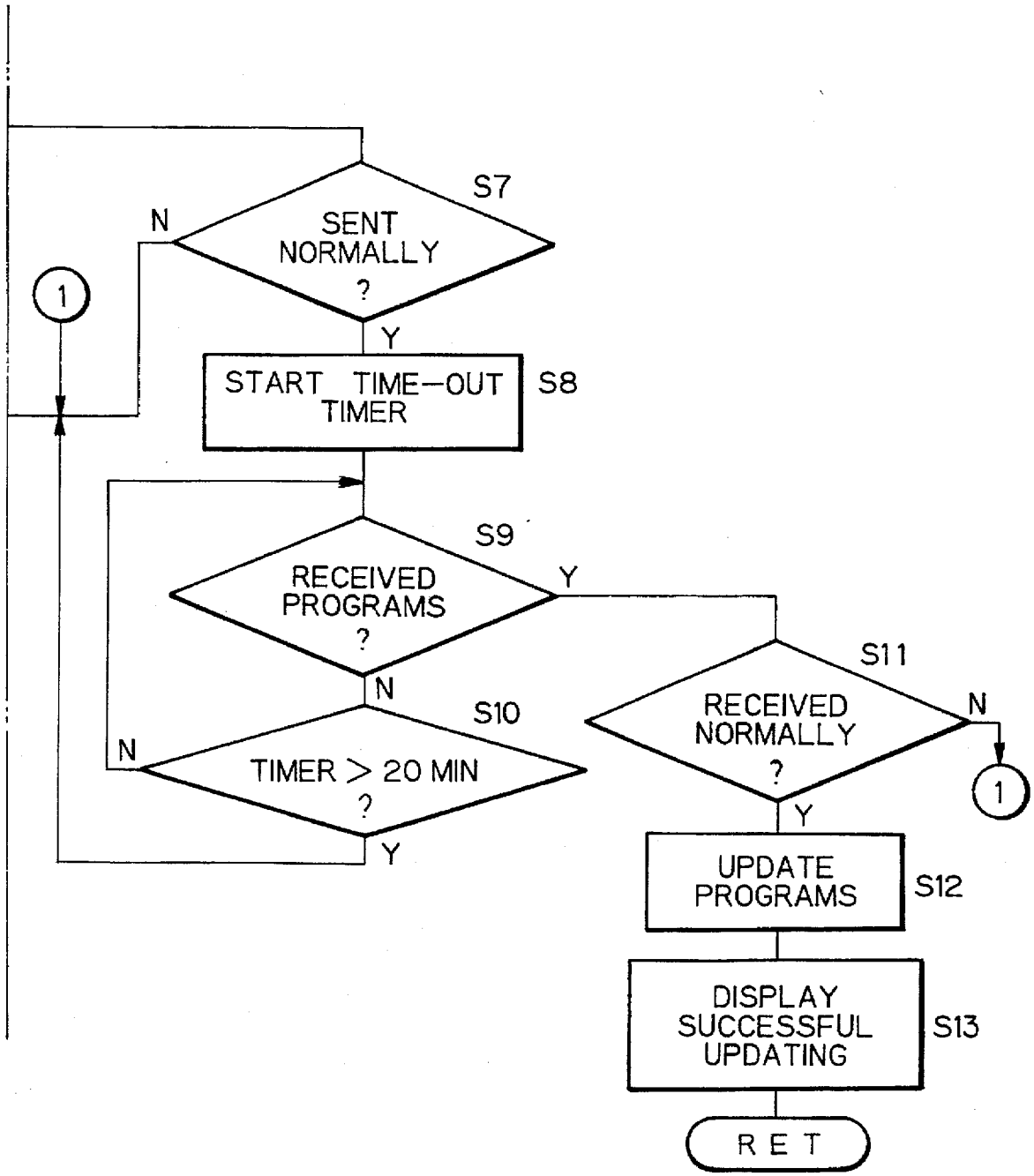

How the copier body 301 receives the updating programs from the CCU 2203 will be described specifically with reference to FIG. 22. As shown, when the copier body 301 needs updating programs, it sends an updating program send request to the CCU 2201 (step S1). If the transmission fails, e.g., if the CCU 2201 does not return a response (N, step S2), the copier body 301 displays the result on the operation and display unit 2006 and thereby informs the serviceman (working at the spot) of the failure (step S6). If the communication succeeds (Y, step S2), the copier body 30 1 stars a timer (step S3) and then waits for a result of communication from the CCU 2201 (steps S4 and S5). In the illustrative embodiment, the timer counts 3 minutes (step S5). If the copier body 301 does not receive a result of communication within 3 minutes (Y, step S5), the copier body 301 determines that the time is out and informs the serviceman of the failure via the operation and display unit 2006 (step S6).

If the copier body 301 receives a result of communication within 3 minutes (Y, step S4 or N, step S5), it examines the content of the result (step S7). If the communication failed (N, step S7), the copier body 2006 displays the failure on the operation and display unit 2006 (step S6). If the communication succeeded (Y, step S7), the copier body 301 again starts the timer (step S8) and awaits updating programs (steps S9 and S10). In this case, the timer counts 20 minutes (step S10). If the copier body 301 does not receive updating programs within 20 minutes (Y, step S10), it determines that the time is out and informs the serviceman of the failure via the unit 2006 (step S6). If the copier body 301 receives updating programs within 20 minutes (Y, step S9 or N, step S10), it examines the received data (step S11). If the received data are identical with the requested data (Y, step S11), the copier body 301 updates the programs (i.e. writes them in the RAM 2019) (step S12) and then informs the serviceman of the successful updating via the unit 2006 (step S13). If the updating of the programs fails, e.g., an error exists in the updating programs (N, step S11), the copier body 301 reports it to the serviceman via the unit 2006 (step S6).

Figure 23:
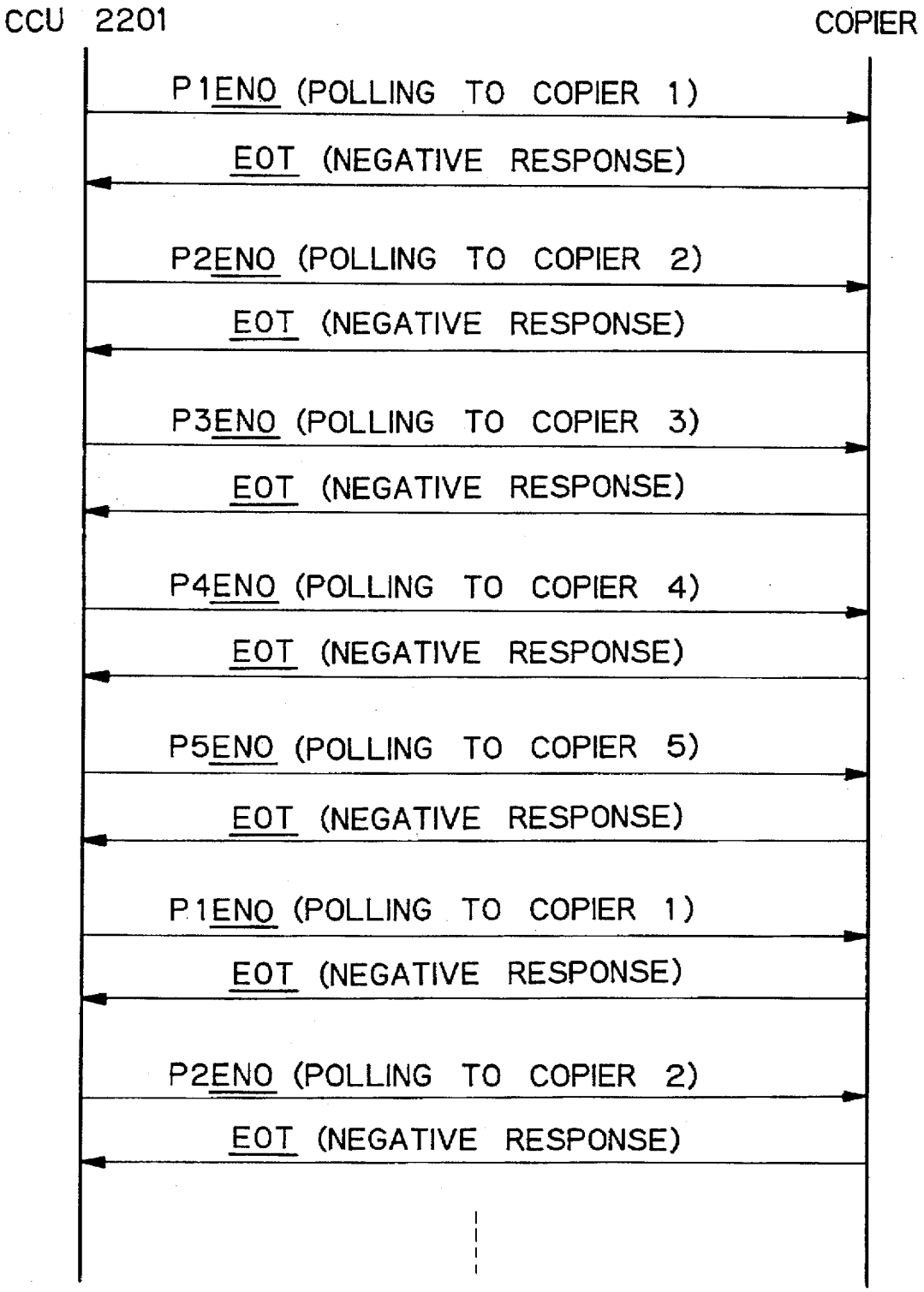
FIGS. 23–25 each shows a communication procedure between the copier body and the communication control unit.
Figure 24:
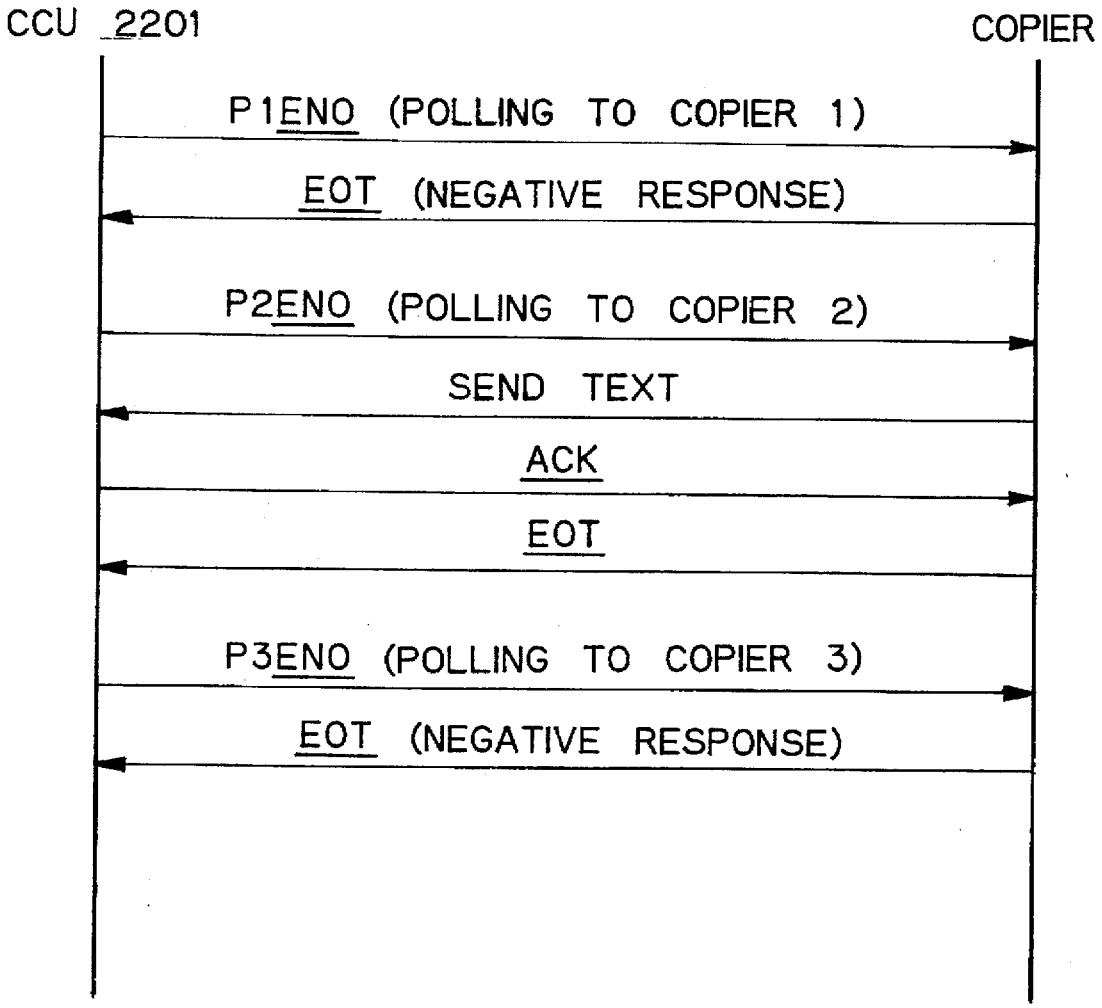
Figure 25:
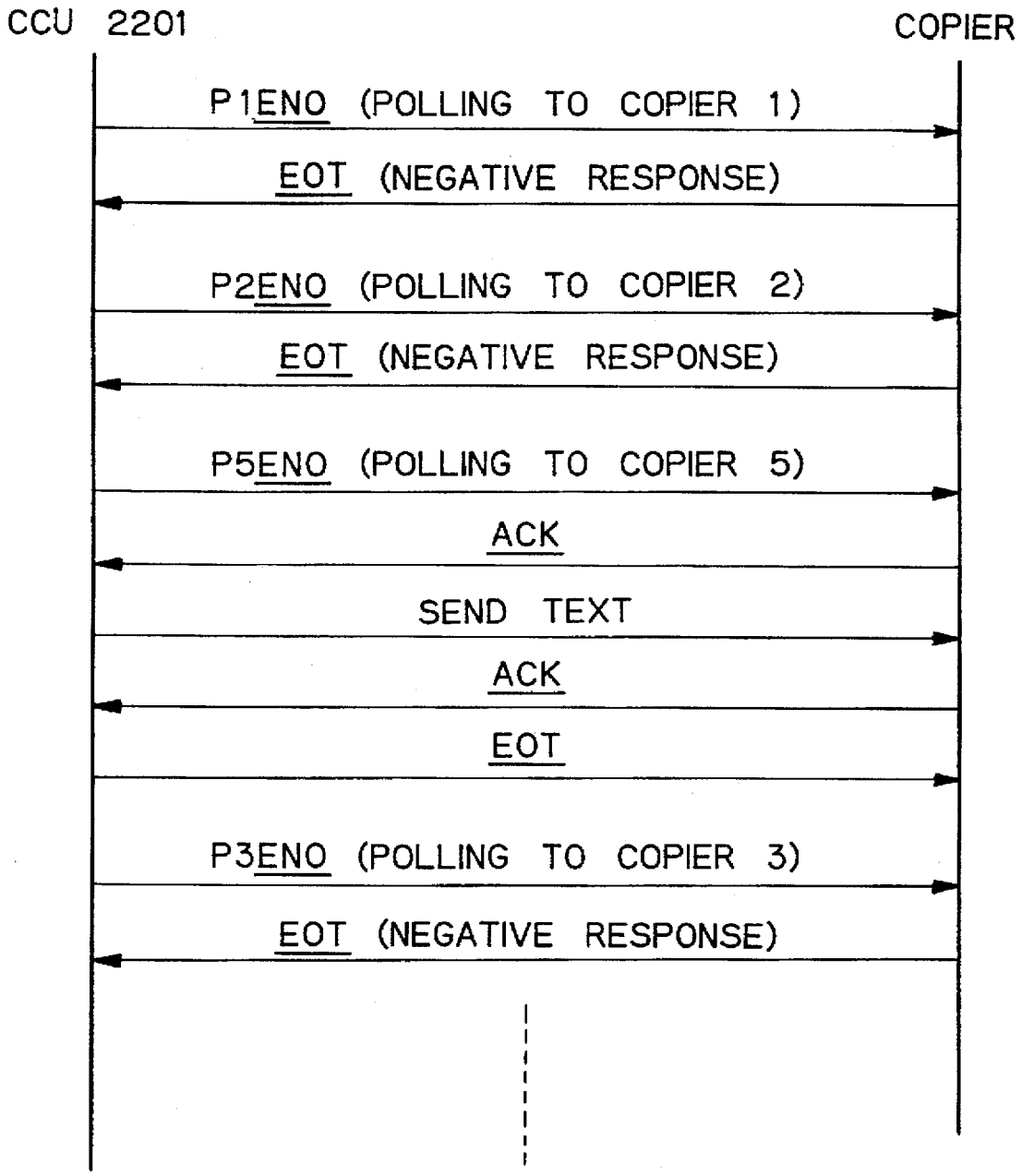

Referring to FIGS. 23–25, a communication procedure between the CCU 2201 and the copier body will be described. FIG. 23 shows a sequence to occur in an idle state, assuming five copier bodies 301 connected to the CCU 2201. As shown, the CCU 2201 executes a polling cycle in which a polling sequence is sequentially sent to the copier bodies 301 on the basis of their polling addresses. Each copier, polled by its own address, returns a negative response to the CCU 2201 if a text to be sent (updating program send request) is absent. The CCU 2201 repeats such a polling cycle so long as any other communication processing is absent.

As shown in FIG. 24, when an updating program sent request is generated in, for example, the copier having the address 2, the copier sends the text (updating program send request) to the RS-485 line after it has been polled by its own address.

FIG. 25 shows a specific procedure in which the CCU 201 sends a text or updating programs to the copier of address 5. As shown, on completing the polling under way, the CCU 2201 sends a selecting sequence to the copier of address 5 by using a selecting address assigned thereto, and then sends the text to the copier. Thereafter, the CCU 2201 resumes the polling cycle.

The updating programs may be supplied from an external memory device (floppy disk), as follows. As shown in FIG. 14, the FDC 2040 is mounted on the APL(3) 2004 in order to control the floppy disk 2041. Assume that the copier body 301 cannot deal with the additional function connected thereto. Then, the copier body 301 displays on the LCD of the unit 2006 a message for urging the operator to set a floppy disk storing updating programs, as shown in FIG. 19. In the message, "No. xx" is indicative of the management number of the floppy disk; which floppy disk is needed is indicated by the additional function. When the operator loads the disk 2041 on a floppy disk driver, not shown, updating programs are read out of the disk under the control of the FDC 2040. When updating programs cannot be read out because of the wrong management number by way of example, a message for urging the operator to load the correct disk on the floppy disk driver, as shown in FIG. 20. If expected updating programs are read out, they are written to the nonvolatile RAM 2019 via the system bus 2011. Thereafter, the copier body 301 controls the additional function according to the updating programs. The updating program for displaying extra pictures and controlling the display is transferred to the operation and display unit 2006 and written to the nonvolatile RAM 2065. This allows the unit 2006 to display mode setting keys and alert indicators associated with the additional function, and to control the display. While an IC card, magnetooptical (MO) disk or similar medium may be substituted for the floppy disk 2041, the program updating procedure described above in relation to the disk 2041 is substantially the same.

Figure 26:
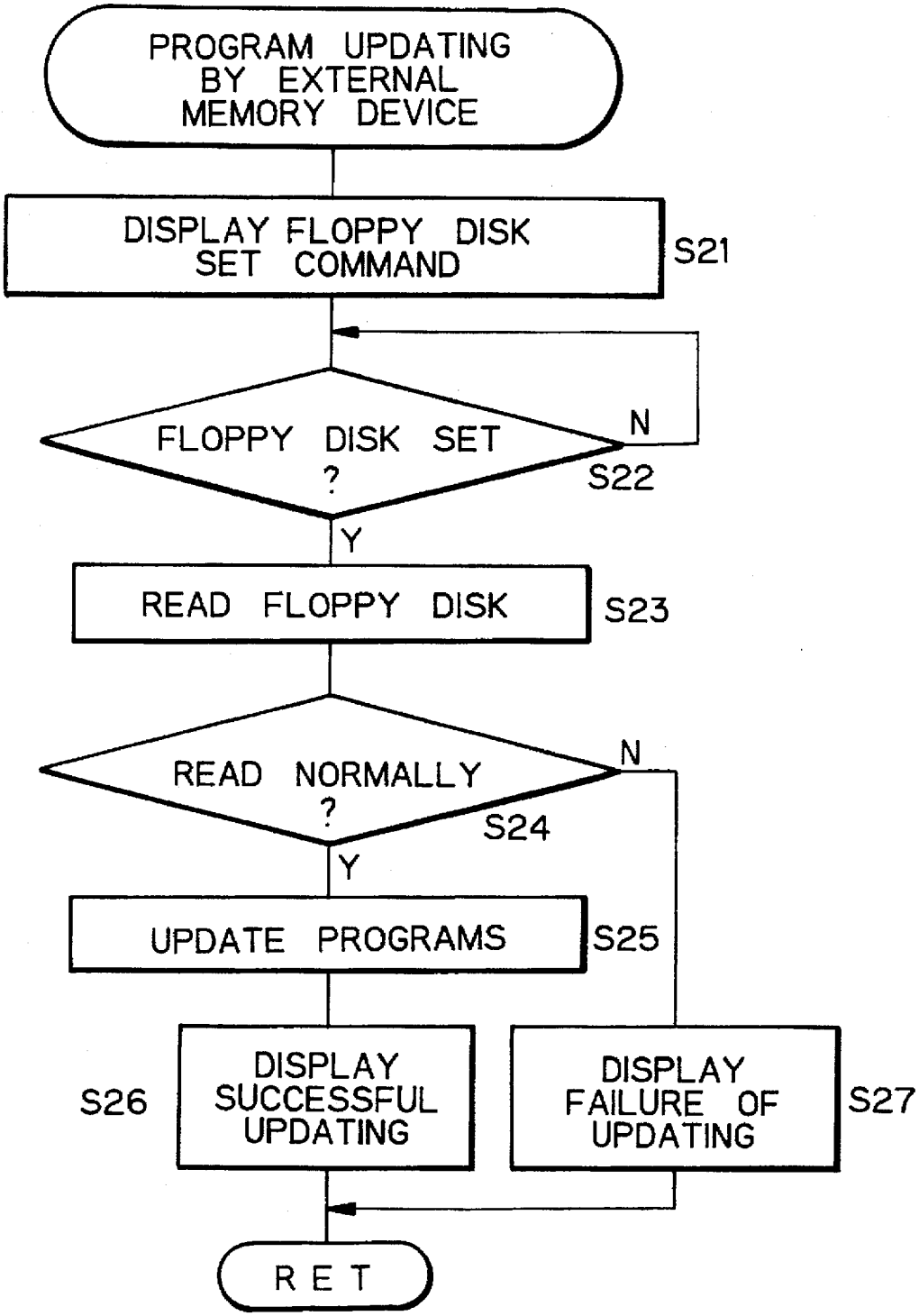
FIG. 26 is a flowchart showing a procedure in which the copier body receives updating programs from the external memory device.

FIG. 26 shows a procedure in which the copier body 301 receives updating programs from the memory device or floppy disk 2041. As shown, when the copier body 301 needs updating programs, it urges the serviceman at the spot to set a floppy disk storing them via the operation and display unit 2006 (step S21). When such a floppy disk is set on the floppy disk driver, not shown, (Y, step S22), the updating programs are read out of the disk (step S23). If the necessary updating programs are not found in the disk, or if the updating programs are different, or if the data cannot be correctly read out (N, step S24), the copier body 301 informs the serviceman of the failure via the unit 2006 (step S27). When the updating programs are correctly read out of the disk (Y, step S24), the copier body 301 updates the programs (i.e. writes them in the nonvolatile RAM 2019) (step S25), and then displays the successful updating on the unit 2006.

The updating programs may be directly supplied from the additional function, peripheral to the copier body 301, as follows. This alternative scheme will be described with reference to FIGS. 2, 3, 4, 21 and 27, assuming that the sorter 303 is connected to the copier body 301. Assume that the copier body 301 lacks control programs relating at least to the type of sorter newly connected thereto.

Figure 21:
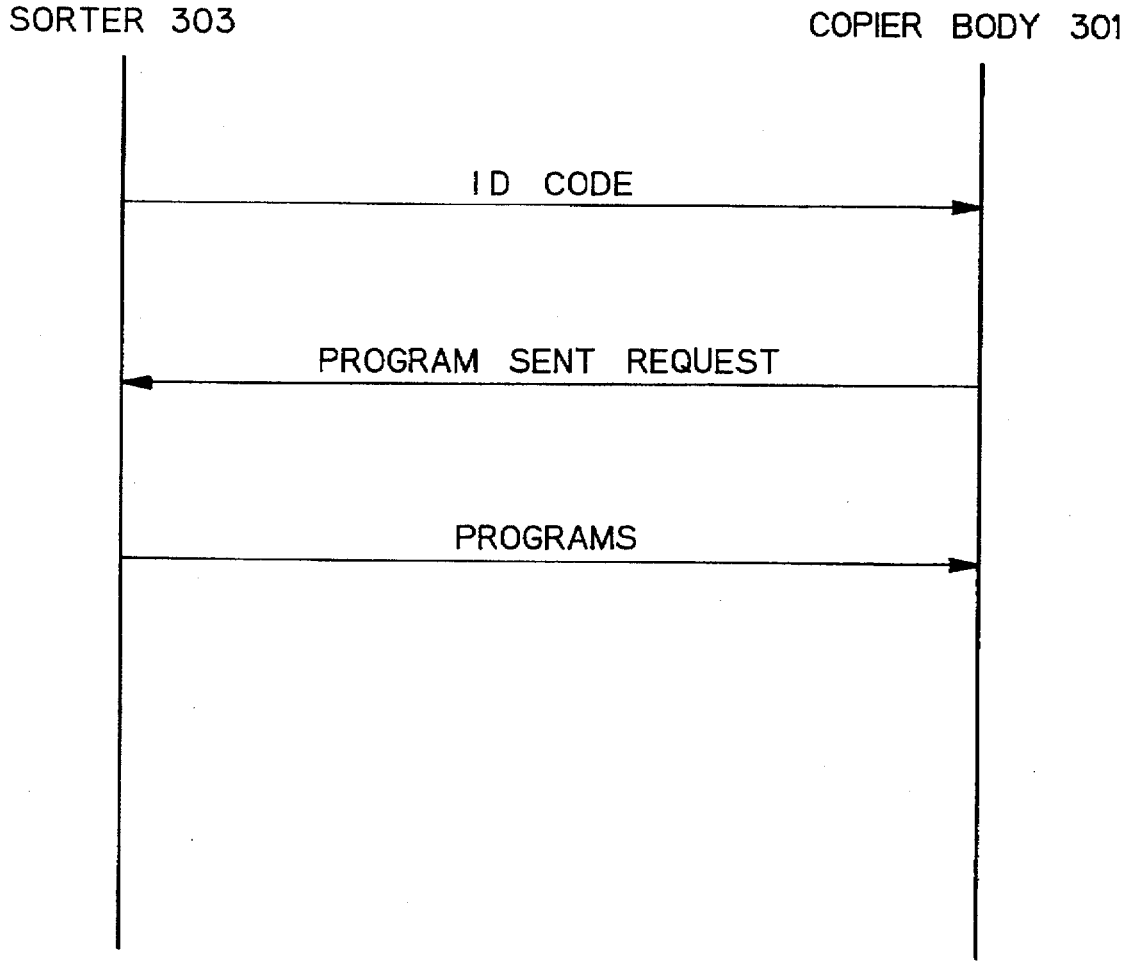
FIG. 21 shows the flows of dam to occur when a sorter is newly connected to the copier body.
Figure 27:
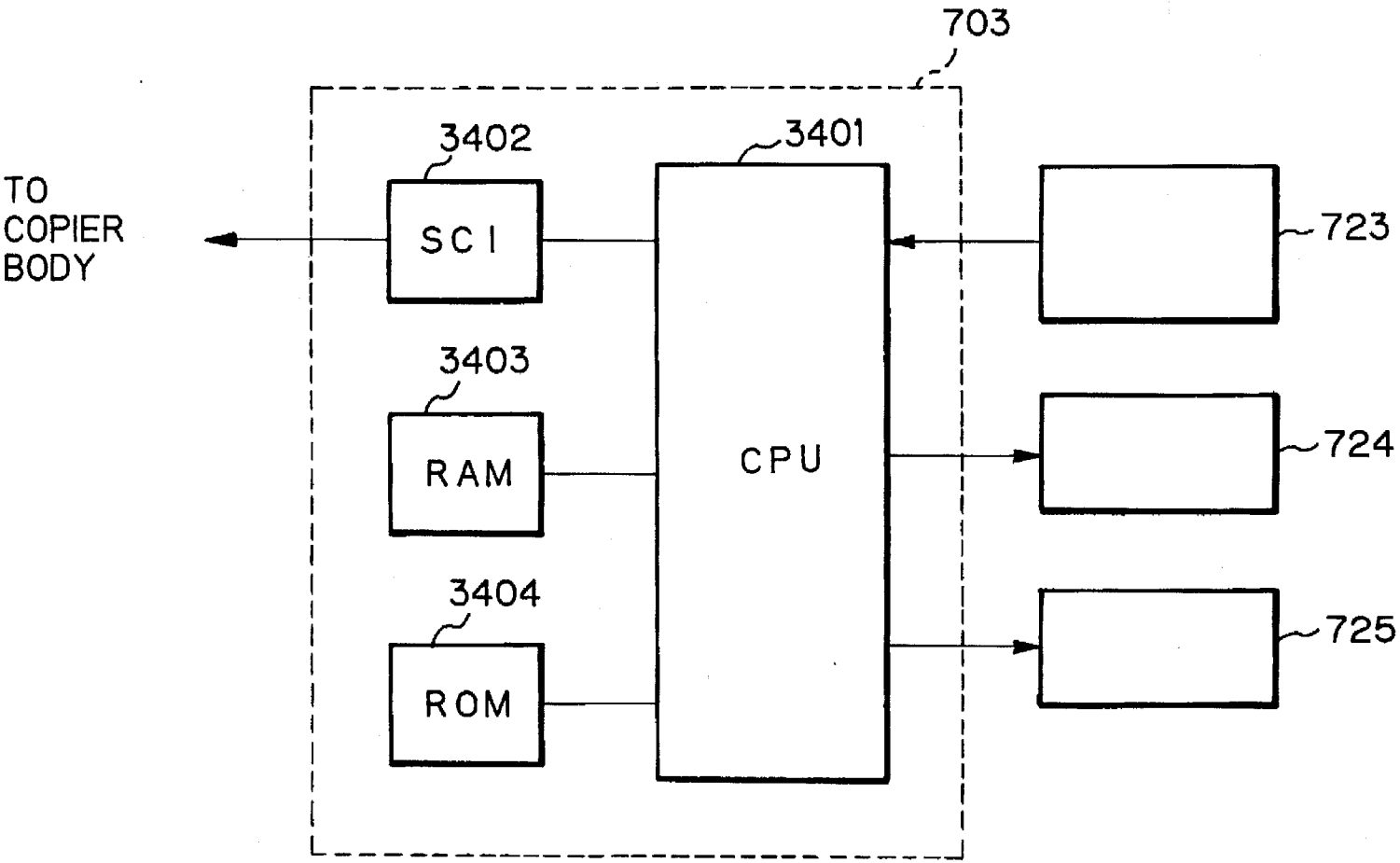
FIG. 27 is a block diagram schematically showing a sorter.

FIG. 27 schematically shows the construction of the sorter 303. As shown, the sorter 303 has a sorter control board 703, a CPU 3401 for controlling the sorter 303, a RAM 3403 associated with the CPU 3401, a ROM 3404 storing a sorter control program and updating programs, and a serial communication interface (SCI) 3402. The sorter 303 is newly connected to the copier body 301 and has its SCI 3402 connected to the USARP 617 by an optical fiber or similar serial communication line, not shown. Then, as shown in FIG. 21, the copier body 301 checks its connection to the sorter 303 as part of an additional function peripheral connection check routine which covers all the additional functions peripherals. The sorter 303 sends a unique ID code (version code) representative of the type of the sorter 303 and sorter control program to the copier body 301 over the serial communication line. The copier body 301 determines whether or not it can control the sorter 303 on the basis of the received ID code and its own version code. If the result of this decision is negative, the copier body 301 sends to the sorter 303 an updating program send request and its own ID code over the communication line.

On receiving the request, the sorter 303 selects, among updating programs stored in the ROM 3404, programs matching the ID code of the copier body 301 and sends them to the copier body 301. The copier body 301 writes the updating programs in the nonvolatile RAM 629 or 614. Thereafter, the copier body 301 controls the sorter 303 by use of the updating programs. The updating program for displaying mode setting pictures and control is transferred to the operation and display unit 2006. This allows the unit 2006 to display mode setting keys (sort key, stack key and others particular to the sorter) and alert indicators associated with the sorter 303 and to control the display. The copier body 301, received the updating programs, updates its own version data and writes the updated data in the nonvolatile RAM 629 or 614. Hence, at the next power up, the copier body 301 uses the control programs stored in its own RAM 629 or 614.

Figure 28:
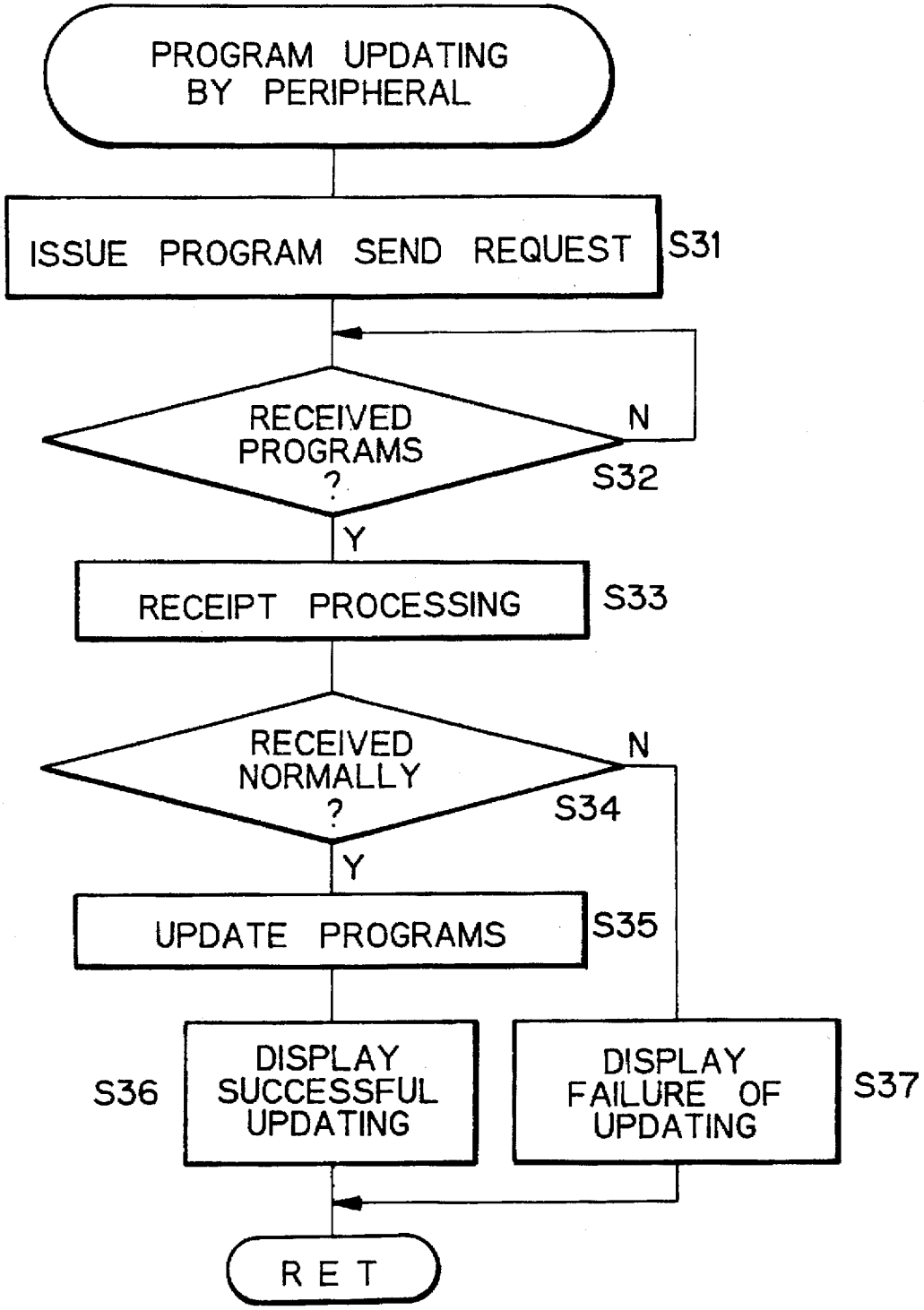
FIG. 28 is a flowchart showing a procedure in which the copier body receives updating programs from an additional function peripheral.

FIG. 28 demonstrates how the copier body 301 receives the updating programs from the additional function peripheral. As shown, when the copier body 301 needs updating programs, it issues an updating program send request to the additional function peripheral (step S31) and then awaits updating programs from the additional function peripheral (step S32). Subsequently, the copier body 301 executes receipt processing (Y, step S32 and step S33). On completing the receipt, the copier body 301 examines the received contents (step S34). If the received updating programs are identical with the requested programs (Y, step S34), the copier body 301 executes program updating (writing the programs in the RAM 629 or 614 and other processing) (step S35). Then, the copier body 301 displays the successful updating on the unit 625 (step S36). If the program updating is unsuccessful, e.g., if an error exists in the received programs (N, step S34), the copier body 301 reports it to the serviceman via the unit 625 (step S37).

Figure 29A:
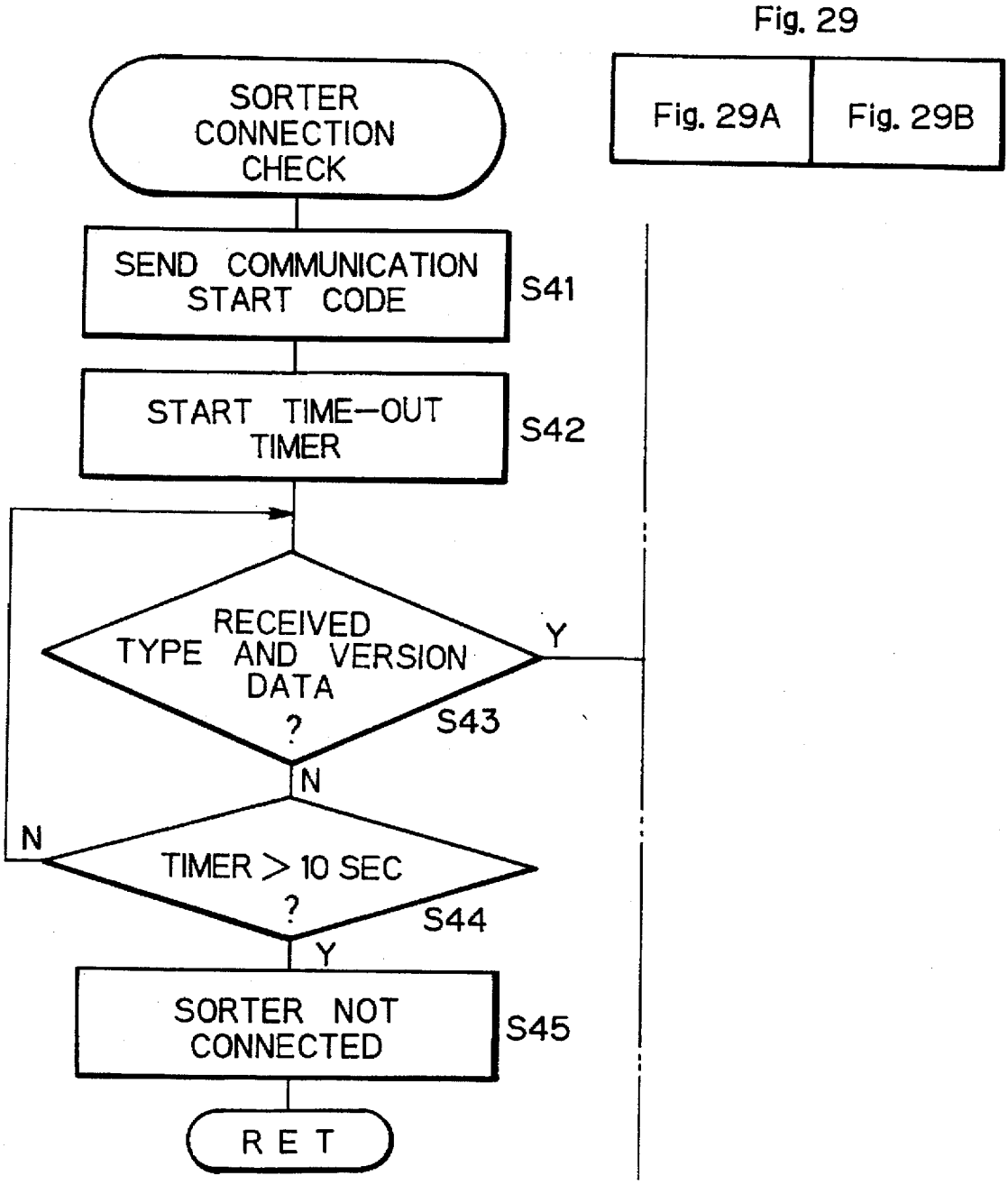
FIG. 29 is a flowchart demonstrating a connection check routine between the apparatus body and the sorter.
Figure 29B:
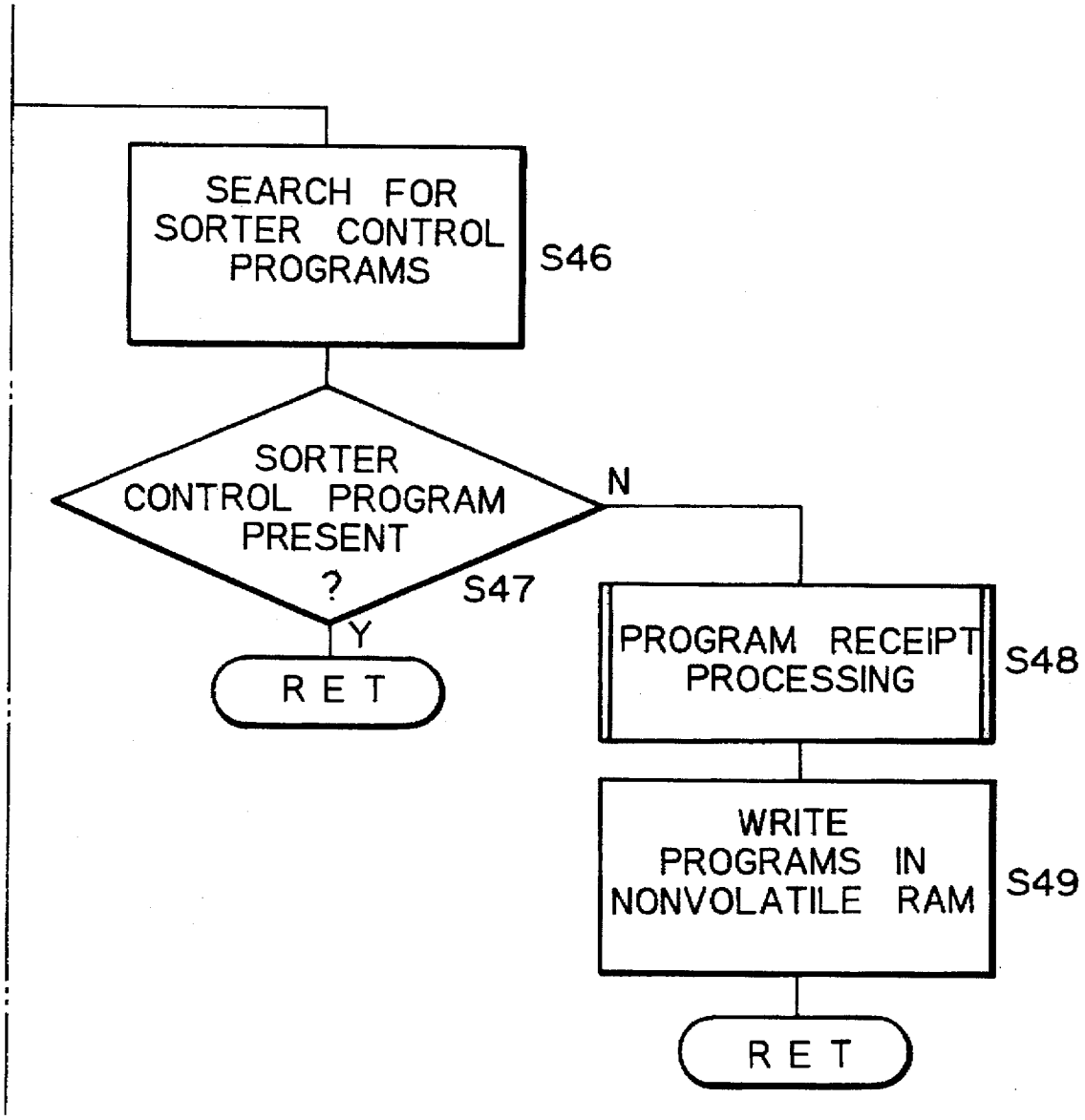

The copier body 301 executes the following procedure in order to be connected to the additional function peripheral or sorter 303 when lacking the control programs for controlling it. At the time of power up, the copier body 301 checks the connection thereof to the additional functions peripherals (including the sorter 303, ADF 302, and duplex copy unit 304) over the serial lines. FIG. 29 shows part of the connection check routine relating to the sorter 303. As shown, the copier body 301 sends a communication code representative of a communication start to the sorter 303 via the USARP 617 (step S41) and, at the same time, starts a timer (step S42). Then, the copier body 301 awaits the arrival of type data and control program version data from the sorter 303 (steps S43 and S44). In this case, the timer counts 10 seconds by way of example (step S44). If no data arrives from the sorter 303 within 10 seconds (Y, step S44), the copier body 301 determines that the time is out, i.e., that the sorter 303 is not connected thereto (step S45). On the other hand, on receiving the type data and version data from the sorter 303 within 10 seconds (Y, step S43), the copier body 301 searches the ROM 612 storing sorter control programs beforehand and RAM 614 storing sorter control programs in its control program area (step S46). If control programs matching the newly connected sorter 303 are present in the ROM 612 and RAM 614 (Y, step S47), the copier body 301 controls the sorter 303 by using them thereafter. If the necessary programs are absent (N, step S47), the copier body 301 receives them from the external managing unit, external memory device, or the additional function peripheral by the previously stated procedure (step S48), writes them in the control program area of the RAM 614 (step S49), and controls the sorter 303 by using them. Because the RAM 614 is nonvolatile, the updating programs remain in the RAM 614 even when the power switch of the copier body 301 is turned off. Then, when the power switch is again turned on, the copier body 301 determines that control programs are present in the step S47. Therefore, it is not necessary for the copier body 301 to be again supplied with the control programs, so that the processing time is reduced at the second and successive turn-on of the power switch.

The above procedure is also executed when a postprocessing peripheral other than the sorter 303, e.g., a finisher or a sorter/stapler is connected to the copier body 301. The updating programs to be sent from the peripheral to the copier body 301 during the connection check routine include codes representative of the functions and ability particular to the peripheral. The functions and ability include the number of bins, the variable width of linear velocity for receiving a copy, the minimum transport path length, the paper sizes to be dealt with, whether or not a turn-over function is available, the required interval between copies, the interval between jobs, whether or not a doggy tail function is available, the front/rear copy receipt, the presence/absence of a stapler, the kinds of stapling (maximum number of copies to be stapled together, two-point stapling, and slant stapling), a machine contour display pattern meant for the LCD 2060, the kinds of punching (two holes, three holes, and four holes), the presence/absence of a folding function, the kinds of folding (in two and Z), the presence/absence of a mail box function, the directions of stapling (up and down), the adjustable range of the stapling (or punching) position, the presence/absence of a stamping function, the kinds of stamping, and a standard linear velocity. On receiving the updating programs, the copier body 301 causes, based on the program stored in the ROM 628, the CPU 602 to compare the above function data with the functions of the ADF 302, duplex copy unit 304 and other peripherals connected to the copier body 301. The CPU 602 distinguishes the functions which can be used as a system and the functions which cannot be used. Then, the CPU 602 sends picture data newly required due to the system configuration and meant for the LCD 2060 to the nonvolatile RAM 2065. This processing will be described with reference to FIG. 30.

Figure 30:
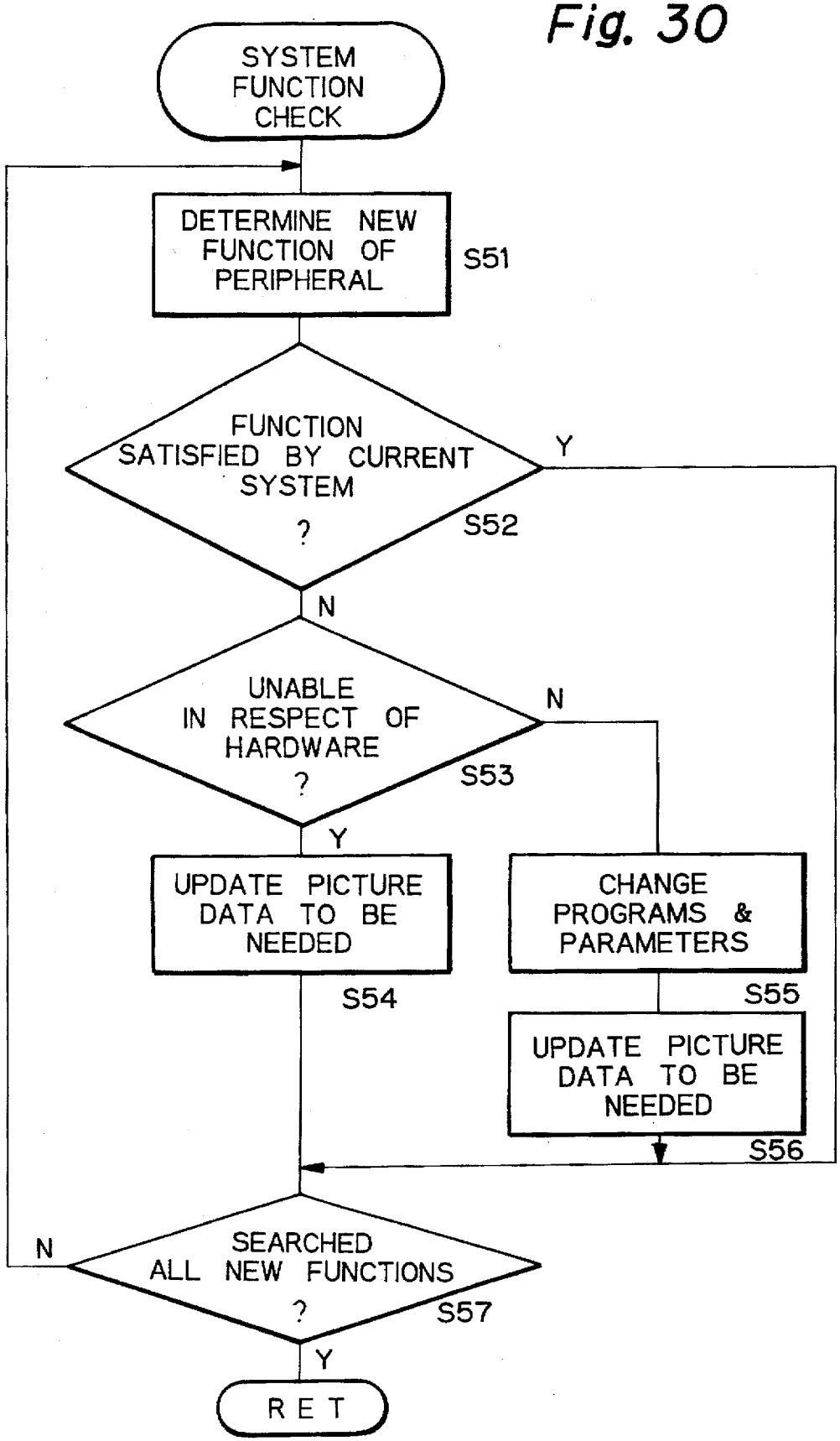
FIG. 30 is a flowchart representative of system function check processing.

In FIG. 30, the extra postprocessing functions are searched (step S51) to see if the existing system satisfies them or not (step S52). If the existing system suffices and when all the new functions are searched, the procedure ends (Y, step S52 or Y, step S57). If the functions cannot be performed by the existing system and cannot be implemented hardware (N, step 52 or Y, step S53), picture data to be needed are updated (step S54). If the functions cannot be sufficed by the existing system, but can be implemented by hardware (N, step S52 or N, step S53), the programs and parameters are changed (S55). Then, picture data to be needed are updated (step S56). When all the new functions are fully searched, the procedure ends (Y, step S57).

Figure 31:
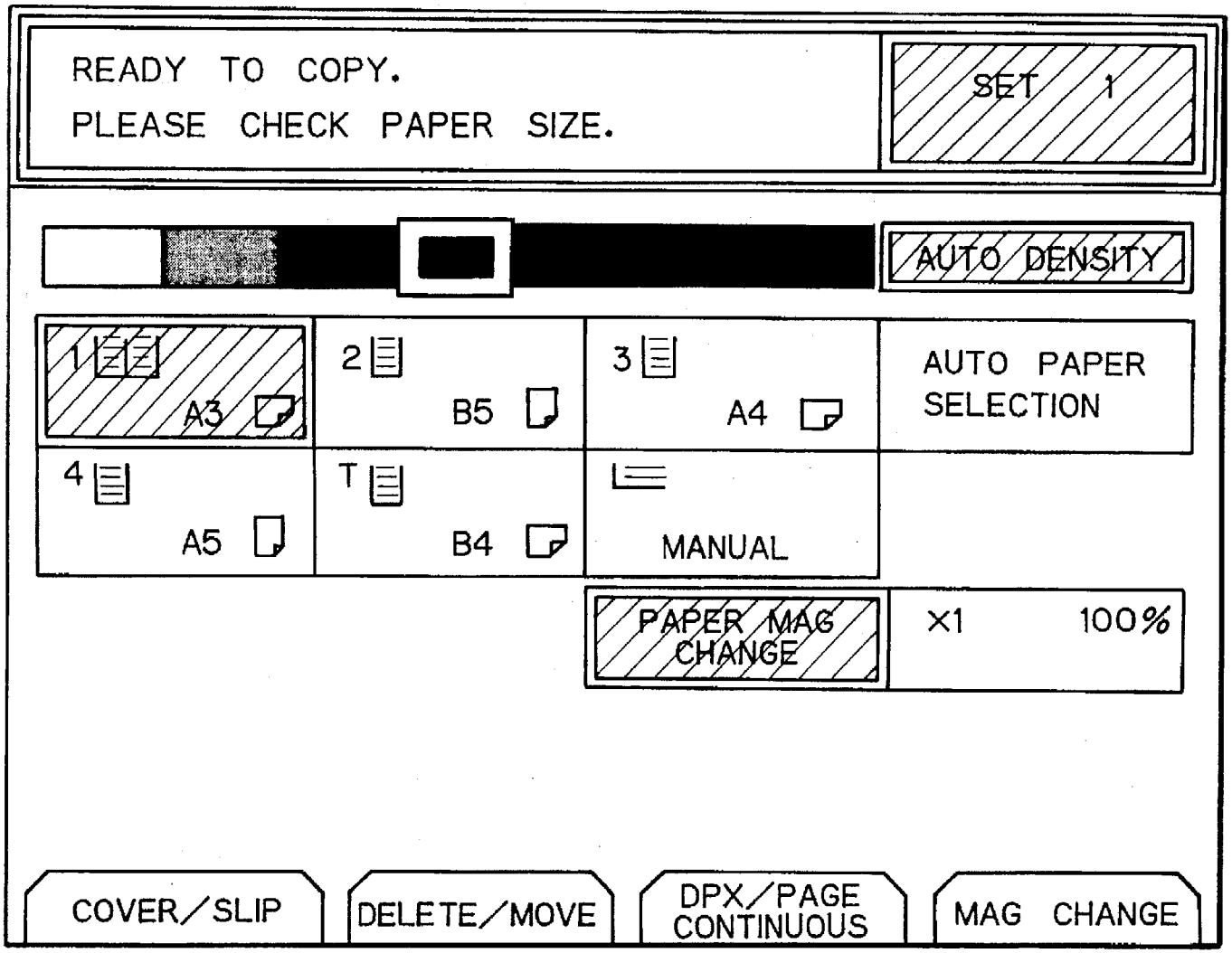
FIGS. 31, 32 and 33A–33C each shows a particular picture to appear on a display.
Figure 32:
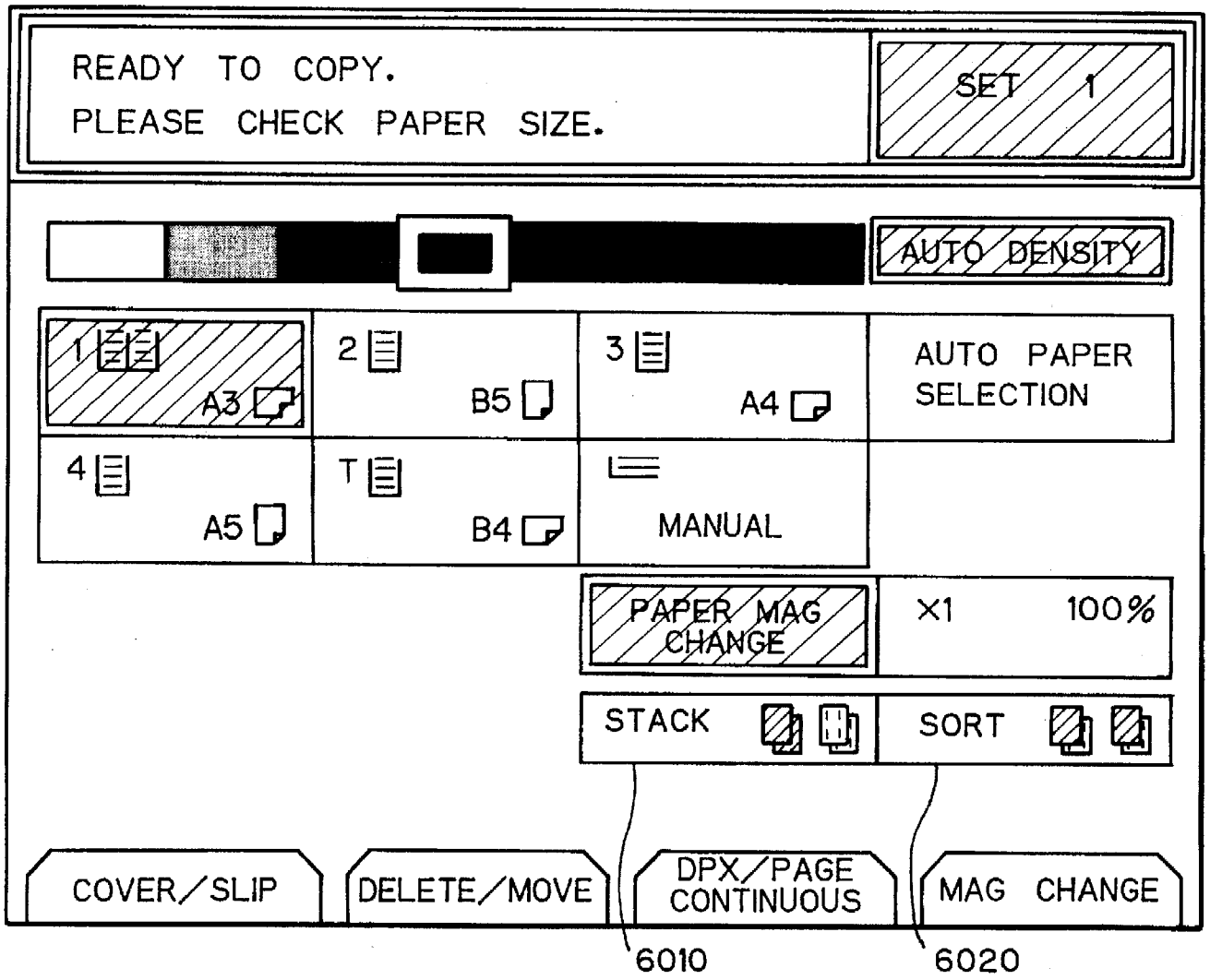

When the sorter 303 is newly connected to the copier body 301, and the program updating is completed, a sort mode and a stack mode are basically available. Hence, the picture on the LCD 2060 changes from the one shown in FIG. 31 to the one shown in FIG. 32 on the basis of the updating program written to the operation and display unit 2006. As shown in FIG. 32, the new picture includes a stack key 6010 and a sort key 6020.

Figure 33A:
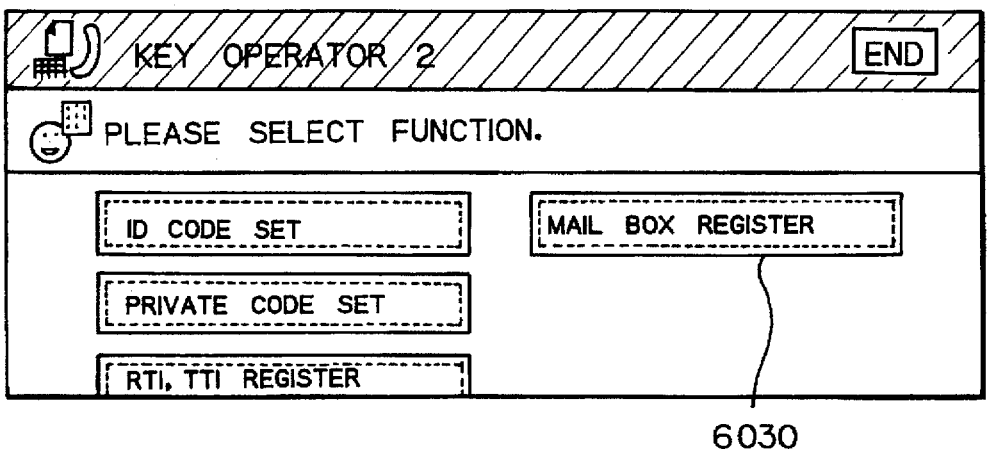
Figure 33B:
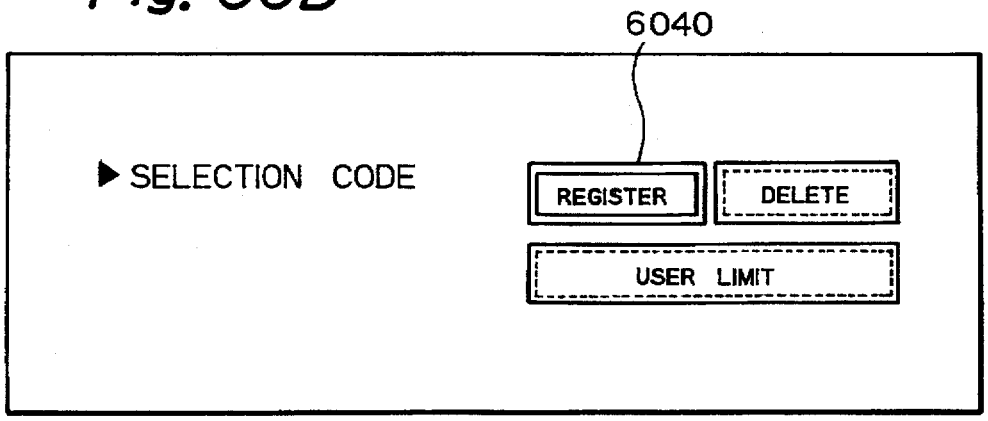
Figure 33C:
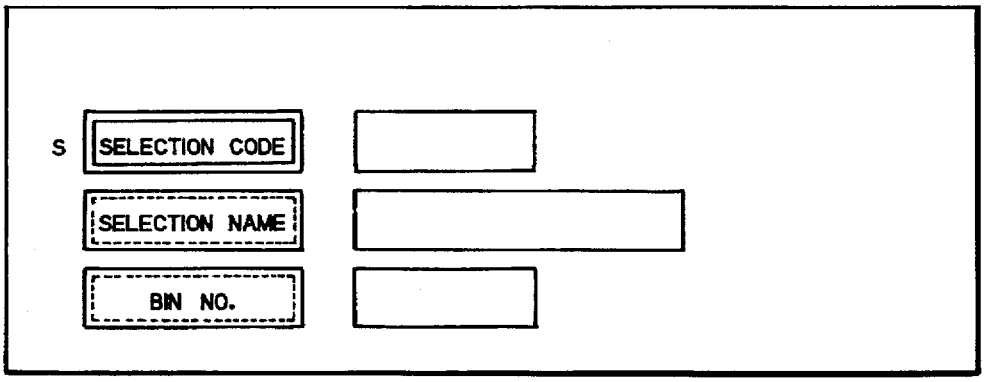

When the facsimile function is used, the sorter 303 whose bins are not movable can play the role of a mail box. When the copier body 301 determines that the sorter 303 newly connected thereto has a mail box function by the previously stated procedure, it adds new pictures to the operation and display panel 625. Specifically, when the user selects the facsimile utility function on the T/S 2063 overlying the LCD 2060, a picture shown in FIG. 33A appears. As shown, the picture includes a mail box register key 6030 due to the addition of the sorter 303. When the user touches the key 6030, a picture shown in FIG. 33B appears in place of the picture of FIG. 33A. When the user touches a register key 6040 in the picture of FIG. 33B, the picture is replaced with a picture shown in FIG. 33C. The user, watching the picture of FIG. 33C, enters a section code and a section name on numeral keys and character keys, not shown, for each bin. As a result, the sorter 303 can service as a mail box.

Figure 34:
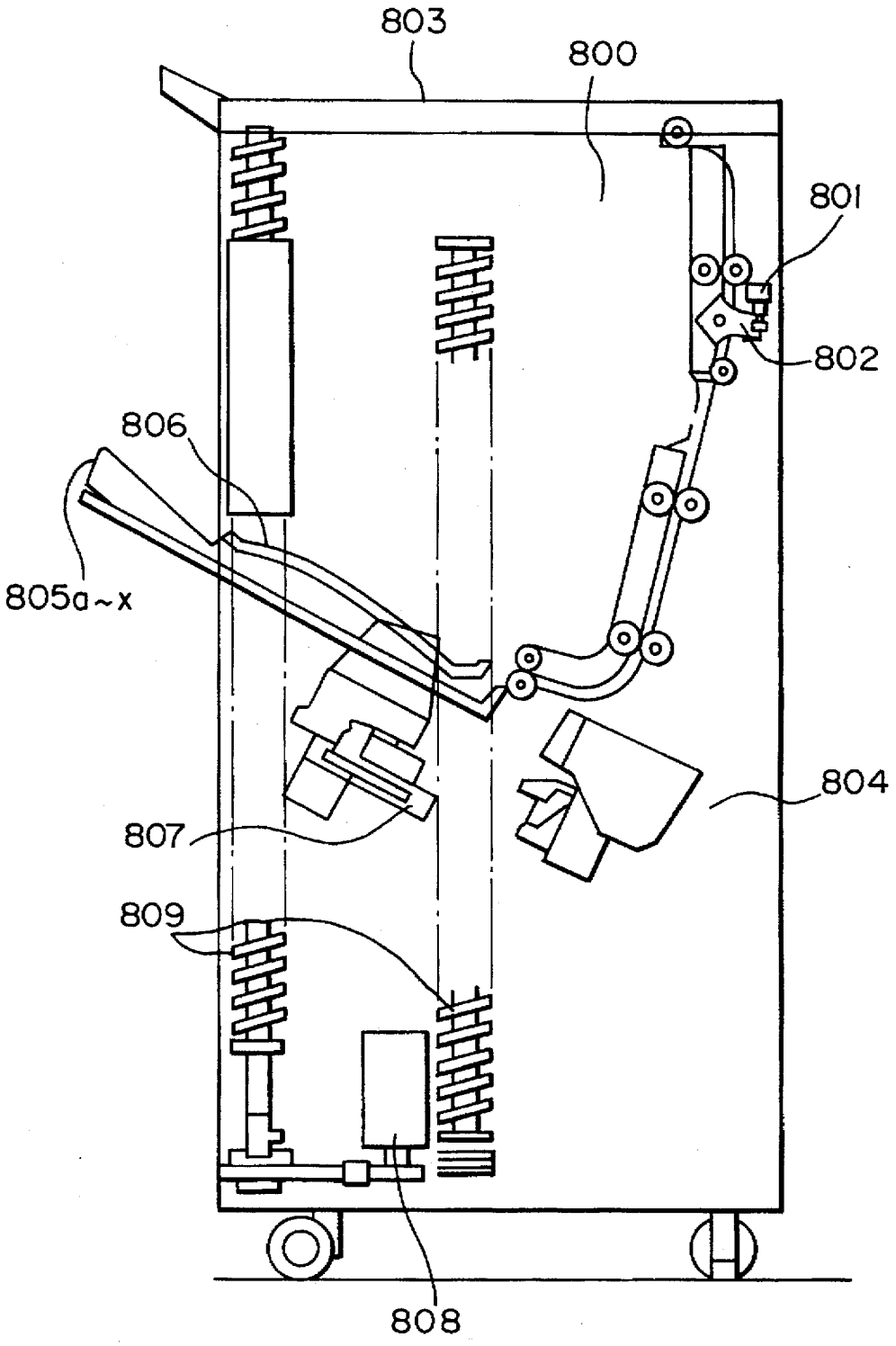
FIG. 34 is a section of a sorter/stapler belonging to a family of postprocessing peripherals.

FIG. 34 shows the construction of a sorter/stapler (S/S) 800 belonging to a family of postprocessing peripherals. As shown, the S/S 800 has an inlet sensor 801 located at a copy inlet. A path selector 802 steers a copy coming in through the inlet either to a proof tray 803 or to a path terminating at a stack of bins 805*a*–805*x*. The bins 805*a*–805*x* are supported by helical spirals 809. As the helical spirals 809 are selectively rotated in opposite directions, they move the bins 805*a*–805*x* up and down for thereby sorting or stacking copies. A chuck unit 807 includes a chuck solenoid and a chuck motor, not shown. The chuck unit 807 chucks copies stacked on any one of the bins 805*a*–805*x* and conveys them to a stapler unit 804. The stapler unit 804 drives staples from below the copy stack. There are also shown in the figure an auxiliary bin 806 for positioning the copy stack, and a bin lift motor 808 for driving the helical spirals 809.

Figure 35:
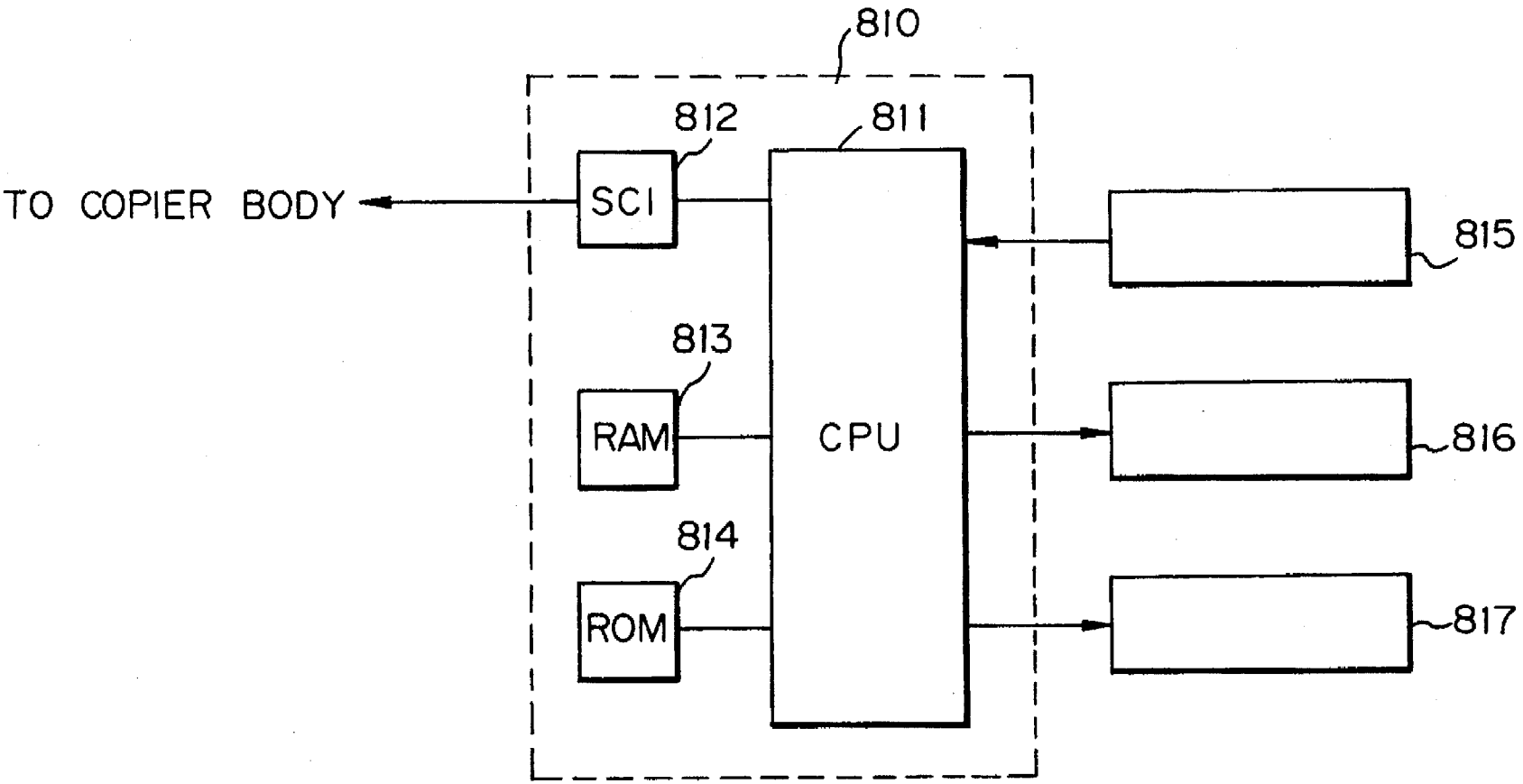
FIG. 35 is a block diagram of the sorter/stapler.

FIG. 35 shows the electrical arrangement of the S/S 800. As shown, the S/S 800 has a control board 810, a CPU 811 for controlling the S/S 800, a RAM 813 for the CPU 811, a ROM 814 storing S/S control programs and updating programs, a serial communication interface (SCI) to be connected to the copier body 301, and sensors 815. A block designated by the reference numeral 816 includes a drive motor for driving rollers, a stapler drive motor, and the bin lift motor 808.

Figure 36:
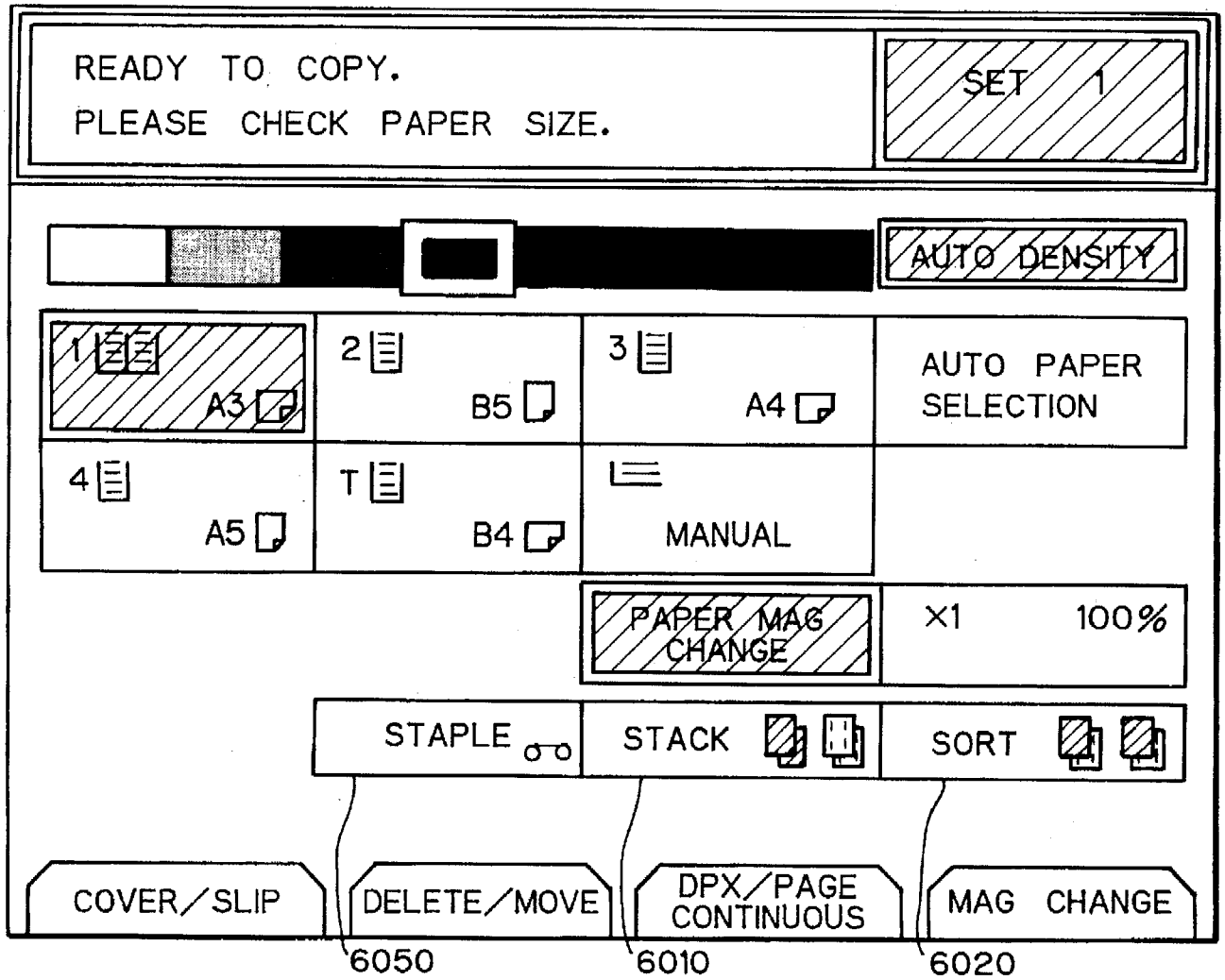
FIG. 36 shows a specific picture to appear on the display.
Figure 37:
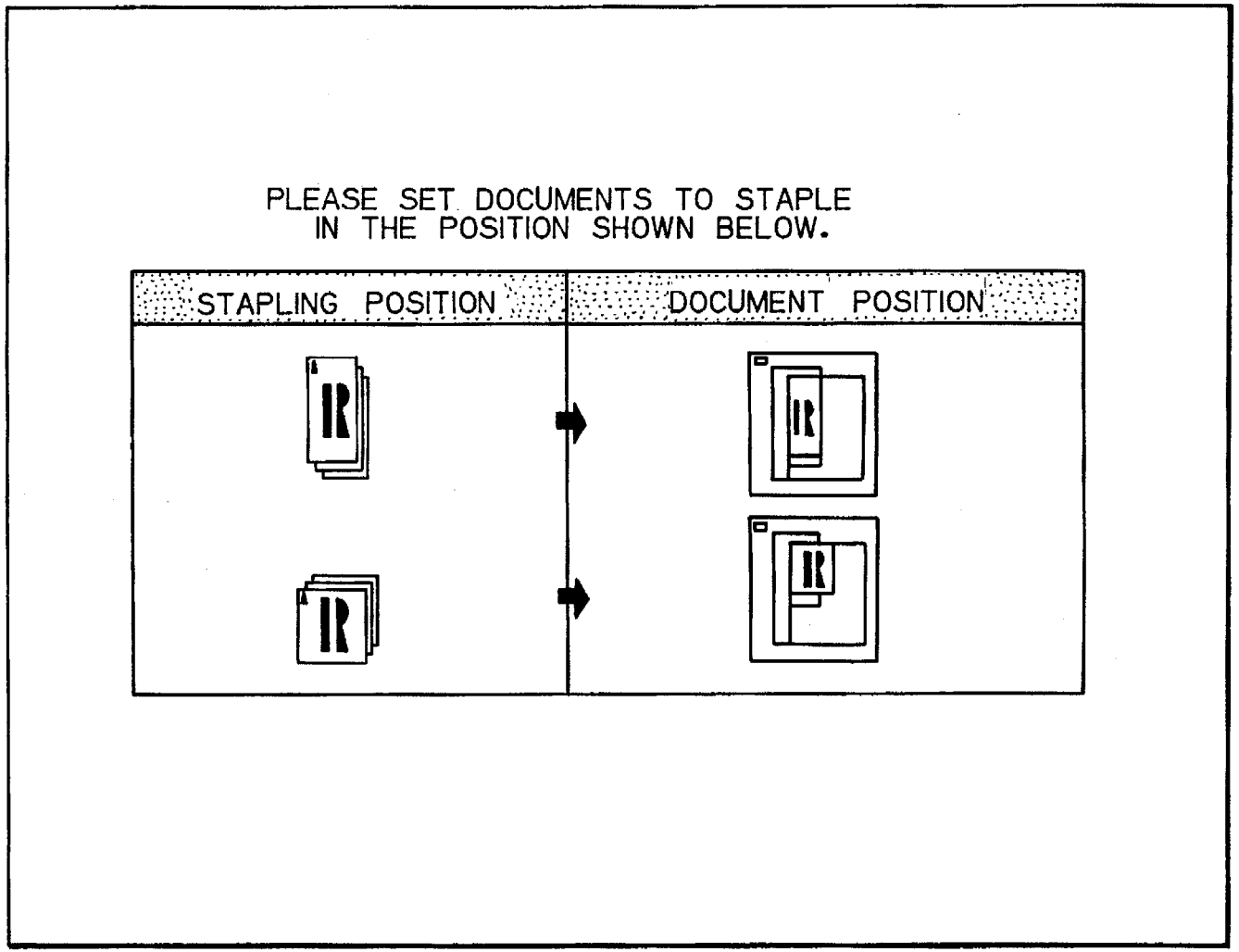
FIG. 37 shows a specific picture for showing the operator stapling positions available.

When the S/S 800 is connected to the copier body 301, the programs stored in the copier body 301 are updated in the same manner as when the sorter 303 is newly connected. At the same time, the system function check routine of FIG. 30 is executed. As a result, the picture shown in FIG. 31 is replaced with a picture shown in FIG. 36 and additionally including a staple key 6050, a stack key 6010, and a sort key 6020. When the user touches the staple key 6050, a picture shown in FIG. 37 appears to inform the user of stapling positions matching the functions of the S/S 800. This successfully reduces defective copies.

Figure 38:
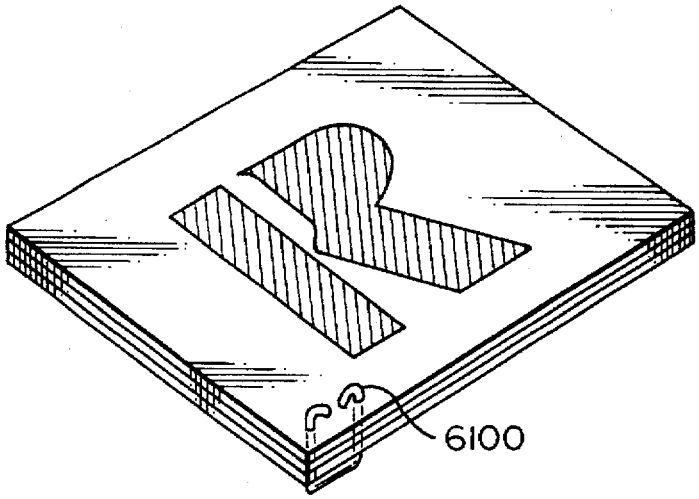
FIG. 38 shows a stack of copies stapled at an opposite position.
Figure 39:
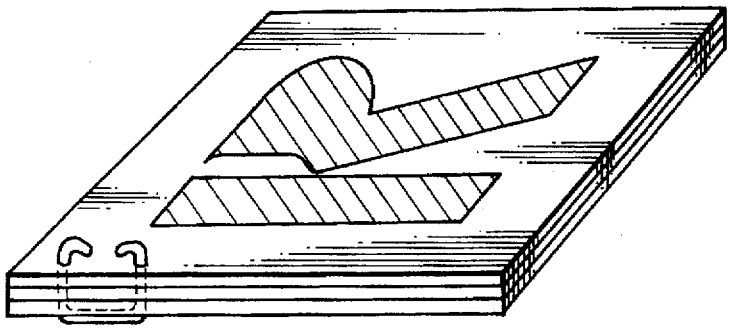
FIG. 39 shows a specific picture for alerting the operator to the stapling at the opposite position.

The S/S 800 drives a staple or staples from below a stack of copies while the copier body 301 discharges copies face up. Hence, when copies are produced in a usual manner and then stapled, they will be stapled in a position opposite to the desired position, as shown in FIG. 38. To inform the user of this beforehand, an alert picture shown in FIG. 39 specifically appears. The reference numeral 6100 designates a staple driven into the copies.

An alternative method for avoiding the above occurrence will be described with reference to FIGS. 40, 41, and 42A–42C. Briefly, this method changes the order of documents and uses the turn-over mechanism of the copier body 301. In the system function check routine shown in FIG. 30, the copier body 301 implements the additional staple mode by changing a staple mode operation program in the existing system (combination of the down-feed ADF 302 with a turn-over function and the turn-over path of the copier body 301).

Figure 40A:
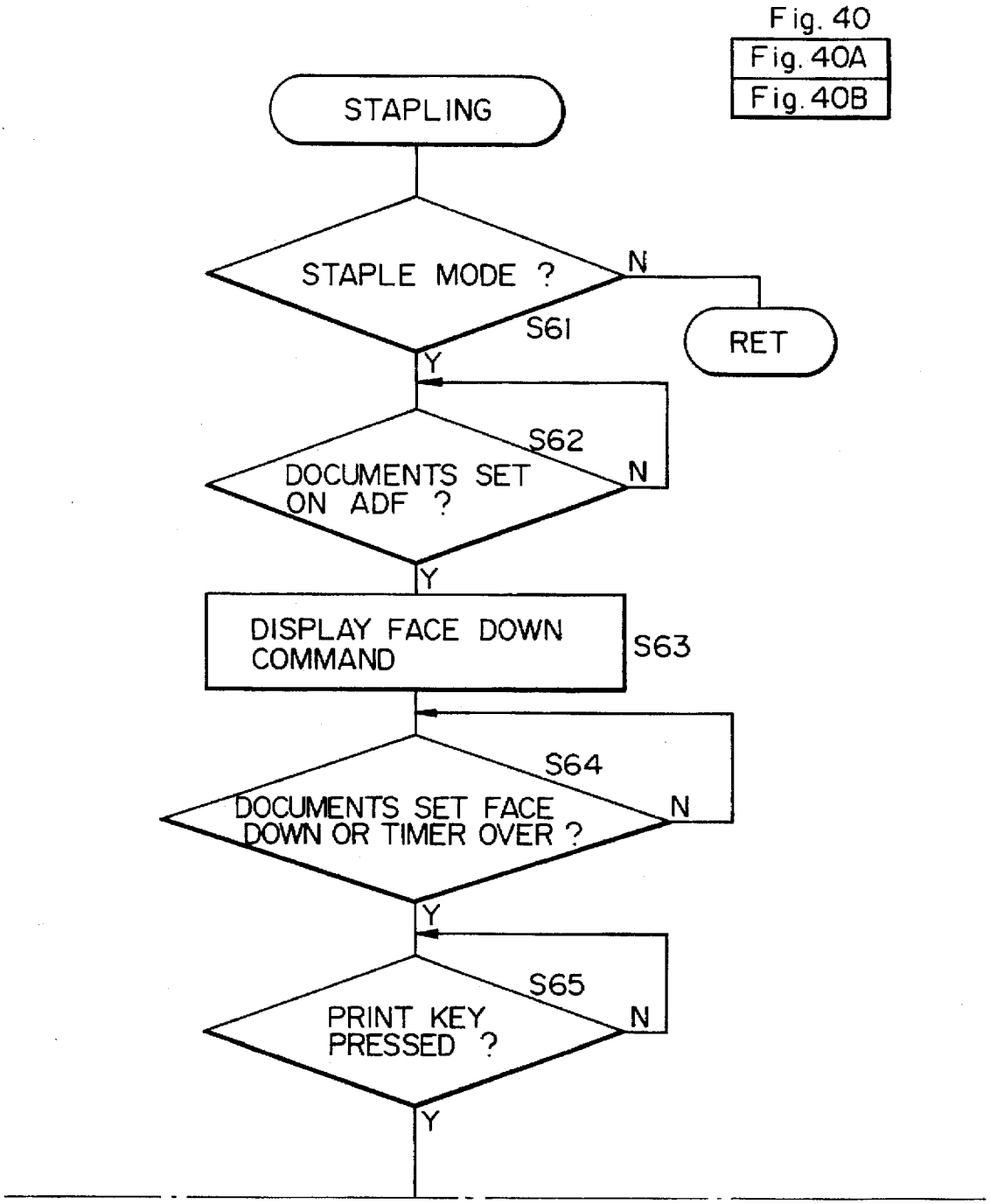
FIG. 40 is a flowchart demonstrating operation control after a change.
Figure 40B:
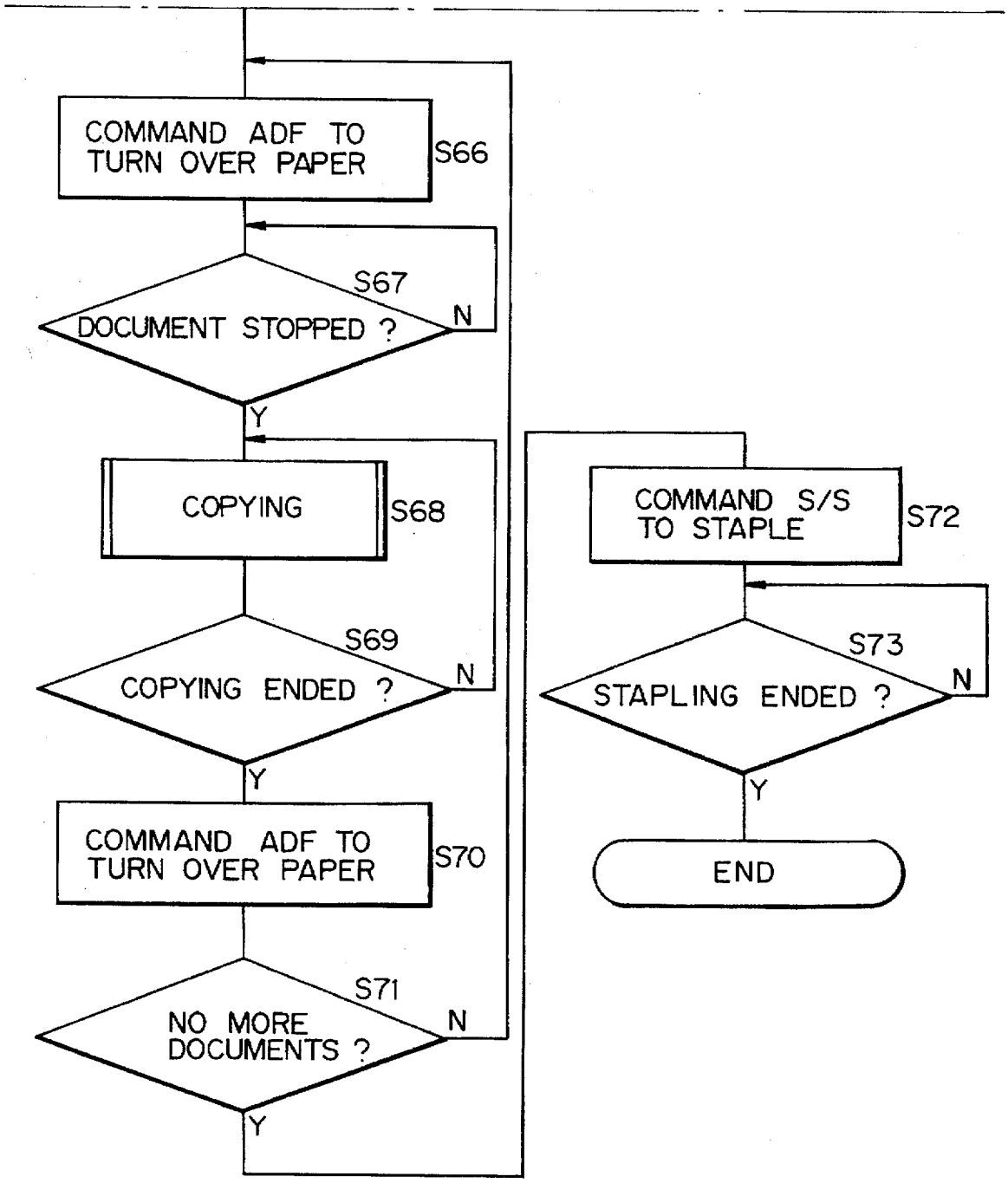
Figure 41:
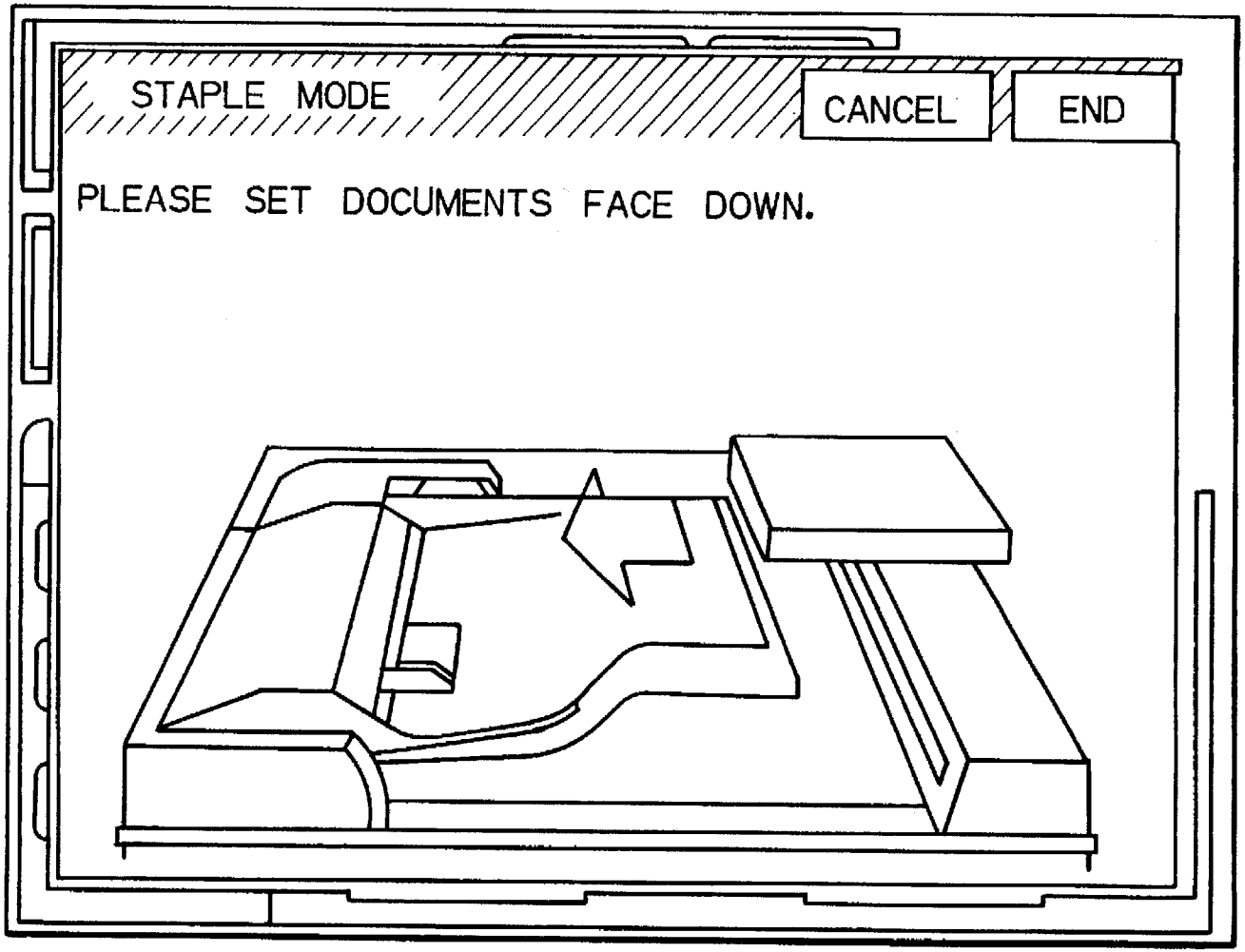
FIG. 41 shows a specific picture to appear on the display.

FIG. 40 demonstrates a procedure to occur after the change of the operation program. As shown, when the user touches the staple key in the picture, a staple mode operation begins (step S61). After documents have been set on the ADF 302 (step S62), a picture shown in FIG. 41 appears to urge the user to set the documents face down, i.e., in a position opposite to the usual position. When the user sets them face down or when a predetermined period of time expires (5 seconds to 10 seconds) (steps S63 and S64), the usual picture appears in place of the picture of FIG. 41 and awaits another key input (not shown in FIG. 40).

Figure 42A:
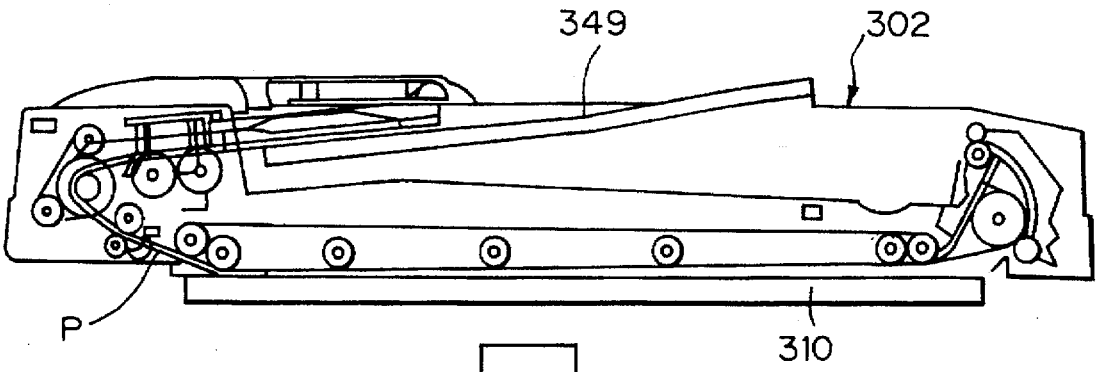
FIGS. 42A–42C are representative of the turn-over of a document.
Figure 42B:
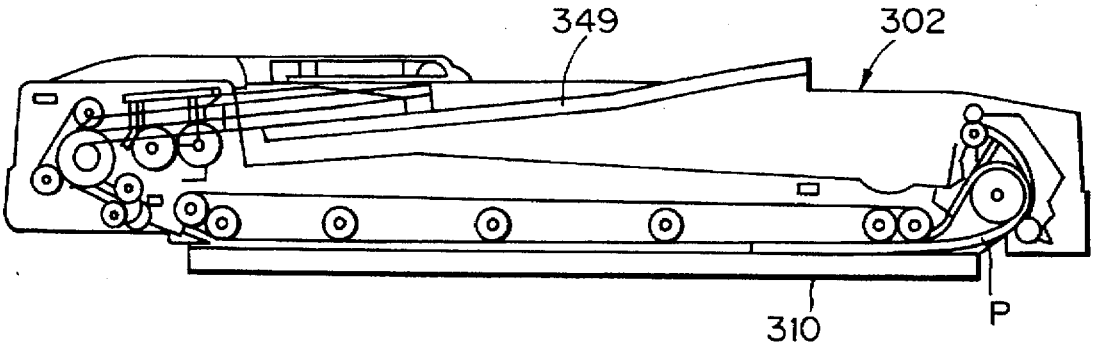
Figure 42C:
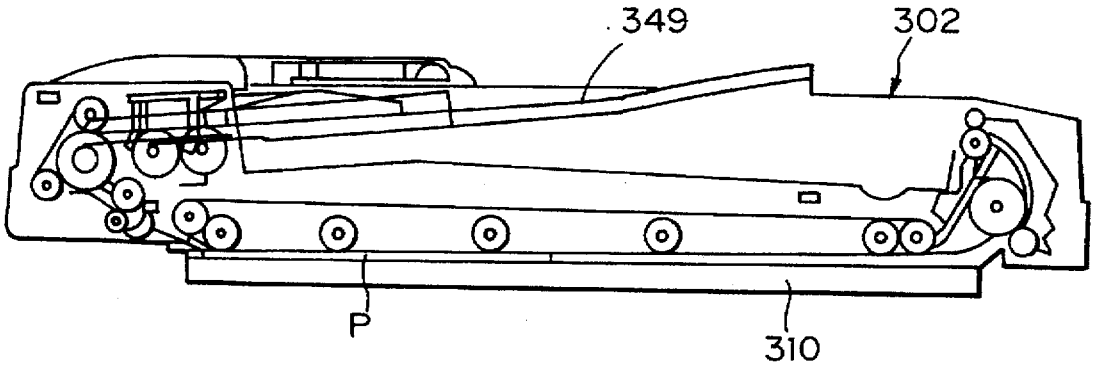

After the user has set the mode and then pressed a print key (step S65), the copier body 301 sends a turn-over document feed command to the ADF 302 (step S66). In response, the ADF 302 separates the lowermost document P (FIG. 42A), conveys it, turns it over by the turn-over path (FIG. 42B), and then stops it on the glass platen 310 (FIG. 42C). This is because the documents P are set on the ADF 302 face down. The first page of the documents P is fed first. When the document is brought to a stop on the glass platen 310 (step S67), the copier body 301 copies it in the previously stated manner (step S68). If the resulting copy is driven out of the copier body 301 in the usual position, it will be delivered to the S/S 800 face up. Hence, the copier body 301 turns over the copy by use of the duplex copy path available therein, returns it to the paper feed path, and then drives it out to the S/S 800 without executing the copying cycle. Subsequently (Y, step S69), the copier body 301 sends a turn-over discharge command (step S70) to the ADF 302. In response, the ADF 302 turns over the document, i.e., positions it face down and then conveys it to the table 353. These steps S66–S70 are repeated until all the documents on the tray 349 have been fed out. When all the documents are fully copied (Y, step S71), the copier body 301 sends a staple command to the S/S 800 (S72) and causes it to perform stapling (staple S73).

By the above procedure, a staple is driven into a stack of copies in the normal direction (from the image side). This procedure is also applicable to other postprocessing units (punching, stamping and folding machines) which would suffer from the same problem as discussed in relation to the S/S 800.

Figure 43:
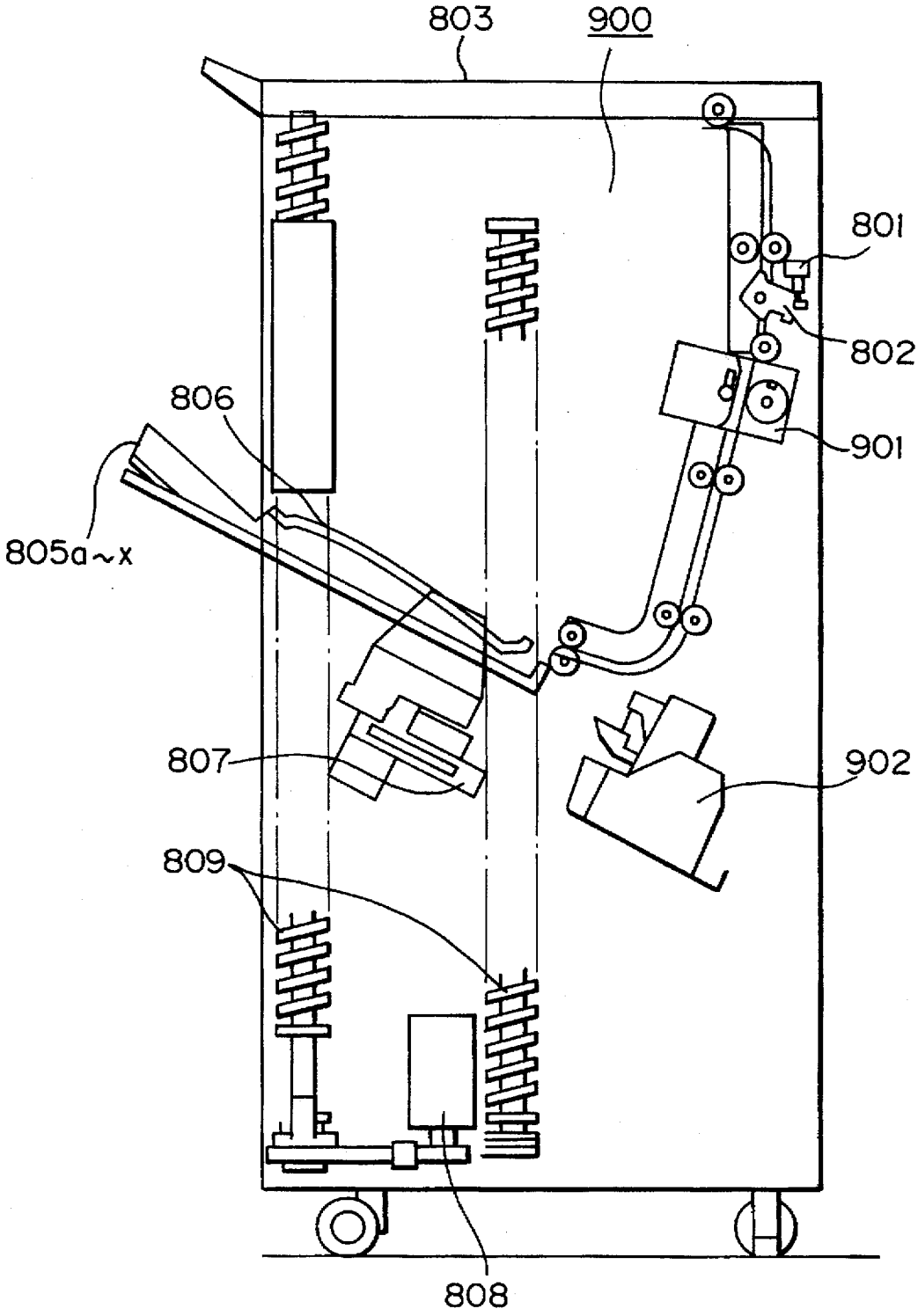
FIG. 43 shows the construction of a multifunction sorter/stapler.
Figure 44:
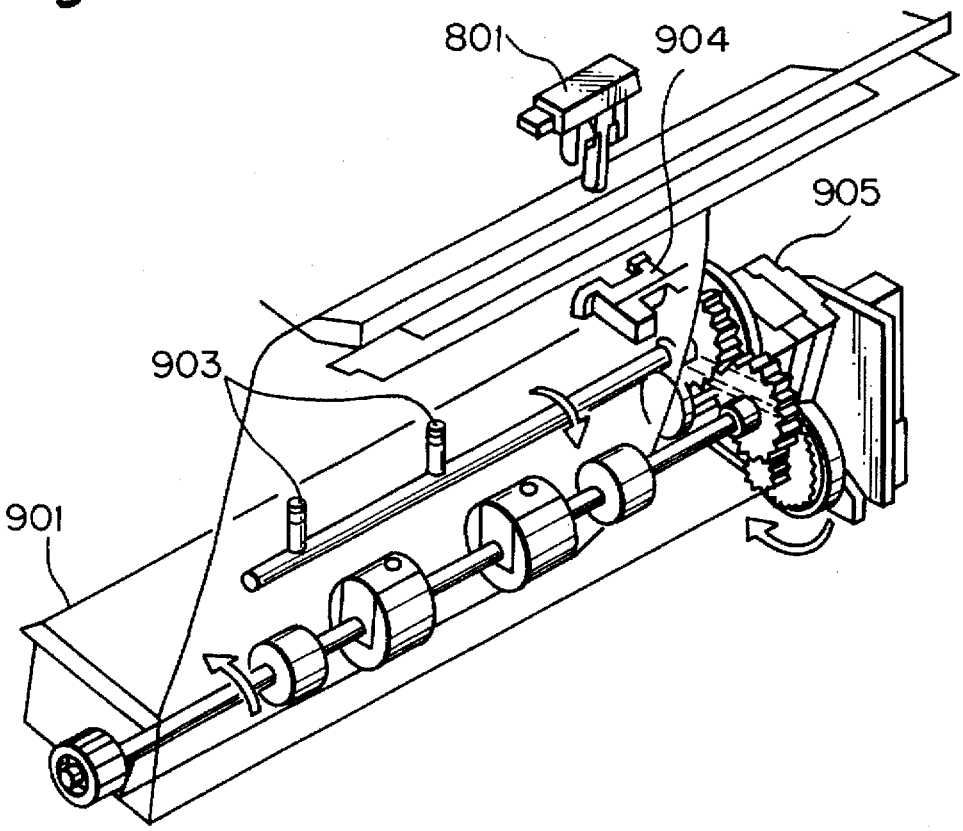
FIG. 44 is a perspective view of a puncher unit.

FIGS. 43 and 44 show a multifunction S/S 900 and a puncher unit 901, respectively. The same or similar parts of the S/S 900 and puncher unit 901 as or to the parts of the S/S 800 will not be described in order to avoid redundancy. There are shown in the figures the puncher unit 901, a stapler unit 902 constructed to drive a staple downward and capable of driving it aslant, a punch motor 905, two punches 903, a punch home position sensor 904. When the inlet sensor 801 senses the trailing edge of a paper, a CPU 911 included in the S/S 900, as will be described, starts a timer. As a result, the punch motor 905 is driven at a predetermined timing to punch a stack of papers.

Figure 45:
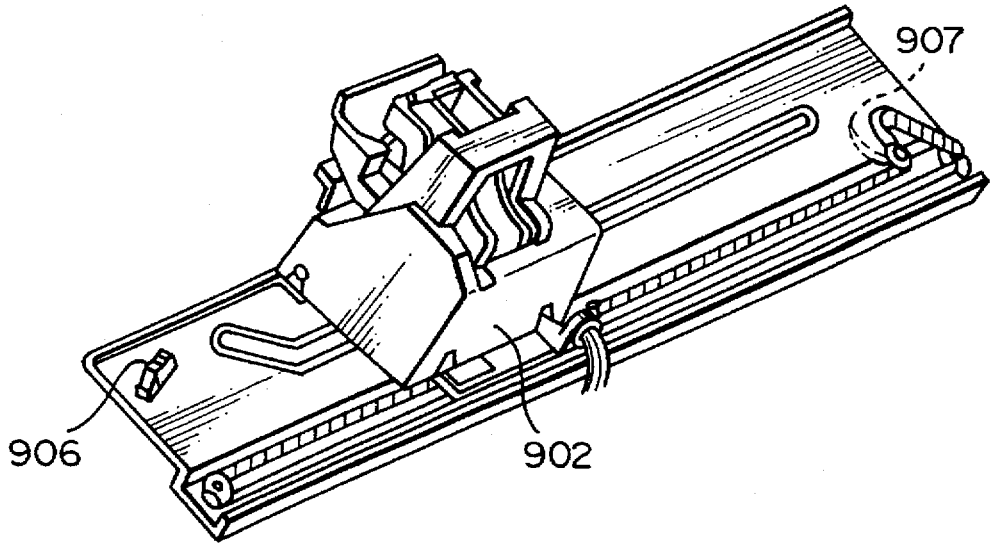
FIG. 45 is a perspective view showing a mechanism for moving a stapler unit.

FIG. 45 shows a mechanism for moving the stapler unit 902. As shown, the stapler unit 902 is movable by being driven by a stapler motor 907. The unit 902 is capable of stapling papers in any one of four different patterns, i.e., a single top slant pattern, a single top parallel pattern, a single bottom pattern, and a double parallel pattern. For slant stapling, the stapler unit 902 is brought to a stop at a staple slant sensor 906 and then operated.

Figure 46:
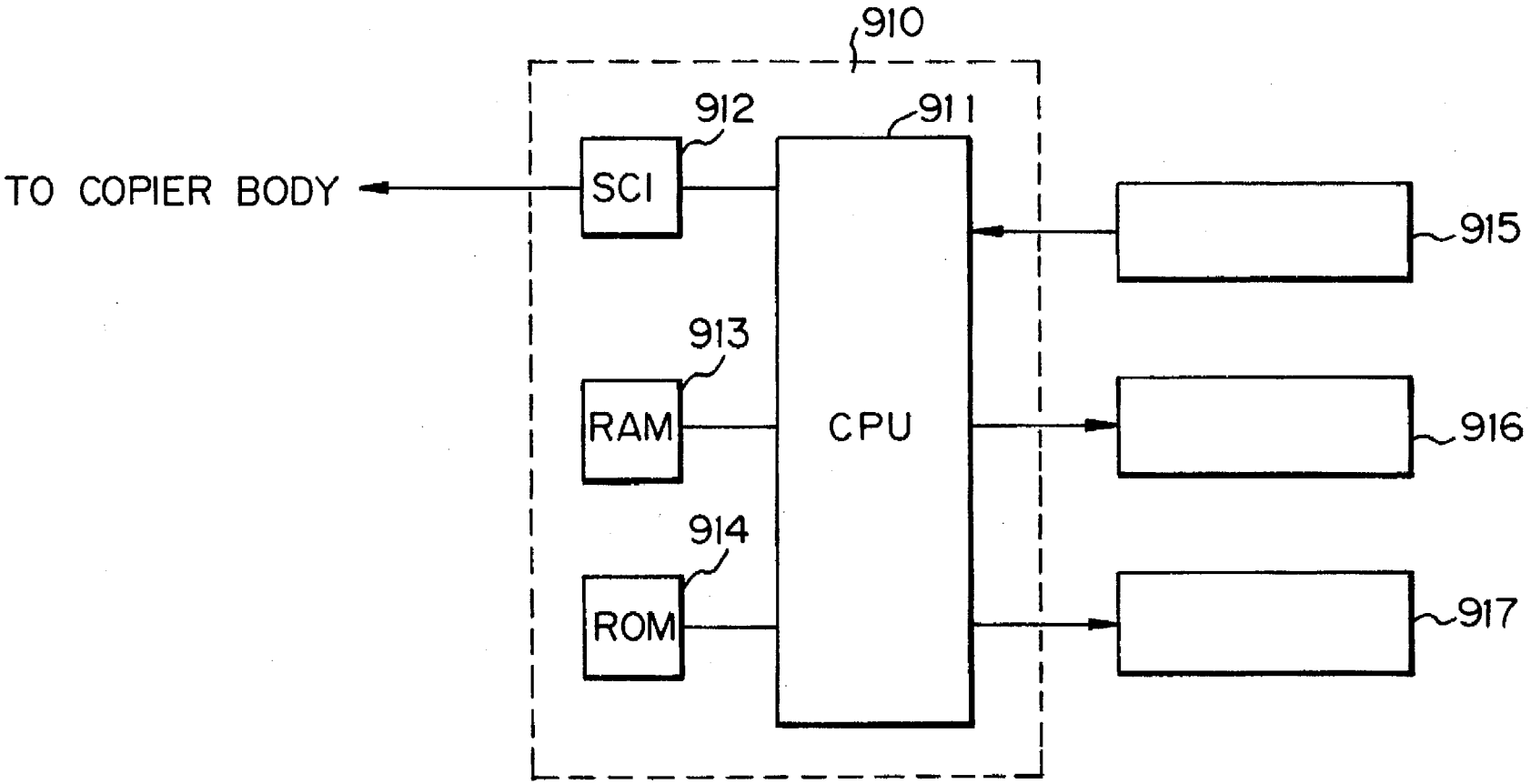
FIG. 46 is a schematic block diagram of the sorter/stapler.

FIG. 46 shows the construction of the SIS 900. As shown, the SIS 900 has a control board, a CPU 911, an SCI 912, a RAM 913, and a ROM 914. The internal arrangement of the SIS 900 will not be described specifically because it is identical with the arrangement of SIS 800. There are also shown in FIG. 46 sensors 915, motors 916 including a roller drive motor, stapler drive motor, bin lift motor, stapler motor 907, and punch motor 905, and solenoids 917.

When the S/S 900 is newly connected to the copier body 301, the programs of the copier body 301 are updated in the same manner as described in relation to the sorter 303. At the same time, the system function check routine shown in FIG. 30 is executed. As a result, a sort mode, stack mode, staple mode and punch mode are additionally available as new functions. In this case, the picture shown in FIG. 31 is replaced with a picture shown in FIG. 47 which includes a punch key 6060, a staple key 6050, a stack key 6010, and a sort key 6020. Further, because the S/S 900 has the multifunction stapler unit 902, a picture shown in FIG. 48 appears when the user touches the staple key 6050. The picture allows the user to select one of the four different stapling patterns and displays guidance relating to the stapling positions.

Figure 47:
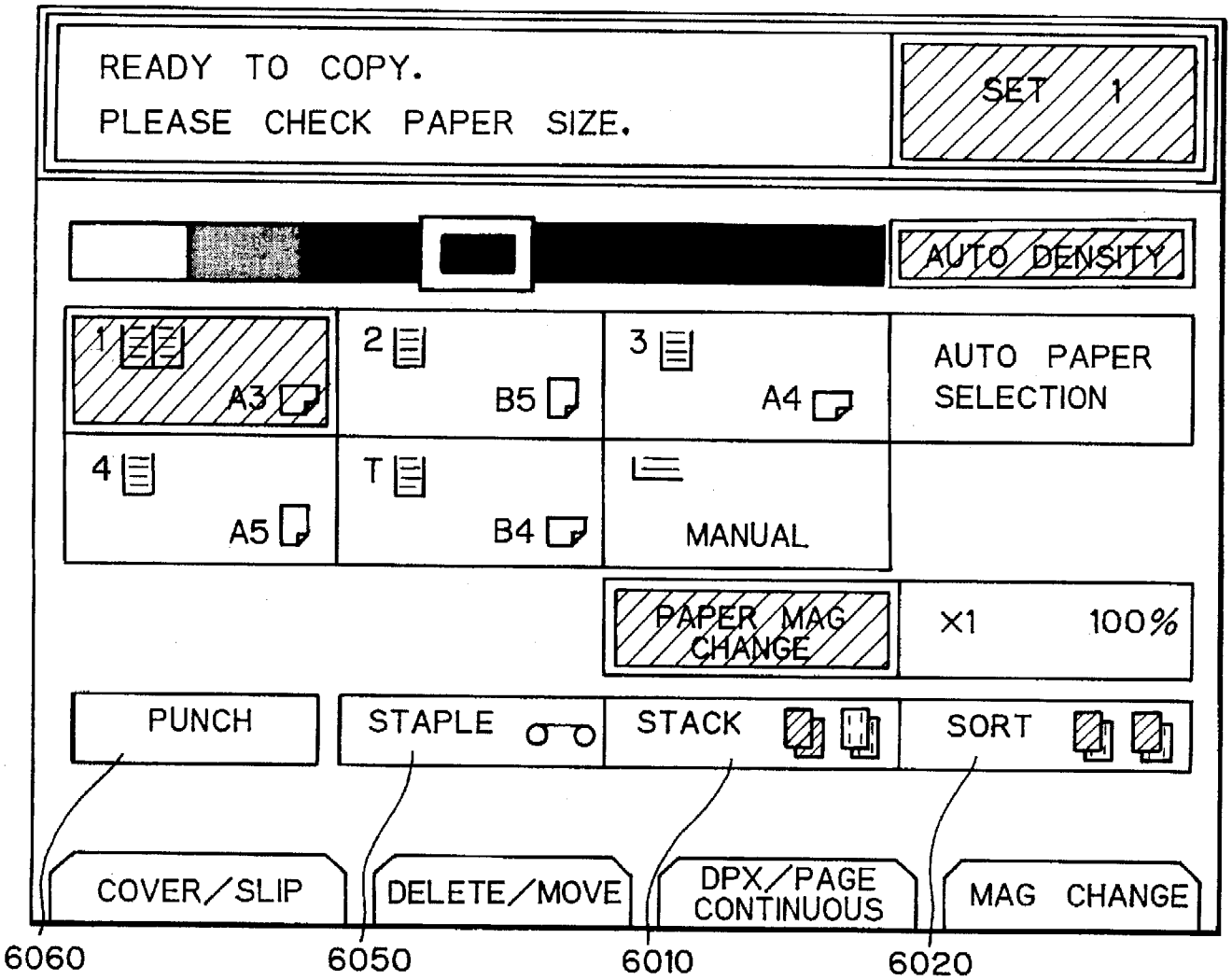
FIG. 47 shows a specific picture to appear on the display.
Figure 48:
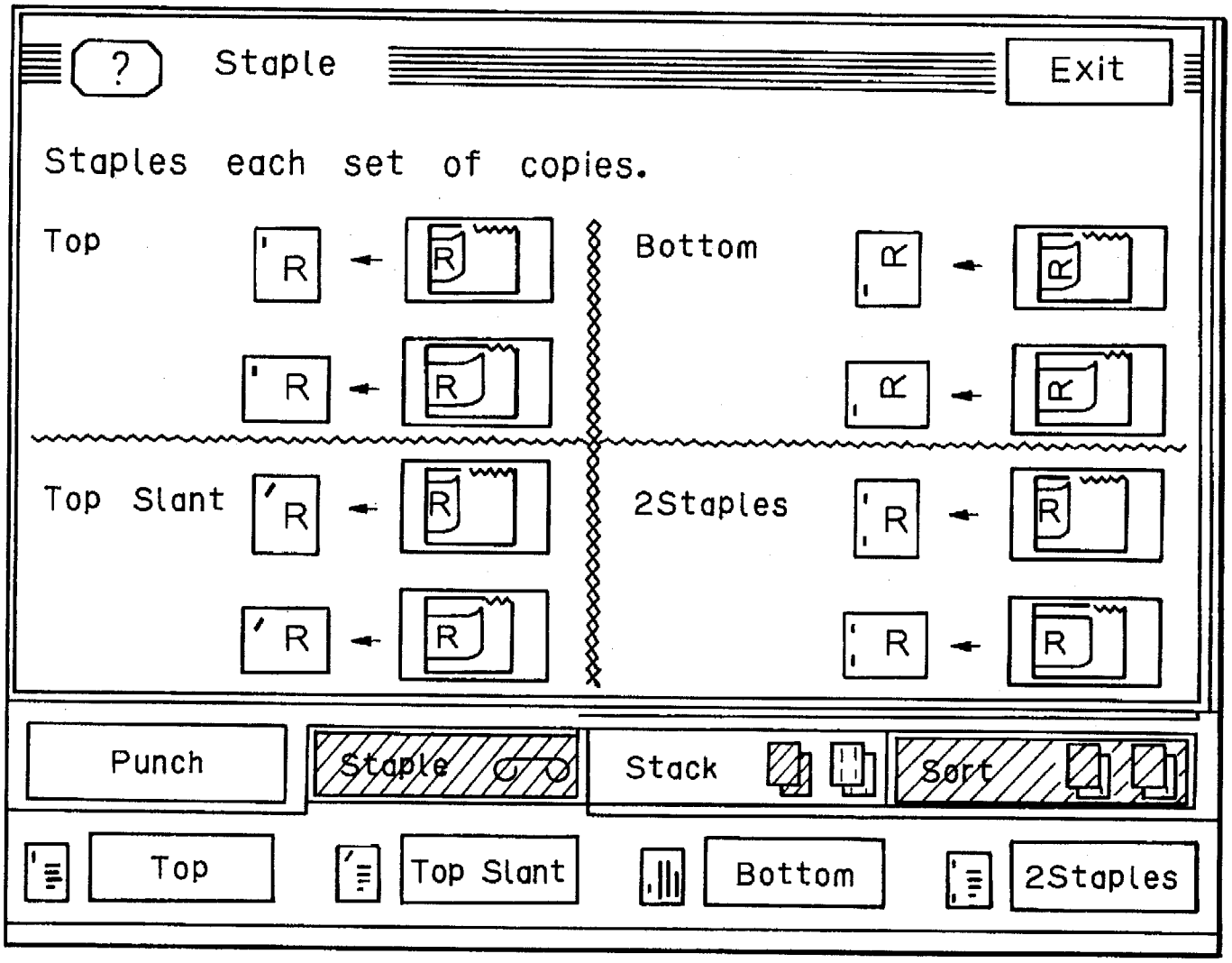
FIG. 48 shows a picture associated with the stapler unit.
Figure 49:
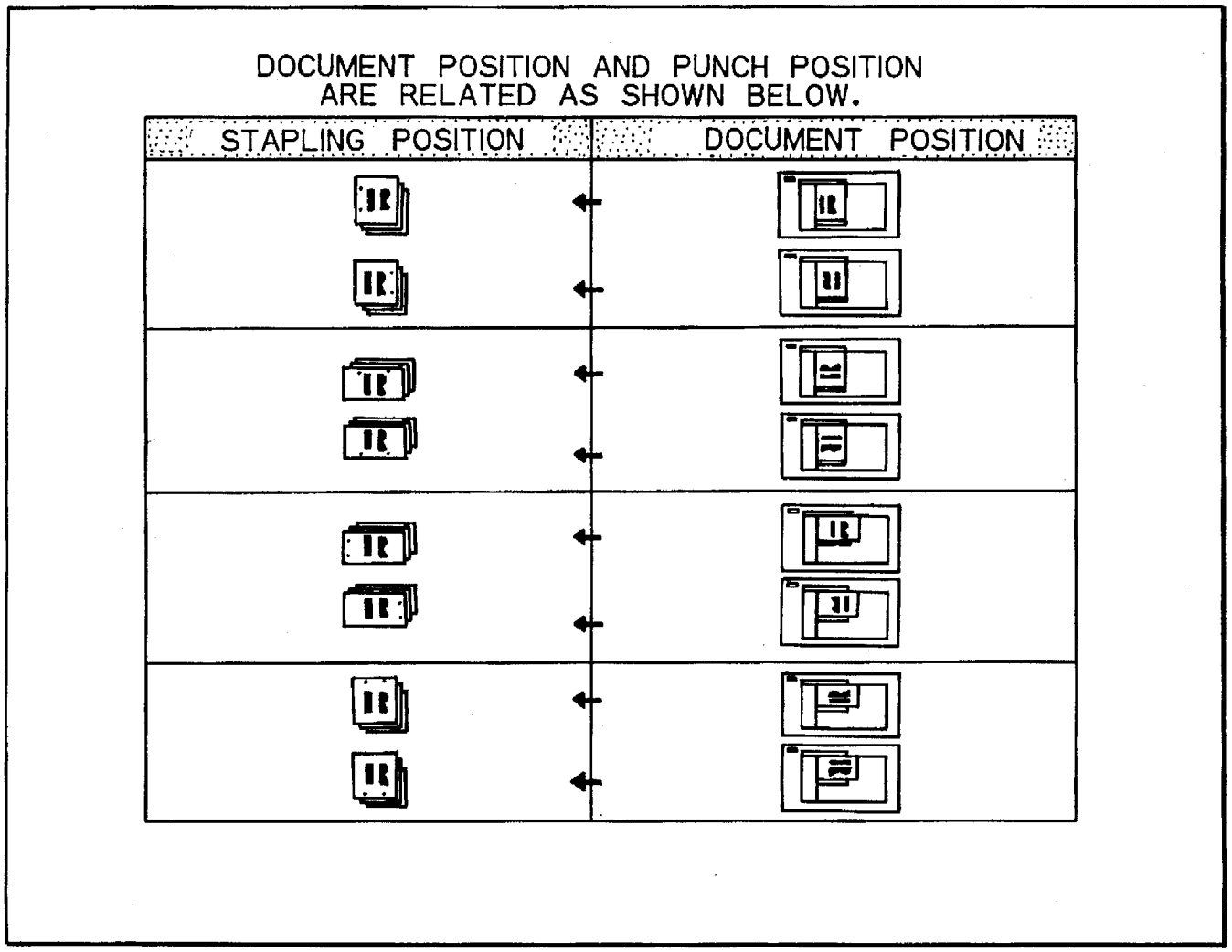
FIG. 49 shows a picture for showing the operator how documents should be set and the positions of holes.

When the user selects the punch mode in the picture of FIG. 47, a picture shown in FIG. 49 appears to show the user particular document orientations and guidance relating to the punching positions. This successfully reduces erroneous operations.

Figure 50:
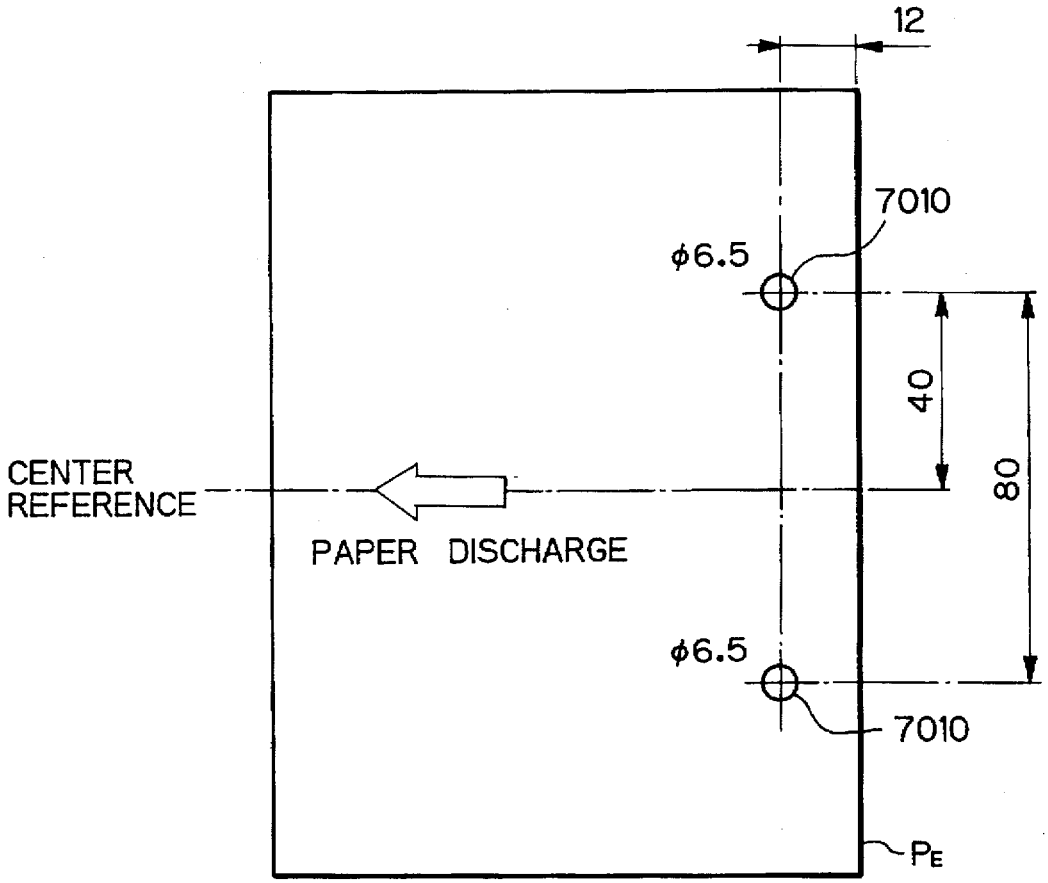
FIG. 50 shows a standard punching position available with the sorter/stapler.
Figure 51:
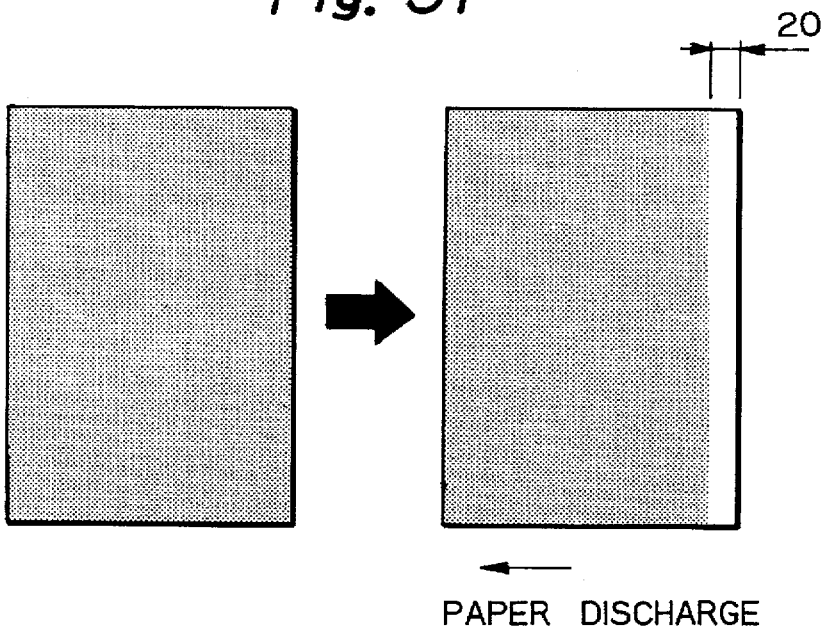
FIG. 51 shows how image data are shifted before output on a paper.

During the communication associated with the S/S 900, data representative of the punching positions and punching diameters are also dealt with (this is also true with the stapler unit 902). FIG. 50 shows standard punching positions available with the S/S 900. As shown, two holes 7010 each having a diameter of 6.5 mm are formed at a position 12 mm remote from the trailing edge $P_E$ of a paper. If an image is present at the punching positions 7010, it will be partly lost. Moreover, when a stack of papers are bound by use of the holes 7010, their images will be hard to see. In light of this, as shown in FIG. 51, when an image is present in the 20 mm zone as measured from the trailing edge PE (as indicated by mesh), the image processing board 319 shifts the image data until the image has been brought to the outside of the 20 mm zone.

Figure 52:
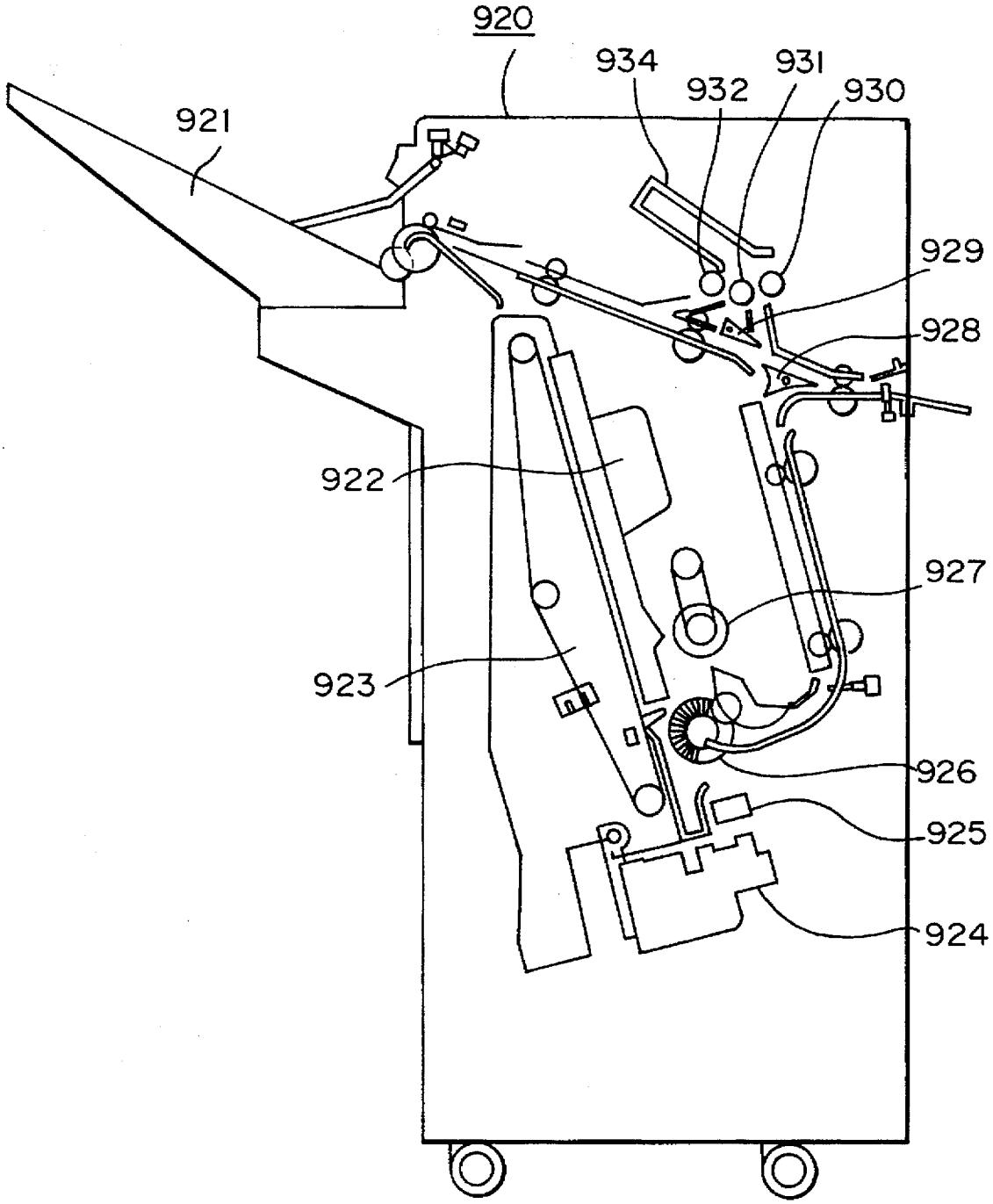
FIG. 52 shows the construction of a finisher which is a specific form of the postprocessing peripheral.

FIG. 52 shows a finisher 920 also belonging to a family of postprocessing peripherals. As shown, the finisher 920 has a tray 921 for stacking papers, an intermediate tray 922 for papers to be stapled or stampled, a return roller for positioning papers, a brush roller 926, a stapler unit 924, a stamper unit 925 for stamping papers on existing on the tray 922, a belt 923 for conveying papers from the tray 922 to the tray 921, a path selector 928 for switching over the paths to the trays 922 and 921, fold rollers 930, 931 and 932 for folding papers, a guide 934 for guiding papers to be folded, and a path selector 929 for switching over the paths to the tray 921 and folding portion. The operation of the finisher 920 will not be described because it is the same as the operations of a conventional finisher and paper folding machine.

Figure 53:
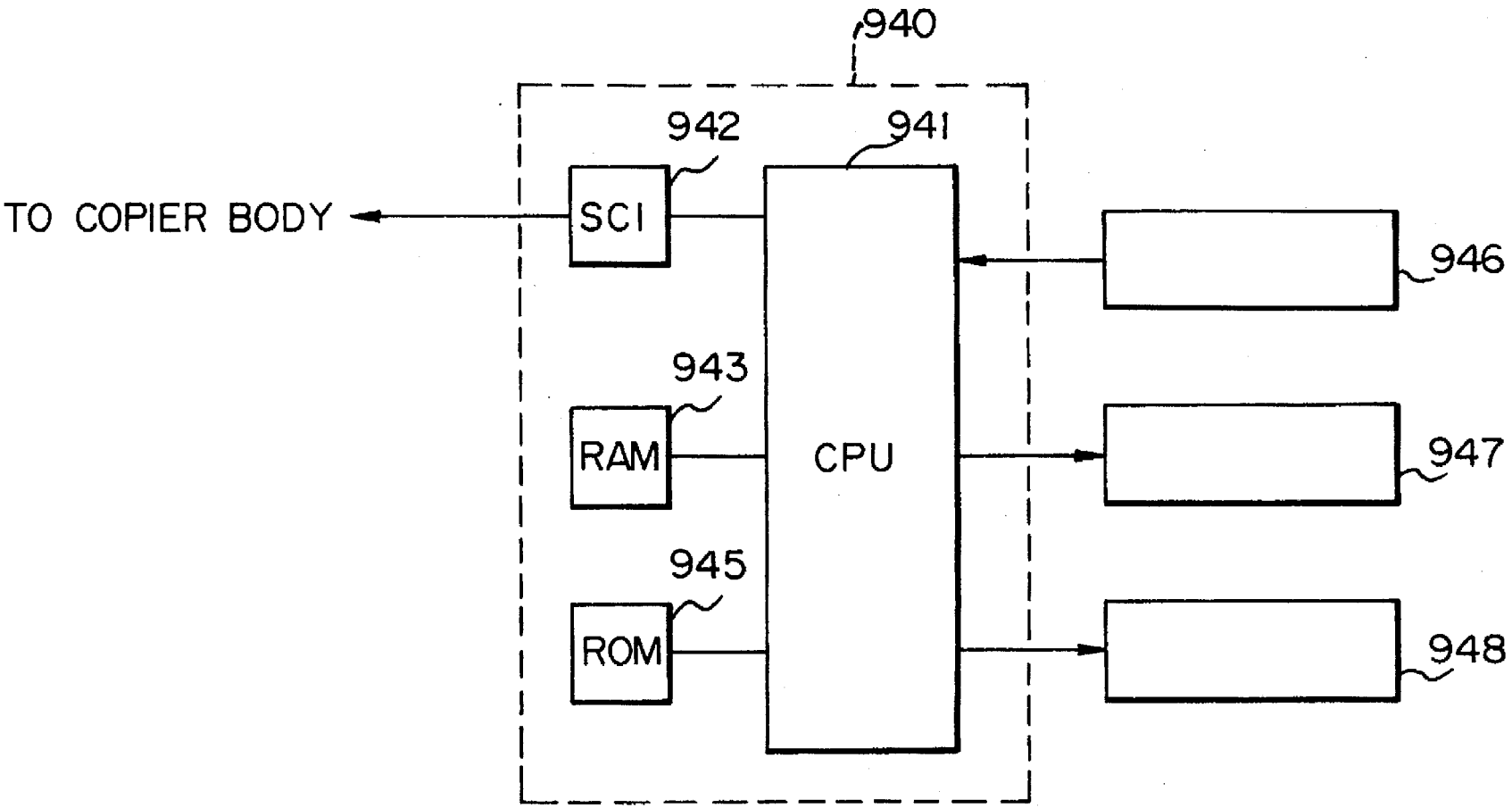
FIG. 53 is a schematic block diagram of the finisher.
Figure 54:
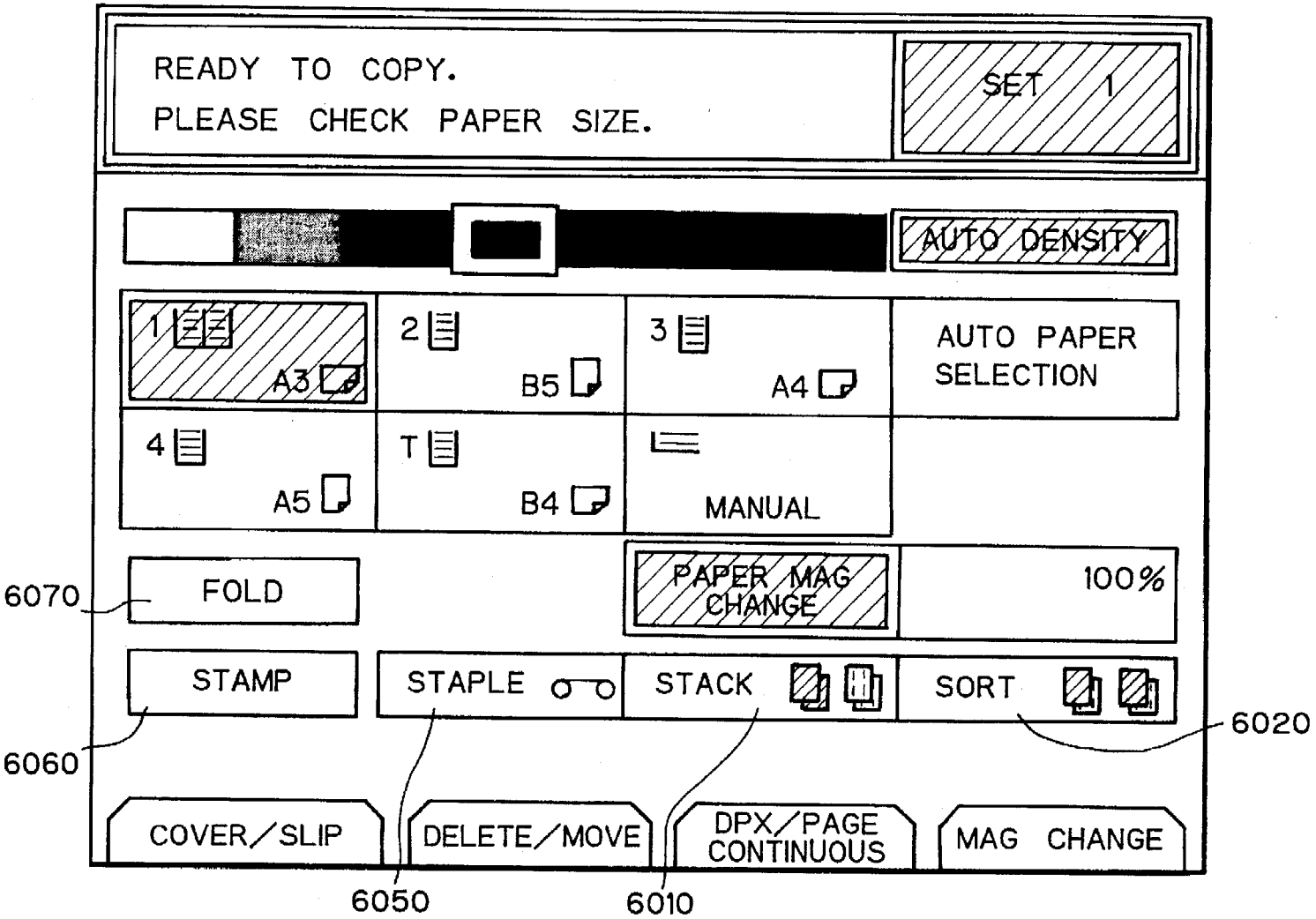
FIG. 54 shows a specific picture to appear on the display.

FIG. 53 shows the construction of the finisher 920. As shown, the finisher 920 has a control board 940, a CPU 941, an SCI 942, a RAM 943, and a ROM 945. The internal arrangement of the FIN 920 is identical with that of the S/S 800 and will not be described specifically. There are also shown in the figure sensors 946, and motors 947 including a drive motor for driving various rollers, a stapler drive motor and a fold roll drive motor, and solenoids 948. When the finisher 920 is newly connected to the copier 301, a stamping function, stapling function, a stacking function and a sorting function are added in the same manner as when the S/S 900 is added. As a result, the picture of FIG. 31 is replaced with a picture shown in FIG. 54 and including a fold key 6070.

Figure 55:
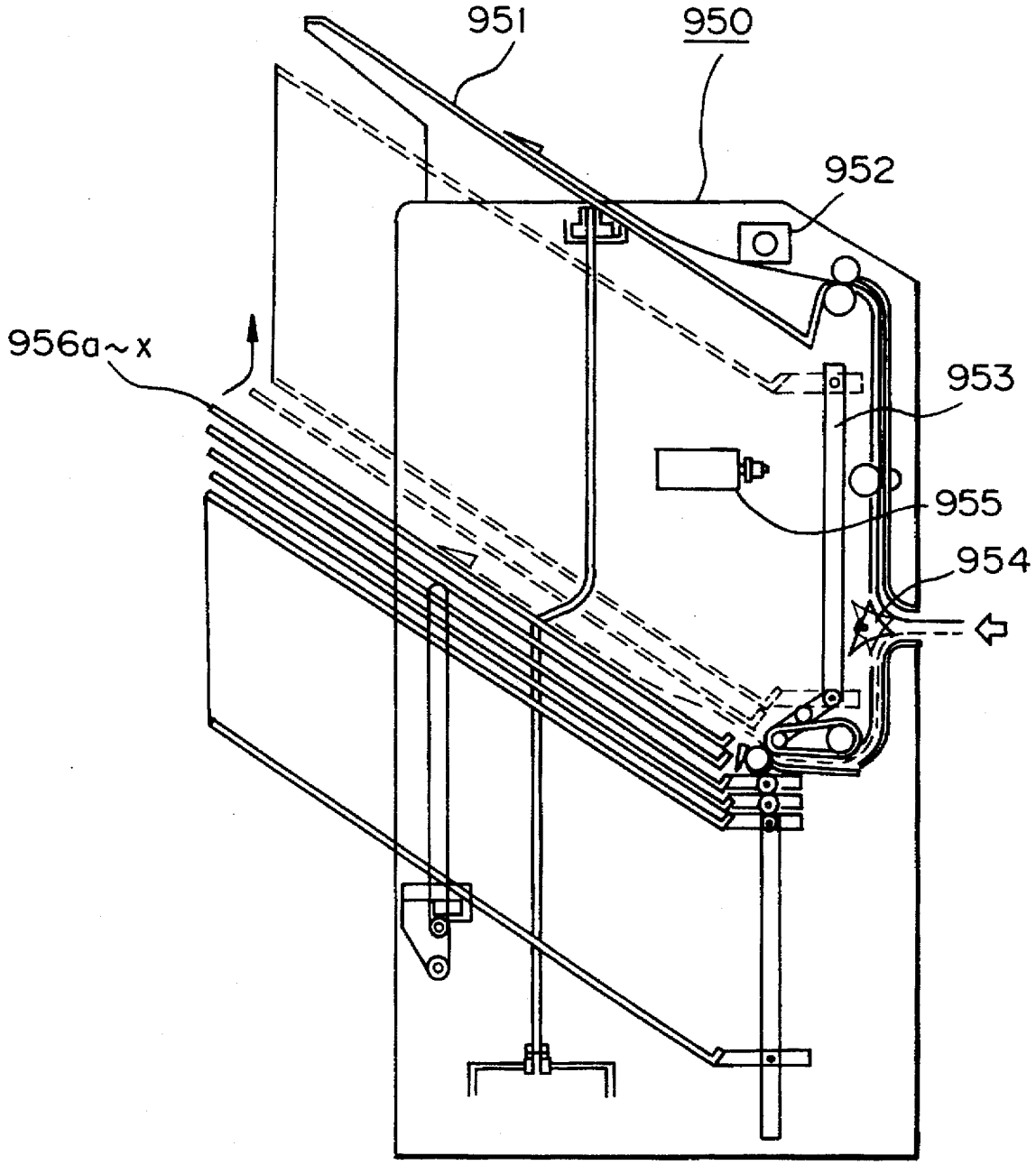

FIG. 55 shows the construction of a sorter 950 for use with a low-speed copier. As shown, the sorter 950 has a proof tray 951, a motor 952 for driving various conveyor rollers, a bin lift motor 955 for moving bins 956*a*–956*x* up and down, a channel 953 for guiding the bins 956*a*–956*x*, and a path selector 954 for selecting one of the path terminating at the proof tray 951 and the path terminating at the bins 956*a*–956*x*. The sorter 950 has the same electrical arrangement as the sorter 303 shown in FIG. 27.

The sorter 950 designed for a low-speed copier does not match the copier body 301 in paper conveying speed or processing speed (copies per minute or CPM). Hence, if the copier body 301 operates at the usual copying speed, papers will jam at the inlet of the sorter 950. Specifically, the sorter conveys papers at a speed of 240 mm/sec while the copier body 301 usually conveys papers at a speed of 300 mm/sec. In light of this, after the sorter 950 has been connected to the copier body 301, the former sends its standard linear velocity data to the latter as part of the updating programs. In the system function check routine of FIG. 30, the copier body 301 changes the program and parameters in order to match the linear speeds.

Figure 56:
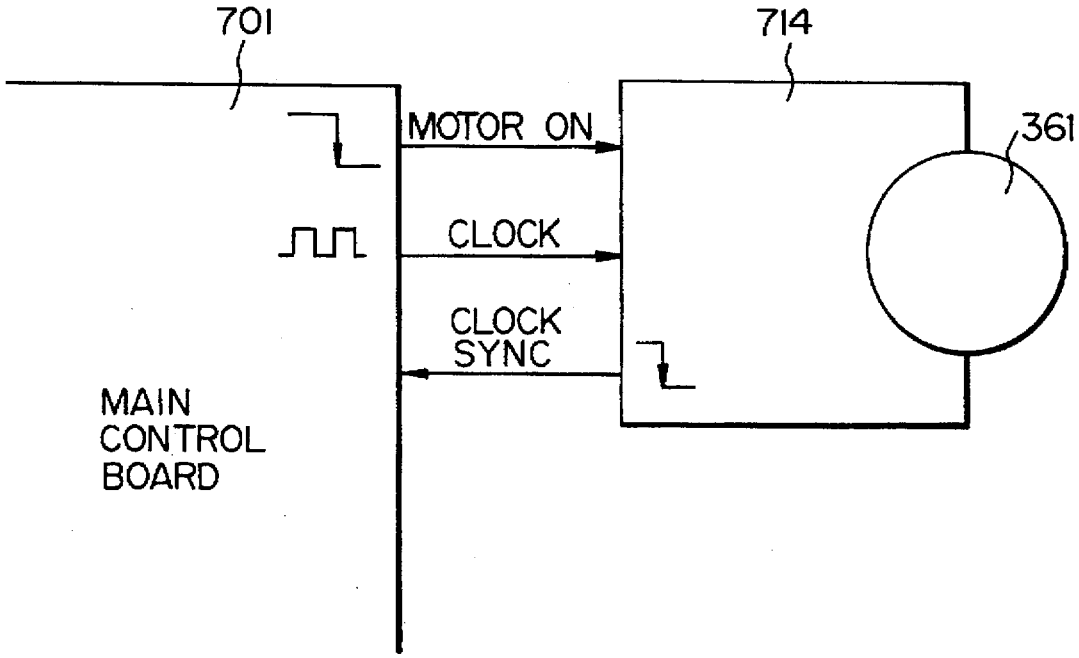
FIG. 56 is a schematic block diagram of a sorter.
Figure 57:
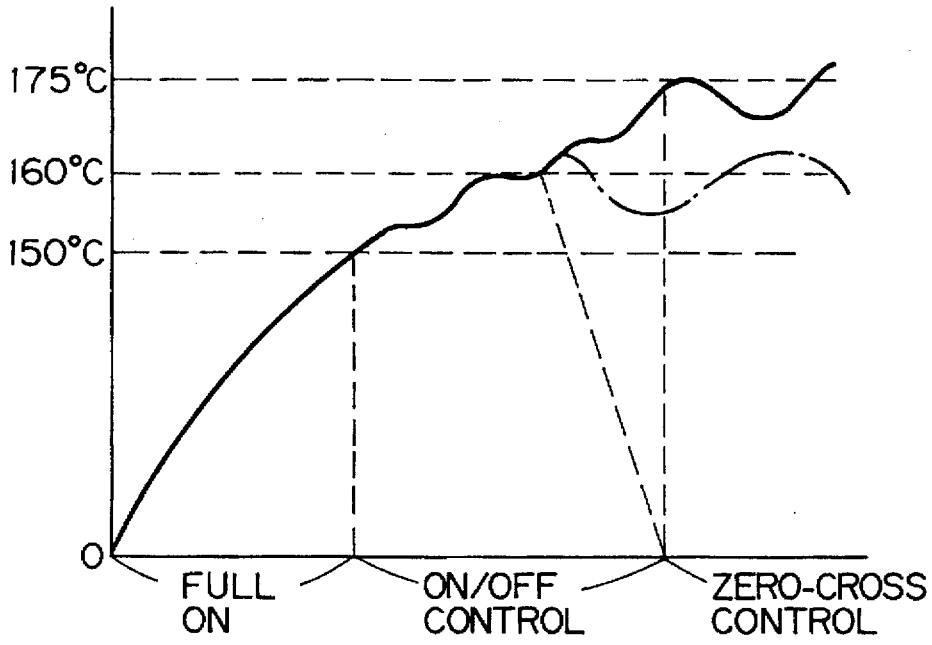
FIG. 57 shows a procedure for changing the temperature of a heat roller.

Paper transport in the copier body 301 is effected by the main motor 361 (DC brushless servo motor). As shown in FIG. 56, the main control board 701 is connected to the main motor drive board 714 by a motor ON line, a clock line, and a clock synchronizing line. The main motor 361 is driven under PLL (Phase Locked Loop) control. For the PLL control, a clock is fed from the main control board 701 over the clock line. The clock frequency is controlled by the CPU 601, FIG. 2. The rotation speed of the main motor 361 is proportional to the clock frequency. When the standard speed of the copier body 301 is 300 mm/sec, the rotation speed of the main motor 361 and the PLL clock frequency are 100 rpm and 2 kHz, respectively. To match this to the linear speed of 240 mm/sec of the sorter 950, the PLL clock frequency is changed to 1.6 kHz. At the same time, the paper feed start timing and other parameters are changed in order to reduce CPM. However, the standard fixing temperature (175° C.) is excessively high for the lowered linear velocity, increasing the curl of papers. Another problem is that because the path from the inlet of the sorter 950 to each bin is short, papers are sequentially stacked before the fixed toner has cooled off. As a result, the toner is transferred from the front of the underlying paper to the rear of the overlying paper. To eliminate these problems, as shown in FIG. 57, the standard temperature of the heat roller is lowered from 175° C. to 160° C.

Assume that the S/S 900, finisher 920 or similar postprocessing peripheral of the type discharging copies face up (last page first) is connected to the copier body 301. Then, when the first page to the last page are output in this order in the facsimile mode or printer mode, outputting them directly would reverse the order of pages. A method of obviating this problem will be described hereinafter, taking the facsimile mode as an example.

When the programs are updated due to the addition of the S/S 900, finisher 920 or similar peripheral to the copier body 301, the peripheral function data include face up/down receipt data. Hence, after the programs of the CPUs 601 and 602 of the main control board 701 and the programs of the operation and display panel 625 have been updated, the CPU 602 updates the programs stored in the RAM 2019 for controlling the application circuit 624. Then, in the event of facsimile receipt, the copier body 301 determines, based on a non-standard function set signal (NSS) or a digital send command signal (DCS) from the transmitting station, whether or not the station is of the type sending the first page first. If the transmitting station is of this type or of the type whose transmission order is not known, the copier body 301 executes the usual receipt and image formation. When the transmitting station is of the type sending the first page first, the copier body 301 sends, after the receipt of the first page of image data, a procedure interrupt positive signal (PIP) to the transmitting station if the next page exists. In response, the transmitting station interrupts the transmission. In this condition, the image data written to the SAF 2033 are output on a paper by the usual procedure. Then, the paper is turned over by the duplex copy path of the copier body 301, then returned to the paper feed path, and then driven out to the peripheral without the copying cycle effected. Subsequently, the FAX application unit 2003 sends a digital identification signal (DIS) or a non-standard function identification signal (NSF) to the transmitting station and then awaits the next page of image data. This is repeated up to the last page. As a result, papers are stacked on the tray of the peripheral face down and, therefore, in the correct order.

The above approach, however, lowers productivity because it turns over and discharge papers one by one. In light of this, if the FAX application unit 2003 has a sufficient memory capacity, updating programs different from the previously mentioned programs are written to the RAM 2019 of the application circuit 624. At the same time, the programs of the CPU 601 are updated. In this condition, all the pages of image data are sequentially written to the memory without the receipt being interrupted. Subsequently, if the transmitting station is of the type sending the first page first (determined at the beginning of receipt), the last page of image data received is output on a paper first. If whether or not the transmitting station is of the type sending the first page first is not known, the image data of the page written to the memory first are output first. In any case, papers are driven out to the peripheral without being turned over. Consequently, the papers are stacked on the peripheral in the correct order.

Assume that the ADF, or preprocessing peripheral, 302 and the sorter, or postprocessing peripheral, 303 are connected to the copier body 301. Then, the updating programs for version adjustment and for implementing an optimal image forming system may be supplied from the external managing unit 2203, as follows.

Figure 58:
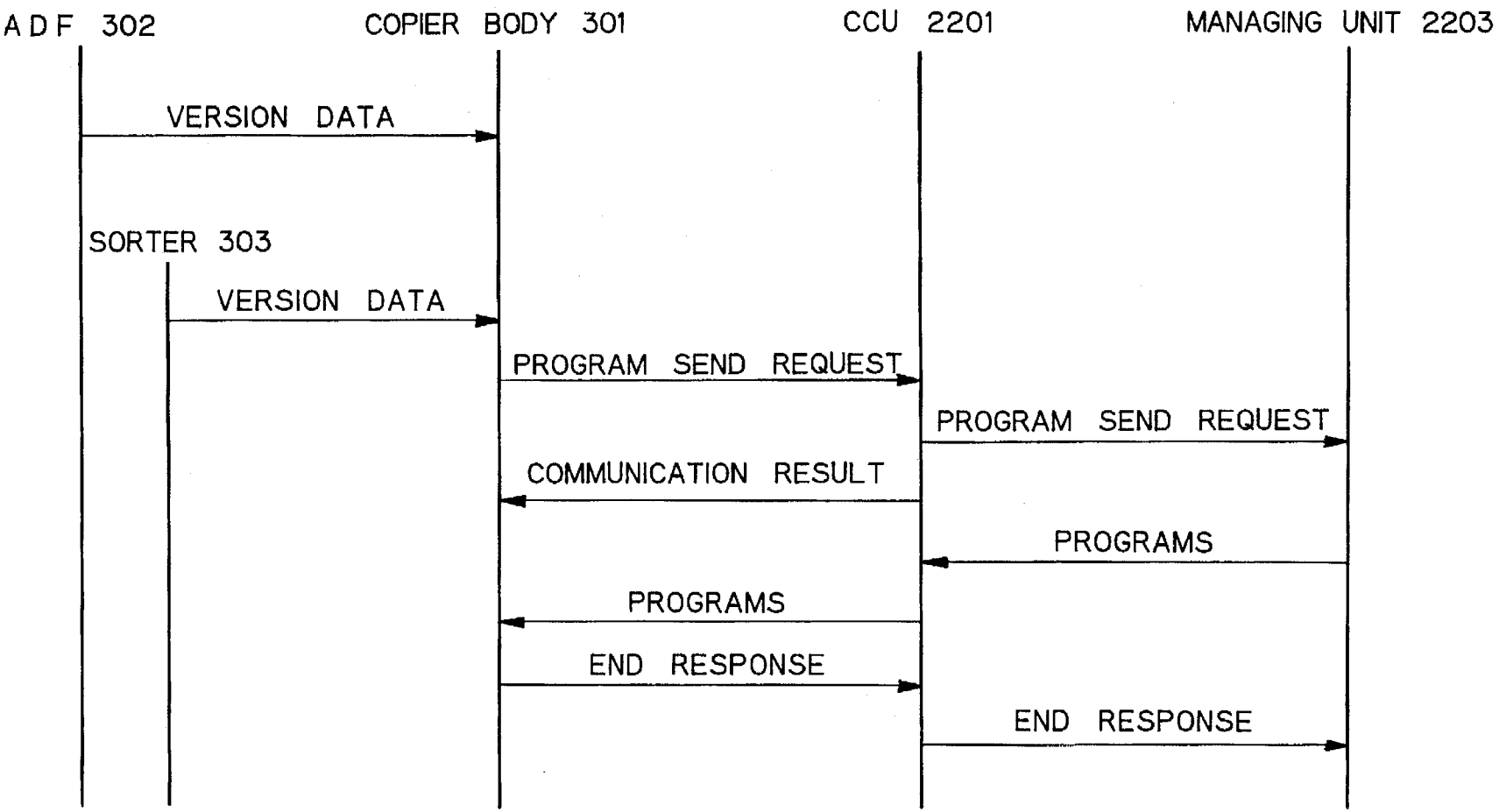
FIG. 58 is chart demonstrating a procedure for supplying updating programs from the external managing unit.

As shown in FIG. 58, after the ADF 302 and sorter 303 have been newly connected to the copier body 301, the ADF 302 and sorter 303 and the copier body 301 check their connection at the time of, for example, power up. At this instant, version data (e.g. ID code) particular to the ADF 302 and sorter 303 are sent to the copier body 301. The copier body 301 compares the ID codes with its own program version. If the copier body 301 determines, as a result of the comparison, that it cannot deal with the additional functions sufficiently, it sends the ID codes of the additional preprocessing and postprocessing peripherals and an updating program send request to the CCU 2201 via the USARP 633 and PI unit **626*a*. At the same time, the copier body 301 sends its own ID code to the CCU 2201**.

In response, the CCU 2201 dials the telephone number assigned to the managing unit 2203 and stored in the RAM 2305 beforehand, and then sends the above data to the unit 2203. The managing unit 2203 is usually located at a base station and capable of interchanging data with a plurality of CCUs 2201 over the subscriber lines. After sending all the data to the managing unit 2203, the CCU 2201 returns the result of communication thereof with the managing unit 2203 to the copier body 301. This shows the copier body 301 whether or not the communication ended normally or failed due to some error. On receiving the updating program send request via the CCU 2201, for adequate 203 searches for adequate programs for version adjustment and for implementing an optimal image forming system stored in the data base of the memory device 2402 by use of the ID codes of the additional functions and the ID code of the copier body 301. Then, the managing unit 2203 dials the CCU 2201 and then sends the programs thereto. In response, the CCU 2201 transfers such data to the copier body 301.

The copier body 301, received the updating programs via the CCU 2201, writes them in the nonvolatile RAM 629 or 614. Thereafter, the copier body 301 controls the ADF 302 and sorter 303 on the basis of the updating programs. Among the updating programs, the program for the display and control of a mode setting picture is transferred to the operation and display unit 2006 and written to the nonvolatile RAM 2065. This allows the unit 2006 to display mode setting keys and alert indicators associated with the additional functions and to control the display.

After the copier body 301 has written all the programs in the RAM 629 or 614 and completed the associated processing, it sends an end response to the CCU 2201. The CCU 2201 transfers the end response to the managing unit 2203. This is the end of a single processing unit.

Hereinafter will be described a control method (based on the updating programs) coping with the combination of the order in which documents are fed and the order in which papers are discharged from the sorter 303, as an example of optimal image forming systems including the ADF 302 and sorter 303.

To begin with, assume the digital copier shown in FIG. 1 and having the duplex copy unit 304. FIG. 59 shows the possible combinations of the order in which the ADF 302 feeds document and the order in which sorters discharges papers. When the ADF 302 and sorter 303 are connected to the copier body 301, the connection check routine is executed (FIG. 58). At this instant, the version data of the ADF 302 and those of the sorter 303 are sent to the copier body 301. Assume that the ADF 302 feeds the first page first while the sorter 303 discharges papers face up. The copier body 301 sends, by the previously stated procedure, an updating program send request associated with the ADF 302 and sorter 303 together with its own ID code (including data representative of the presence of the duplex copy unit 304).

The external managing unit 2203 receives the ID code of the ADF 302 (sending the first page first), the ID code of the sorter 303 (discharging papers face up), and the ID code of the copier body 301 (having the duplex copy unit 304) at the same time. In response, the managing unit 2203 selects out of its data base updating programs including a control command for causing the duplex copy unit 304 to turn over papers, and then sends them to the copier body 301 by the previously stated procedure. In this manner, when the versions as an image forming system are adjusted, the order of document pages and that of copies coincide with each other.

For the other combinations the document feed order of the ADF 302 and the paper discharge order of the sorter 303, the versions will be adjusted to cause the turn-over mechanism of the copier body 301 to operate as listed in FIG. 59. This also allows the order of document pages and the order of copy pages to coincide.

A digital copier lacking the duplex copy unit 304 and the sorter 303 incorporating a turn-over mechanism will be described. FIG. 60 shows the possible combinations of the document feed order of the ADF 302 and the paper discharge order of the sorter 303. When the ADF 302 and sorter 303 are connected to the copier body 301, the connection check routine is executed. At this instant, the version data of the ADF 302 and those of the sorter 303 are sent to the copier body 301. Assume that the ADF 302 feeds the first page first while the sorter 303 discharges papers face up. The copier body 301 sends, by the previously stated procedure, an updating program send request associated with the ADF 302 and sorter 303 together with its own ID code (including data representative of the absence of the duplex copy unit 304).

The external managing unit 2203 receives the ID code of the ADF 302 (sending the first page first), the ID code of the sorter 303 (discharging papers face up, and incorporating a turn-over mechanism), and the ID code of the copier body 301 (lacking the duplex copy unit 304) at the same time. In response, the managing unit 2203 selects out of its data base updating programs including a control command for causing the turn-over mechanism of the sorter 303 to turn over papers, and then sends them to the copier body 301 by the previously stated procedure. In this manner, when the versions as an image forming system are adjusted, the order of document pages and that of copies coincide with each other.

For the other combinations the document feed order of the ADF 302 and the paper discharge order of the sorter 303, the versions will be adjusted to cause the turn-over mechanism of the sorter 303 to operate as listed in FIG. 60. This also allows the order of document pages and the order of copy pages to coincide.

Further, assume a digital copier lacking the duplex copy unit 304 and the sorter 303 lacking the turn-over mechanism. FIG. 61 shows the possible combinations of the document feed order of the ADF 302 and the paper discharge order of the sorter 303. When the ADF 302 and sorter 303 are connected to the copier body 301, the connection check routine is executed. At this instant, the version data of the ADF 302 and those of the sorter 303 are sent to the copier body 301. Assume that the ADF 302 feeds the first page first while the sorter 303 discharges papers face up. The copier body 301 sends, by the previously stated procedure, an updating program send request associated with the ADF 302 and sorter 303 together with its own ID code (including data representative of the absence of the duplex copy unit 304).

The external managing unit 2203 receives the ID code of the ADF 302 (sending the first page first), the ID code of the sorter 303 (discharging papers face up, and lacking a turn-over mechanism), and the ID code of the copier body 301 (lacking the duplex copy unit 304) at the same time. In response, the managing unit 2203 selects out of its data base updating programs including a control command for reversing the output order from the memory (memory system described with reference to FIG. 6 and successive figures), and then sends them to the copier body 301 by the previously stated procedure. In this manner, when the versions of an image forming system are adjusted, the order of document pages and that of copies coincide with each other.

For the other combinations of the document feed order of the ADF 302 and the paper discharge order of the sorter 303, the versions will be adjusted to cause the copier body 301 to effect the reversal using the memory, as listed in FIG. 60. This also allows the order of document pages and the order of copy pages to coincide.

Figure 62:
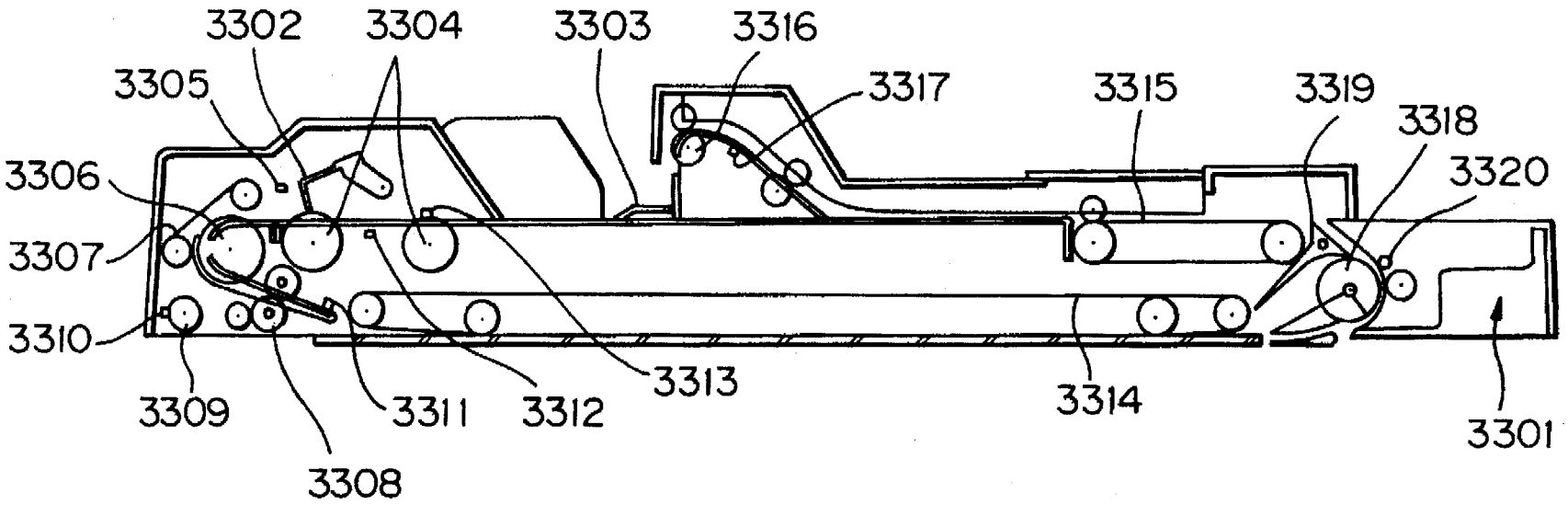
FIG. 62 shows the copier body of FIG. 1 to which a recycling document hander is connected in place of the automatic document feeder.

Referring to FIG. 62, there is shown the copier body 301 to which a recycling document handler (RDH) 3301 is connected in place of the ADF 302. When the RDH 3301 is started up, a stop pawl 3302 is raised while a push plate 3303 pushes a stack of documents toward a separating portion. When a pick-up roller 3304 completes one rotation, the RDH 3301 is ready to feed a document. When the document stack is pushed forward, a sensor 3305 turns on. After the last document has been fed out, the sensor 3305 turns off. This is the end of a single copying cycle. A roller 3306 and a belt 3307 cooperate to separate one document from the others. To sense the document size, use is made of a length sensing portion 3310 and a width sensing portion. The length sensing portion 3301 has a roller pressed against a pull-out roller 3308 and determines the rotation time of the roller with a pulse generator 3309. The width sensing portion is located at the rear of a registration detecting portion 3311. A document set sensing portion 3312 is also provided in the RDH 3301. A one-rotation sensor 3313 is mounted on the shaft of the pick-up roller 3304. A document conveyed to a discharge section by a belt 3314 is returned to a document table by a discharge roller 3316. To enhance the accurate stacking of the documents on the table, the paper discharge is decelerated when the leading edge of the document arrives at a discharge sensing portion 3317. The document is turned over by a turn roller 3318 and a turn pawl 3319. The document reaching the roller 3318 is turned over while being guided by the pawl 3319. As soon as the document moves away from a turn sensing portion 3320, a motor is reversed to return the document to a document scale.

Figure 63:
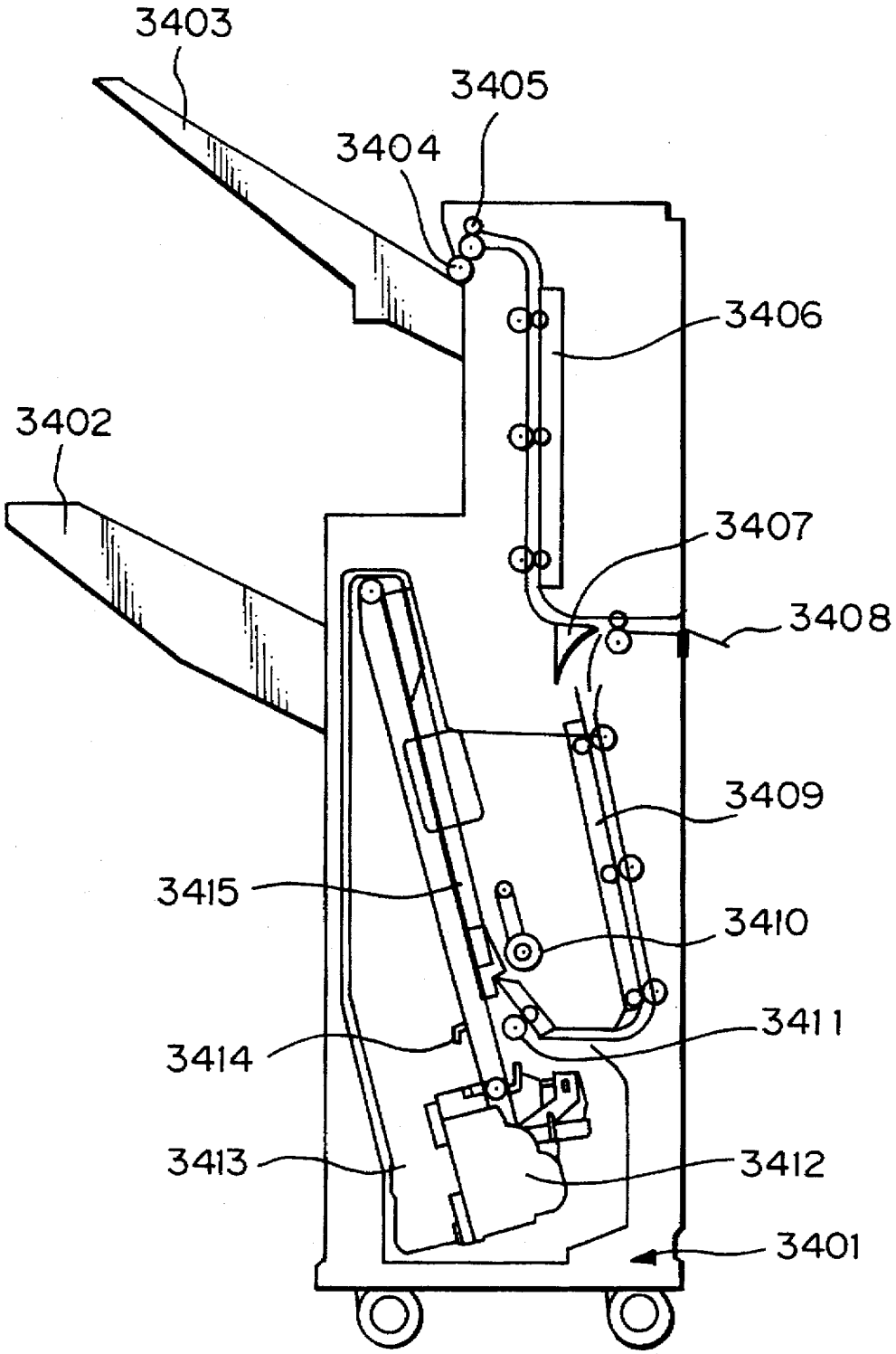
FIG. 63 shows the copier body of FIG. 1 to which a finisher is connected in place of the sorter.

FIG. 63 shows the copier body 301 to which a finisher 3401, belonging to a family of postprocessing peripherals, is connected in place of the sorter 303. When a staple mode is selected, a path selector 3414 is opened. A paper from an inlet guide 3408 is conveyed to a stapler unit 3413 via a transport unit 3409. Papers stacked in the staple unit 3413 are positioned by a shift roller 3410, a brush roller 3411, and a jogger fence 3415, and then stapled by a stapler 3412. The stapled stack is conveyed to a tray 3402 by a belt 3414. When a sort/stack mode is selected, the path selector 3407 is closed. Hence, the paper from the inlet guide 3408 is conveyed by another transport unit 3406 and then driven out to a shift tray 3403 via a shift roller 3404 and a guide discharge assembly 3405. In the sort/stack mode, the shift tray 3403 is shifted 30 mm in the transverse direction in order to sort copies set thereon. Specifically, in the sort mode, the shift tray 3403 is shifted for each set of documents. In the stack mode, it is shifted for each document.

Assume that the RDH 3301 and finisher 3401 are connected to the copier body 301. Then, the updating programs for version adjustment and for implementing an optimal image forming system may be supplied from the external managing unit 2203, as follows.

Figure 64:
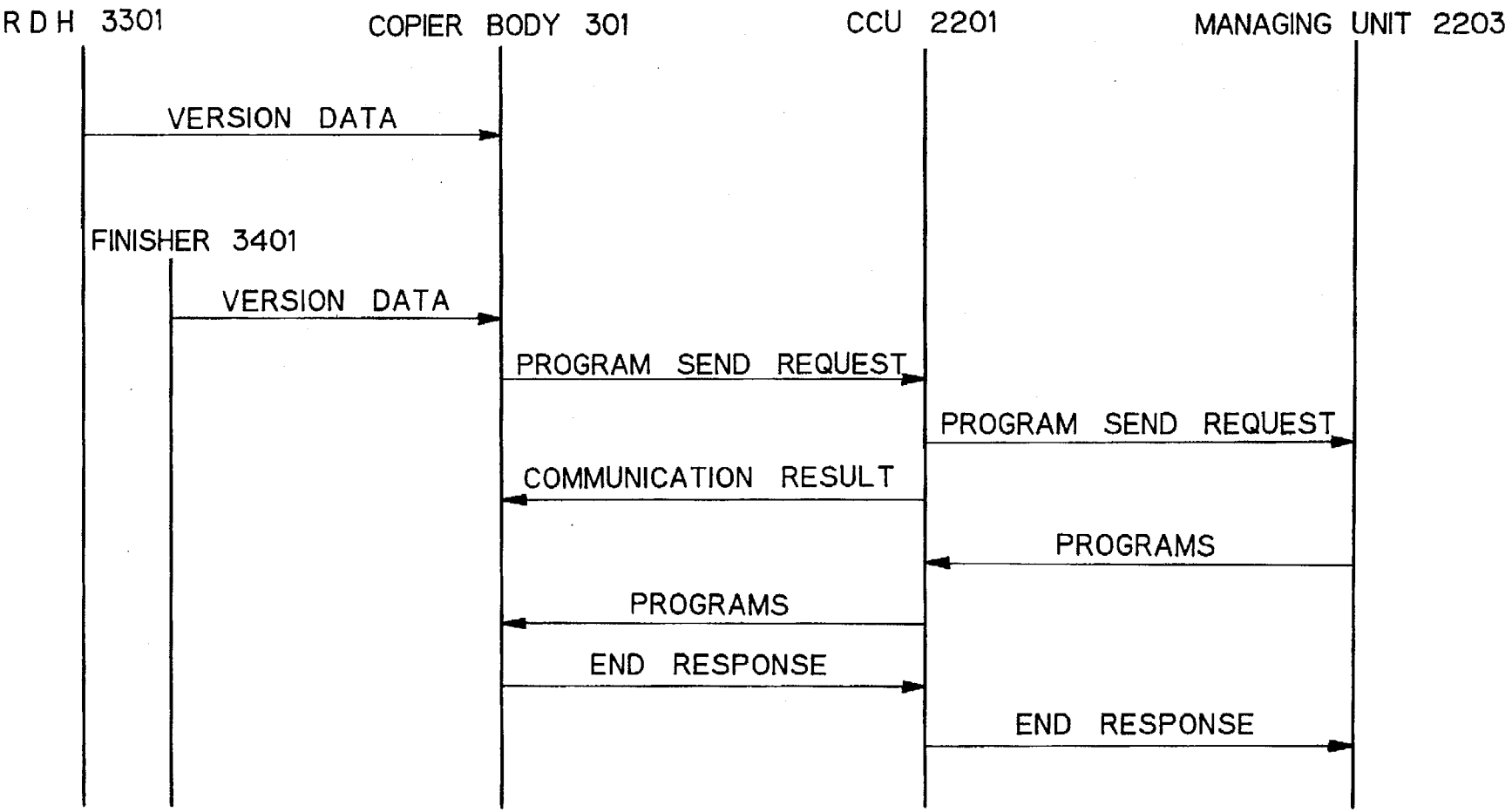
FIG. 64 is a chart representative of a procedure for supplying updating programs from the external managing unit.

As shown in FIG. 64, after the RDH 3301 and finisher 3401 have been newly connected to the copier body 301, they and the copier body 301 check their connection at the time of, for example, power up. At this instant, version data (e.g. ID codes) particular to the RDH 3301 and finisher 3401 are sent to the copier body 301. The copier body 301 compares the ID codes with its own program version. If the copier body 301 determines, as a result of the comparison, that it cannot deal with the RDH 3301 and finisher 3401 sufficiently, it sends the ID codes of the additional preprocessing and postprocessing peripherals and an updating program send request to the CCU 2201 via the USARP 633 and PI unit 626a. At the same time, the copier body 301 sends its own ID code to the CCU 2201.

In response, the CCU 2201 dials the telephone number assigned to the managing unit 2203 and stored in the RAM 2305 beforehand, and then sends the above data to the unit 2203. The managing unit 2203 is usually located at a base station and capable of interchanging data with a plurality of CCUs 2201 over the subscriber lines. After sending all the data to the managing unit 2203, the CCU 2201 returns the result of communication thereof with the managing unit 2203 to the copier body 301. This shows the copier body 301 whether or not the communication ended normally or failed due to some error. On receiving the updating program send request via the CCU 2201, the managing unit 2203 searches for adequate programs for version adjustment and for implementing an optimal image forming system stored in the memory device or data base 2402 by use of the ID codes of the additional functions and the ID code of the copier body 301. Then, the managing unit 2203 dials the CCU 2201 and then sends the programs thereto. In response, the CCU 2201 transfers such data to the copier body 301.

The copier body 301, received the updating programs via the CCU 2201, writes them in the nonvolatile RAM 629 or 614. Thereafter, the copier body 301 controls the RDH 3301 and finisher 3401 on the basis of the updating programs. Among the updating programs, the program for the display and control of a mode setting picture is transferred to the operation and display unit 2006 and written to the nonvolatile RAM 2065. This allows the unit 2006 to display mode setting keys and alert indicators associated with the additional functions and to control the display.

After the copier body 301 has written all the programs in the RAM 629 or 614 and completed the associated processing, it sends an end response to the CCU 2201. The CCU 2201 transfers the end response to the managing unit 2203. This is the end of a single processing unit. How the copier body 301 receives the updating programs and how it communicates with the CCU 2201 will not be described in order to avoid redundancy.

Hereinafter will be described a control method (based on the updating programs) coping with the combination of the order in which documents are fed and the order in which papers are discharged by the finisher 3401, as an example of optimal image forming systems including the RDH 3301 and finisher 3401.

To begin with, assume the digital copier shown in FIG. 1 and having the duplex copy unit 304. FIG. 65 shows the possible combinations of the order in which the RDH 3301 feeds document and the order in which the finisher 3401 discharges papers. When the RDH 3301 and finisher 3401 are connected to the copier body 301, the connection check routine is executed. At this instant, the version data of the RDH 3301 and those of the finisher 3401 are sent to the copier body 301. Assume that the RDH 3301 feeds the first page first while the finisher discharges papers face up. The copier body 301 sends an updating program send request associated with the RDH 3301 and finisher 3401 together with its own ID code (including data representative of the presence of the duplex copy unit 304).

The external managing unit 2203 receives the ID code of the RDH 3301 (sending the first page first), the ID code of the finisher 3401 (discharging papers face up), and the ID code of copier body 301 (having the duplex copy unit 304) at the same time. In response, the managing unit 2203 selects out of its data base updating programs including a control command for causing the duplex copy unit 304 to turn over papers, and then sends them to the copier body 301 by the previously stated procedure. In this manner, when the versions of an image forming system are adjusted, the order of document pages and that of copies coincide with each other.

For the other combinations of the document feed order of the RDH 3301 and the paper discharge order of the finisher 3401, the versions will be adjusted to cause the turn-over mechanism of the copier body 301 to operate as listed in FIG. 65. This also allows the order of document pages and the order of copy pages to coincide.

A digital copier lacking the duplex copy unit 304 which is connected to a finisher 3401 incorporating a turn-over mechanism will be described. FIG. 66 shows the possible combinations of the document feed order of the RDH 3301 and the paper discharge order of the finisher 3401. When the RDH 3301 and finisher 3401 are connected to the copier body 301, the connection check routine is executed. At this instant, the version data of the RDH 3301 and those of the finisher 3401 are sent to the copier body 301. Assume that the RDH 3301 feeds the first page first while the finisher 3401 discharges papers face up. The copier body 301 sends an updating program send request associated with the RDH 3301 and finisher 3401 together with its own ID code (including data representative of the absence of the duplex copy unit 304).

The external managing unit 2203 receives the ID code of the RDH 3301 (sending the first page first), the ID code of the finisher 3401 (discharging papers face up, and incorporating a turn-over mechanism), and the ID code of the copier body 301 (lacking the duplex copy unit 304) at the same time. In response, the managing unit 2203 selects out of its data base updating programs including a control command for causing the turn-over mechanism of the finisher 3401 to turn over papers, and then sends them to the copier body 301 by the previously stated procedure. In this manner, when the versions of an image forming system are adjusted, the order of document pages and that of copies coincide with each other.

For the other combinations of the document feed order of the RDH 3301 and the paper discharge order of the finisher 3401, the versions will be adjusted to cause the turn-over mechanism of the finisher 3401 to operate as listed in FIG. 66. This also allows the order of document pages and the order of copy pages to coincide.

Further, assume a digital copier lacking the duplex copy unit 304 which is connected to a finisher 3401 which lacks a turn-over mechanism. FIG. 67 shows the possible combinations of the document feed order of the RDH 3301 and the paper discharge order of the finisher 3401. When the RDH 3301 and finisher 3401 are connected to the copier body 301, the connection check routine is executed. At this instant, the version data of the RDH 3301 and those of the finisher 3401 are sent to the copier body 301. Assume that the RDH 3301 feeds the first page first while the finisher 3401 discharges papers face up. The copier body 301 sends, by the previously stated procedure, an updating program send request associated with the RDH 3301 and finisher 3401 together with its own ID code (including data representative of the absence of the duplex copy unit 304).

The external managing unit 2203 receives the ID code of the RDH 3301 (sending the first page first), the ID code of the finisher 3401 (discharging papers face up, and lacking a turn-over mechanism), and the ID code of the copier body 301 (lacking the duplex copy unit 304) at the same time. In response, the managing unit 2203 selects out of its data base updating programs including a control command for reversing the output order from the memory (memory system described with reference to FIG. 6 and successive figures), and then sends them to the copier body 301 by the previously stated procedure. In this manner, when the versions of an image forming system are adjusted, the order of document pages and that of copies coincide with each other.

For the other combinations of the document feed order of the RDH 3301 and the paper discharge order of the finisher 3401, the versions will be adjusted to cause the copier body 301 to effect the turn-over using the memory, as listed in FIG. 67. This also allows the order of document pages and the order of copy pages to coincide.

The ADF 302 and sorter 302 and the RDH 3301 and finisher 3401 described above match each other with respect to hardware. Hence, by adjusting the versions as an image forming system adequately, it is possible to make the most of their functions. However, when, for example, the ADF 302 and finisher 3401 are connected to the copier body 301 as a preprocessing peripheral and a postprocessing peripheral, respectively, they do not match each other with respect to hardware (function). It is, therefore, impractical to make the most of their functions even when the versions of an image forming system are adjusted. Hereinafter will be described the combination of the ADF 302 and finisher 3401.

Figure 68:
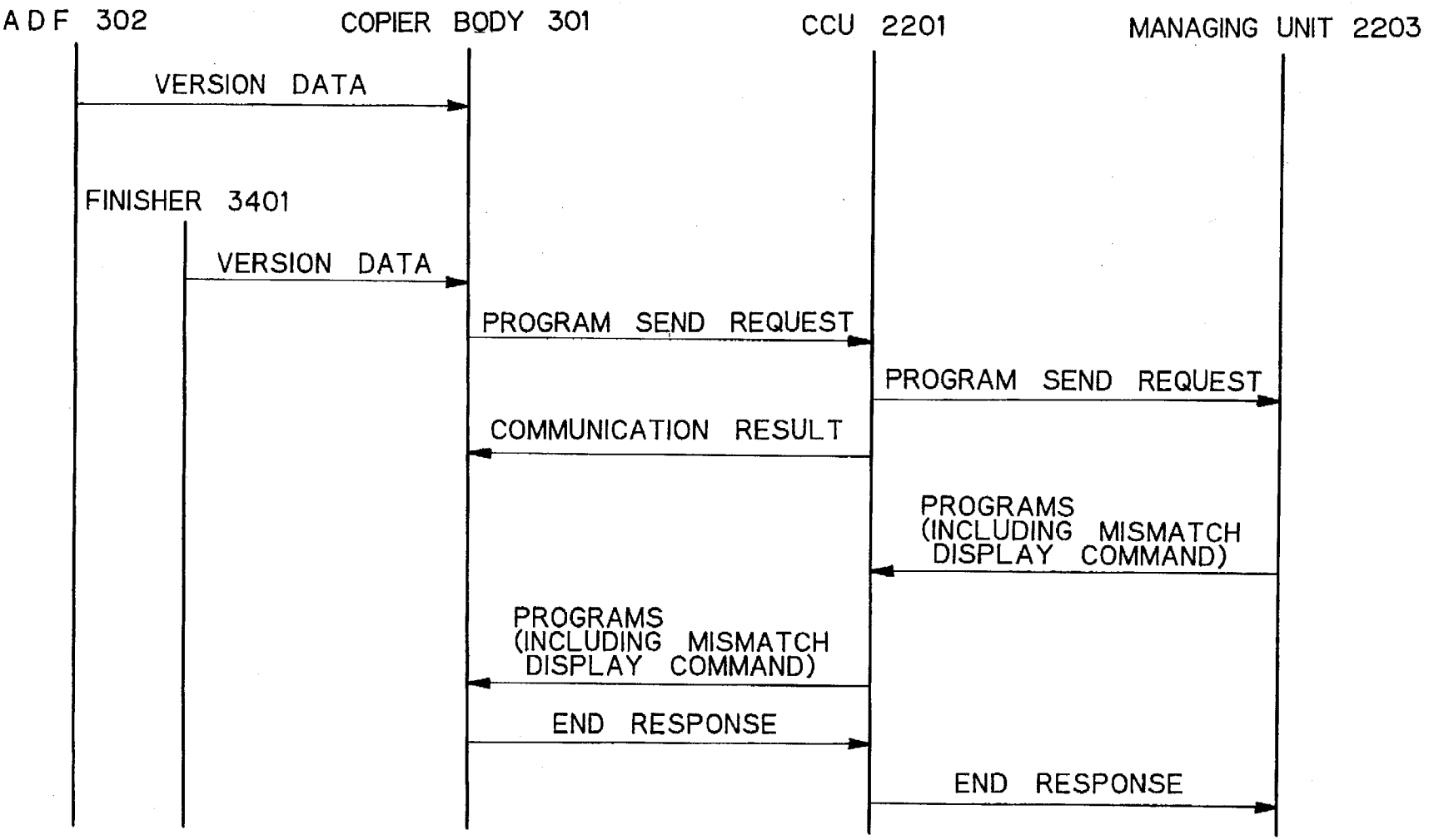
FIG. 68 shows a procedure for supplying updating programs, including a command for displaying a mismatch, from the external managing unit.

Assume that the ADF 302 and finisher 3401 are connected to the copier body 301. The finisher 3401 is a substitute for the sorter 303 in FIG. 1. FIG. 68 shows a procedure in which updating programs, including a command for displaying the mismatch, are supplied from the external managing unit 2203. As shown in FIG. 68, after the ADF 302 and finisher 3401 have been newly connected to the copier body 301, they and the copier body 301 check their connection at the time of, for example, power up. At this instant, version data (e.g. ID code) particular to the ADF 301 and finisher 3401 are sent to the copier body 301. The copier body 301 compares the ID codes with its own program version. If the copier body 301 determines, as a result of the comparison, that it cannot deal with the ADF 302 and finisher 3401 sufficiently, it sends the ID codes of the additional preprocessing and postprocessing peripherals and an updating program send request to the CCU 2201 via the USARP 633 and PI unit 626*a*. At the same time, the copier body 301 sends its own ID code to the CCU 2201.

In response, the CCU 2201 dials the telephone number assigned to the managing unit 2203 and stored in the RAM 2305 beforehand, and then sends the above data to the unit 2003. The managing unit 2203 is usually located at a base station and capable of interchanging data with a plurality of CCUs 2201 over the subscriber lines. After sending all the data to the managing unit 2203, the CCU 2201 returns the result of communication thereof with the managing unit 2203 to the copier body 301. This shows to the copier body 301 whether or not the communication ended normally or failed due to some error. On receiving the updating program send request via the CCU 2201, the managing unit 2203 searches for adequate programs for version adjustment and for implementing an optimal image forming system stored in the memory device or data base 2402 by use of the ID codes of the additional functions and the ID code of the copier body 301. Then, the managing unit 2203 dials the CCU 2201 and then sends the programs thereto. In response, the CCU 2201 transfers such data to the copier body 301. In this case, the updating programs include a command for causing the operation and display unit 2006 to display a message indicating that the preprocessing and postprocessing peripherals connected to the copier body 301 are a mismatch and should be replaced with another combination.

The copier body 301, received the updating programs via the CCU 2201, writes them in the nonvolatile RAM 629 or 614. Thereafter, the copier body 301 controls the ADF 302 and finisher 3401 on the basis of the updating programs. Among the updating programs, the program for the display and control of a mode setting picture is transferred to the operation and display unit 2006 and written to the nonvolatile RAM 2065. This allows the unit 2006 to display mode setting keys and alert indicators associated with the additional functions and to control the display. In addition, the unit 2006 displays a message representative of functions impracticable with the ADF 302 and finisher 3401 or recommending another combination.

After the copier body 301 has written all the programs in the RAM 629 or 614 and completed the associated processing, it sends an end response to the CCU 2201. The CCU 2201 transfers the end response to the managing unit 2203. This is the end of a single processing unit. How the copier body 301 receives the updating programs and how it communicates with the CCU 2201 will not be described in order to avoid redundancy.

A problem particular to the combination of the ADF 302 and finisher 3401 and a method of obviating it will be described specifically. The finisher 3401 shown in FIG. 63 discharges copies to either the staple tray 3402 or the shift tray 3403. Hence, if an electronic sorting function is not available with the copier body 301, copies cannot be sorted when a plurality of documents are copied a plurality of times, unless the finisher 3401 is combined with the RDH 3301 or similar preprocessing peripheral. When use is made of a digital copier, i.e., copier body 301 having the memory unit 1303 and memory managing unit 1801, the updating programs include the control for causing a plurality of documents to be stored in a memory, then sorted electronically, and then output. Therefore, even with the combination of the ADF 302 and finisher 3401, it is possible to sort a plurality of sets of copies by adjusting the versions of an optimal image forming system.

In summary, it will be seen that the present invention provides an image forming apparatus for a multiplex copying system and having various unprecedented advantages, as enumerated below.

(1) Peripherals to be connected to the apparatus body each stores version data particular thereto, while the apparatus body has an arrangement for processing the version data. Hence, even peripherals developed later can be connected to the apparatus body and fully exhibit their functions.

(2) The apparatus body is capable of determining whether or not its own version can be adjusted in matching relation to the peripherals on the basis of the version data, and then showing the result of decision on a display. It is, therefore, possible for the operator to see whether the peripherals are connectable or not beforehand.

(3) The peripherals each store data representative of its functions, while the apparatus body has an arrangement for controlling them on the basis of such data. Hence, the peripherals can be connected to the apparatus body even when the apparatus body lacks functions relating to the peripherals.

(4) The peripherals each store data representative of a stapling position, punching position, stamping position, or folding position, while the apparatus body has arrangements for rotating, based on such data, an image by use of a memory, rotating papers at a paper discharge section, and turning over papers. Therefore, papers can be located at any desired position without regard to the orientation of documents, despite that the stapling, punching, stamping or folding position depends on the peripheral.

(5) The peripherals each store data representative of a stapling position, punching position, stamping position, or folding position, while a document feeder has an arrangement for determining, based on such data, which of the first and last pages is to be fed first. This allows papers to be stapled, punched, stamped or folded in matching relation to the peripheral.

(6) The peripherals each store apparatus control software. The apparatus body has a function of running the software. Hence, when any of the peripherals is connected to the apparatus body, the software thereof can be installed in the apparatus body in order to adjust the version automatically.

(7) The apparatus control software includes data for adjusting the temperature of a fixing unit. When a peripheral having a short paper transport path is connected to the apparatus body, the temperature of the fixing unit is lowered. This prevents a paper from being driven before toner deposited thereon is cooled off; otherwise, the toner would be transferred to the rear of another paper.

(8) The apparatus control software includes apparatus control data (scan start timing and paper feed start timing particular to the apparatus body) matching the ability of the peripheral. Hence, even a peripheral whose ability (processing speed and path length) is different from the processing ability (CPM) can be connected to the apparatus body.

(9) In the event of version adjustment, the apparatus body controls the paper discharge order in matching relation to the paper discharging method of a peripheral. Hence, when a peripheral of the type discharging copies face up (last page first) is connected to a multiplex machine having a copy mode, facsimile mode, and a printer mode, and if the facsimile mode and printer mode each causes the first page to be discharged first, there can be obviated an occurrence that the order of pages is reversed.

(10) The apparatus body has a turn-over mechanism and turns over papers if the facsimile mode and printer mode cause the first page to be discharged first. This allows the papers to be discharged in the correct order.

(11) The apparatus body reverses the order by use of a memory and thereby saves the space available therein.

(12) The apparatus body compares the ID code of a peripheral with its own ID code and is supplied with software relating to control and the display of keys necessary for the apparatus body and peripheral to operate as a single system. Hence, the version of the apparatus body is adjusted surely and adequately in association with the version adjustment of the peripheral, thereby displaying only setting keys meant for the additional function. This ensures easy operation and allows the apparatus body or the system to exhibit the expected functions.

(13) Even when the setting keys for the additional function are newly displayed, the original setting keys remain at the same positions on a display. This makes it needless for the operator to find the original setting keys.

(14) Because setting keys not existing in the peripheral connected to the apparatus body are not displayed, the operator can see that all the keys on the display are valid at a glance.

(15) The version adjustment is efficient because only the control software and display software necessary for the adjustment are added or rewritten.

(16) The version adjustment is free from troubles because the control software and display software necessary for the adjustment are entirely rewritten.

(17) The apparatus body has a function of displaying a method of updating the programs necessary for the version adjustment. When the version adjustment is required, the apparatus body displays the method on the display. This surely informs the operator of a measure to be taken when adequate adjustment cannot be made.

(18) The apparatus body has a function of determining whether or not updated programs are adequate for version adjustment, and a function of displaying that the updated programs are defective. This obviates erroneous version adjustment.

(19) The apparatus body is connected to an external managing unit storing version programs necessary for adjustment. The apparatus body performs version adjustment on the basis of the programs supplied from the managing unit.

(20) Each peripheral stores programs necessary for version adjustment to be executed by the apparatus body. The programs are loaded in the apparatus body in the event of version adjustment, thereby promoting efficient version adjustment.

(21) A preprocessing peripheral and a postprocessing peripheral each stores version data, while the apparatus body has a function of changing its own control system on the basis of such data. Hence, the apparatus body can deal with any combination of peripherals. In addition, the peripheral can be connected to the apparatus body with ease.

(22) When an RDS and a sorter (S/S) or an ADF and a finisher, which do not sufficiently match each other, are connected to the apparatus body, the apparatus body determines that such a combination is inadequate on the basis of their version data, and displays it.

(23) An ADF and a sorter (S/S) or an RDH and a finisher each stores version data, while the apparatus body has a function of displaying their functions or controlling their operations on the basis of the version data. This allows a broad range of peripherals to be connected to the apparatus body later.

(24) An ADF and a sorter or an RDH and a finisher each stores version data, while the apparatus body has a turn-over mechanism. The apparatus body determines whether or not to turn over papers on the basis of such version data. As a result, consecutive pages can be discharged in the correct order.

(25) The tuning operation, customarily executed by hardware, is implemented by a memory, thereby saving the space available in the apparatus body.

(26) A sorter (S/S) or an RDH has a turn-over mechanism. Hence, papers can be discharged in the correct even when the apparatus body lacks a turn-over mechanism.

Various modifications will become possible for those skilled in the art after receiving the teachings of the present disclosure without departing from the scope thereof.

What is claimed is:

1. An image forming apparatus for an image forming system in which a version of a body of said apparatus is adjusted on the basis of a version of a postprocessing peripheral connected to said body, wherein said apparatus comprises a multiplex apparatus, and wherein image formation of said apparatus in a copy mode, a facsimile mode, and a printer mode is selectively controlled in matching relation to said peripheral, and further comprising a page turn-over mechanism, wherein when an order in which said peripheral discharges pages does not match an order in which said body discharges pages in the facsimile mode or the printer mode, said apparatus adjusts an order of pages by using said turnover mechanism included in said body.

2. An image forming apparatus for an image forming system in which a version of a body of said apparatus is adjusted on the basis of a version of a postprocessing peripheral connected to said body, wherein said apparatus comprises a multiplex apparatus, and wherein image formation of said apparatus in a copy mode, a facsimile mode, and a printer mode is selectively controlled in matching relation to said peripheral, and further comprising a memory for storing image data, wherein when an order in which said peripheral discharges pages does not match an order in which said body discharges pages in the facsimile mode or the printer mode, said apparatus adjusts an order of pages by once writing image data in said memory and then reversing an output order from said memory.

3. An image forming apparatus to which an indefinite peripheral is connectable, comprising:

a body; and adjusting means for adjusting a version of said body on the basis of a combination of a preprocessing peripheral and a postprocessing peripheral connected to said body, further comprising displaying means for indicating that said combination does not match with respect to hardware.

4. An apparatus as claimed in claim 3 wherein said adjusting means adjusts, when an automatic document feeder (ADF) and a sorter are connected to said body as said preprocessing peripheral and said postprocessing peripheral, a version of display software and operation control software.

5. An apparatus as claimed in claim 3, wherein when a recycling document handler (RDH) and a finisher are connected to said body as said preprocessing peripheral and said postprocessing peripheral, said adjusting means adjusts a version of display software and operation control software.

6. An image forming apparatus to which an indefinite peripheral is connectable, comprising:

a body; and adjusting means for adjusting a version of said body on the basis of a combination of a preprocessing peripheral and a postprocessing peripheral connected to said body, wherein said adjusting means adjusts, when an automatic document feeder (ADF) and a sorter are connected to said body as said preprocessing peripheral and said postprocessing peripheral, respectively, a version of display software and operation control software, and further comprising a page turn-over mechanism, wherein said adjusting means adjusts, if a combination of a document feed order of said ADF and a paper discharge direction of said sorter will reverse an order of pages of resulting copies, the order of pages by causing said turnover mechanism included in said body to operate.

7. An image forming apparatus to which an indefinite peripheral is connectable comprising:

a body;and adjusting means for adjusting a version of said body on the basis of a combination of a preprocessing peripheral and a postprocessing peripheral connected to said body, wherein said adjusting means adjusts, when an automatic document feeder (ADF) sorter are connected to said body as said preprocessing peripheral and said postprocessing peripheral respectively, a version of display software and operation control software, and further comprising a memory for storing image data, wherein said adjusting means adjusts, if a combination of a document feed order of said ADF and a paper discharge direction of said sorter will reverse an order of pages of resulting copies, the orders of pages by once writing image data in said memory and then reversing an output order from said memory.

8. An image forming apparatus to which an indefinite peripheral is connectable comprising:

a body; and adjusting means for adjusting a version of said body on the basis of a combination of a preprocessing peripheral and a postprocessing peripheral connected to said body wherein said adjusting means adjusts when an automatic document feeder and a sorter are connected to said body as said preprocessing peripheral and said postprocessing peripheral respectively a version of display software and operation control software, and further comprising a page turn-over mechanism wherein said adjusting means adjusts, if a combination of a document feed order of said ADF and a paper discharge direction of said body will reverse an order of pages of resulting copies, the order of pages by causing said turn-over mechanism included in said sorter to operate.

9. An image forming apparatus to which an indefinite peripheral is connectable, comprising:

a body; and adjusting means for adjusting a version of said body on the basis of a combination of a preprocessing peripheral and a postprocessing peripheral connected to said body, wherein when a recycling document handler(RDH) and a finisher are connected to said body as said preprocessing peripheral and said postprocessing peripheral, respectively, said adjusting means adjusts a version of display software and operation control software, and further comprising a page turn-over mechanism, wherein said adjusting means adjusts, if a combination of a document feed order of said RDH and a paper discharge direction of said finisher will reverse an order of pages of resulting copies, the order of pages by causing said turn-over mechanism included in said body to operate.

10. An image forming apparatus to which an indefinite peripheral is connectable comprising:

a body; and adjusting means for adjusting a version of said body on the basis of a combination of a preprocessing peripheral and a postprocessing peripheral connected to said body wherein when a recycling document handler (RDH) and a finisher are connected to said body as said preprocessing peripheral and said postprocessing peripheral, respectively, said adjusting means adjusts a version of displayed software and operation control software, and further comprising a memory for storing image data, wherein said adjusting means adjusts, if a combination of a document feed order of said RDH and a paper discharge direction of said finisher will reverse an order of pages of resulting copies, the order of pages by once writing image data in said memory and then reversing an output order from said memory.

11. An image forming apparatus to which an indefinite peripheral is connectable, comprising:

a body; and adjusting means for adjusting a version of said body on the basis of a combination of a preprocessing peripheral and a postprocessing peripheral connected to said body, wherein when a recycling document handler (RDH) and a finisher are connected to said body as said preprocessing peripheral and said postprocessing peripheral, respectively, said adjusting means adjusts a version of displayed software and operation control software, and further comprising a page turn-over mechanism, wherein said adjusting means adjusts, if a combination of a document feed order of said RDH and a paper discharge direction of said finisher will reverse an order of pages of resulting copies, the order of pages by causing said turn-over mechanism included in said finisher to operate.

12. An image forming apparatus having a body with a display which is connectable to various peripherals, said apparatus comprising:

a control portion in said body that stores version data in a first memory, said stored version data permitting said body to be compatible with various identified peripherals to perform functions added by said peripherals;

a checking portion in said body that automatically determines if any peripheral connected to said body is one of said identified peripherals or an unidentified peripheral lacking said stored version data; and a storage adjusting portion that causes the introduction of updated version data into storage in said first memory to change the status of an unidentified peripheral to that of an identified peripheral.

13. An apparatus as claimed in claim 12, said control portion further comprising:

a retrieval controller which controls retrieval of said stored version data from said first memory, said version data including display control data; and display controller connected to receive said display control data provided from said retrieval controller to control said display so as to provide guidance and how to obtain performance of functions being added by the connected peripheral that are lacking in the body.

14. An apparatus as claimed in claim 13, wherein when the functions lacking in the body relate to stapling and the connected peripheral includes such stapling functions, the display controller controls said display so as to provide guidance relative to performing the various stapling functions available from the connected peripheral.

15. An apparatus as claimed in claim 14, wherein said display controller controls said display to provide guidance as to various stapling positions and stapling patterns that can be selected as to performing the stapling functions of the connected peripheral.

16. An apparatus as claimed in claim 13, wherein when the functions lacking in the body relate to punching and the connected peripheral includes such punching functions, the display controller controls said display so as to provide guidance relative to performing the various punching functions available from the connected peripheral.

17. An apparatus as claimed in claim 13, wherein when the functions lacking in the body relate to folding and the connected peripheral includes such folding functions, the display controller controls said display so as to provide guidance relative to performing the various folding functions available from the connected peripheral.

18. An apparatus as claimed in claim 13, wherein when the functions lacking in the body relate to stamping and the connected peripheral includes such stamping functions, the display controller controls said display so as to provide guidance relative to performing the various stamping functions available from the connected peripheral.

19. An apparatus as claimed in claim 13, wherein when the functions lacking in the body relate to providing mailbox functions and the connected peripheral includes such mail box functions, the display controller controls said display so as to provide guidance relative to performing the various mailbox functions available from the connected peripheral.

20. An apparatus as claimed in claim 12, said control portion further comprising:

a retrieval controller which controls retrieval of said stored version data from said first memory, said version data including body control data; and a body controller connected to receive said body control data provided from said retrieval controller to control a portion of said body so as to be compatible with the connected peripheral in performing the functions added by said peripheral.

21. An apparatus as claimed in claim 20, wherein the peripheral includes structure for performing a function selected from the group consisting of stapling, punching, stamping, folding and any combination thereof.

22. An apparatus as claimed in claim 20, further comprising:

a document feeder as said portion of said body; and wherein said body controller controls said document feeder so as to be compatible with the connected peripheral.

23. An apparatus as claimed in claim 20, wherein said storage adjusting portion cooperates with said unidentified peripheral to supply said updated version data including body control data from said unidentified peripheral to said storage adjusting portion for storage in said first memory.

24. An apparatus as claimed in claim 23, further comprising:

a fixing temperature adjuster as said portion of said body; and wherein said body controller controls said fixing temperature adjuster to variably adjust the fixing temperature of said body to be compatible with the connected peripheral processing requirements.

25. An apparatus as claimed in claim 23, further comprising:

a processing speed adjuster as said portion of said body; and wherein said body controller controls said processing speed adjuster to variably adjust the processing speed of said body to be compatible with the connected peripheral processing speed requirements.

26. An apparatus as claimed in claim 23, further comprising:

an image mode selector as said portion of said body; and wherein said body controller controls said body image mode selector to select one of a copy mode, a facsimile mode, and a printer mode to be compatible with the connected peripheral processing requirements.

27. An apparatus as claimed in claim 26, further comprising:

a turn-over mechanism in said body; and wherein said body controller additionally controls said turn-over mechanism to adjust the order of pages when an order in which said connected peripheral discharges pages in a selected printer mode or facsimile mode does not match an order in which said body discharges pages in either one of these selected modes.

28. An apparatus as claimed in claim 26, further comprising:

a second memory for storing image data in said body; and wherein said body controller controls said second memory to adjust the order of pages by causing the writing of image data into said second memory in a particular order and then reversing an output order of the data written into said second memory when an order in which a connected peripheral discharges pages in a selected printer mode or a facsimile mode does not match an order in which said body discharges pages in either one of these selected modes.

29. An apparatus as claimed in claim 12, said control portion further comprising:

a retrieval controller which controls retrieval of said stored version data from said first memory, said version data including display control data; and a display controller connected to receive said display control data and to operate therewith to control said display to show only function setting keys that correspond to functions selectable for performance by the apparatus which are compatible with the body and the particular peripherals that are connected thereto.

30. An apparatus as claimed in claim 29, further comprising:

a function setting key manipulation detector which detects operator selection of a displayed function setting key and which then initiates the particular selected function associated therewith.

31. An apparatus as claimed in claim 29, wherein said display control data and said display controller cooperate to provide a display in which predetermined portions of the display are reserved for display of selected function setting keys associated with particular types of connected peripherals and other display portions are reserved for the display of body function setting keys.

32. An apparatus as claimed in claim 29, wherein the storage adjusting portion causes the introduction of said updated version data including display control data into storage into said first memory by adding new data to data already existing in said first memory.

33. An apparatus as claimed in claim 29, wherein the storage adjusting portion causes the introduction of said updated version data including display control data into storage into said first memory by rewriting all of the data existing in said memory.

34. An apparatus as claimed in claim 29, further comprising:

an external data management unit; and wherein said external data management unit cooperates with said storage adjusting portion to supply said updated version data including display control data from said external data management unit to said storage adjusting portion for storage in said first memory.

35. An image forming multiplex apparatus having a main body which is connectable with various peripherals, said multiplex apparatus comprising:

a control portion in said main body that selects at least one of a copy mode, facsimile mode, and printer mode for said multiplex apparatus operations;

said control portion including an applications control circuit which controls data interchanges between said multiplex apparatus and external devices and networks in any selected mode;

a memory storing version data required for the compatible operation of the main body with connected peripheral;

said control portion further including a memory accessing segment which controls access to the version data in said memory;

a checking portion in said main body that automatically determines if any peripheral connected to said main body is an identified peripheral for which said version data has been previously stored in said memory or an unidentified peripheral for which no said version data or incomplete version data has been previously stored in said memory;

a storage adjusting portion responsive to the checking portion which causes updated version data needed for main body compatibility with a connected unidentified peripheral to be added to the stored version data in said memory by said memory accessing segment;

a retrieval controller connected to control the accessing segment to retrieve one of said version data and said updated version data from said memory based upon the nature of the peripheral connected to the main body as determined by the checking portion; and an operations controller connected to receive said version data or said updated version data retrieved from said memory as operation control data and to use said operation control data to control said main body and said connected peripheral.

36. The multiplex apparatus of claim 35, wherein said connected peripheral is a sorter having a plurality of bins and wherein said operations controller controls said sorter to distribute received document copies into selected ones of said bins when said multiplex apparatus is in a selected facsimile mode so that said bins act as mailbox slots for the deposit of facsimile documents.

37. The multiplex apparatus of claim 35, wherein said connected peripheral is a post processing peripheral.

38. The multiplex apparatus of claim 37, further comprising:

a turn-over mechanism in said main body; and wherein said operations controller additionally controls said turn-over mechanism to adjust the order of pages when an order in which said post processing peripheral discharges pages in a selected printer mode or facsimile mode does not match an order in which said main body discharges pages in either one of the selected printer mode or the selected facsimile mode.

39. The multiplex apparatus of claim 37, further comprising:

a turn-over memory in said main body; and wherein said operations controller additionally controls said turn-over memory to adjust the order of pages by causing the writing of image data into said turn-over memory in a particular order and then reversing an output order of the image data written into the turn-over memory when an order in which said post processing peripheral discharges pages in a selected printer mode or facsimile mode does not match an order in which said body discharges pages in either of the selected printer mode or the selected facsimile mode.

* * * * *